US007034514B2

(12) United States Patent
Tachibana et al.

(10) Patent No.: US 7,034,514 B2
(45) Date of Patent: Apr. 25, 2006

(54) SEMICONDUCTOR INTEGRATED CIRCUIT USING BAND-GAP REFERENCE CIRCUIT

(75) Inventors: Suguru Tachibana, Kawasaki (JP); Tatsuo Kato, Kawasaki (JP); Tomonari Morishita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 21 days.

(21) Appl. No.: 10/808,532

(22) Filed: Mar. 25, 2004

(65) Prior Publication Data

US 2005/0088163 A1 Apr. 28, 2005

(30) Foreign Application Priority Data

Oct. 27, 2003 (JP) ..... 2003-366085

(51) Int. Cl.
*G05F 3/16* (2006.01)
*G05F 3/20* (2006.01)

(52) U.S. Cl. ..... 323/313; 323/315; 327/539

(58) Field of Classification Search ..... 323/313, 323/314, 315; 327/539
See application file for complete search history.

(56) References Cited

U.S. PATENT DOCUMENTS

| | | | | |
|---|---|---|---|---|
| 5,952,873 | A * | 9/1999 | Rincon-Mora | 327/539 |
| 6,356,064 | B1 * | 3/2002 | Tonda | 323/313 |
| 6,392,470 | B1 * | 5/2002 | Burstein et al. | 327/539 |
| 6,906,581 | B1 * | 6/2005 | Kang et al. | 327/539 |

FOREIGN PATENT DOCUMENTS

| | | |
|---|---|---|
| JP | 05-204479 | 8/1993 |
| JP | 06-309052 | 11/1994 |
| JP | 08-186484 | 7/1996 |
| JP | 10-198447 | 7/1998 |
| JP | 2001-147725 | 5/2001 |
| JP | 2002-99336 | 4/2002 |
| JP | 2003-78366 | 3/2003 |

OTHER PUBLICATIONS

G. Tzanateas, C.A.T. Salama, and Y.P. Tsividis, "A CMOS Bandgap Voltage Reference," IEEE Journal of Solid-State Circuits, vol. SC-14, No. 3, pp. 655-657, Jun. 1979.

(Continued)

*Primary Examiner*—Bao Q. Vu
(74) *Attorney, Agent, or Firm*—Arent Fox PLLC

(57) ABSTRACT

A semiconductor device is disclosed including a current generator circuit that generates a first current substantially proportional to an absolute temperature, the first current being determined by a size ratio of a MOS transistor, and by a resistor; and a starting-up circuit that causes the current generator circuit to generate the first current at a stable working point of the current generator circuit, wherein while the current generator circuit operates at the stable working point, a current that flows through the starting-up circuit is determined by a diffusion resistance and a MOS transistor. When the current generator circuit starts operating at a stable operating point, resistance of the diffusion resistor and a MOS transistor connected in series determines a current that flows through a starting-up circuit. According to the above arrangements, the power consumption of the circuit can be reduced by increasing the resistance of the diffused resistor.

11 Claims, 43 Drawing Sheets

OTHER PUBLICATIONS

K.N. Leung, and P. K. T. Mok, "A Sub-1-V 15-ppm/° C. CMOS Bandgap Voltage Reference Without Requiring Low Threshold Voltage Devices," IEEE Journal of Solid-State Circuits, vol. 37, No. 4, pp. 526-530, Apr. 2002.

A. Boni, "Op-Amps and Startup Circuits for CMOS Bandgap References With Near 1-V Supply," IEEE Journal of Solid-State Circuits, vol. 37, No. 10, pp. 1339-1343, Oct. 2002.

H. Banba, H. Shiga, A. Umezawa, T. Miyaba, T. Tanzawa, S. Atsumi, and K. Sakui, "A CMOS Bandgap Reference Circuit with Sub-1-V Operation," IEEE Journal of Solid-State Circuits, vol. 34, No. 5, pp. 670-674, May 1999.

* cited by examiner

SEMICONDUCTOR INTEGRATED CIRCUIT USING BAND-GAP REFERENCE CIRCUIT

CROSS-REFERENCE TO RELATED APPLICATIONS

This application is based upon and claims the benefit of priority from the prior Japanese Patent Application No. 2003-366085, filed on Oct. 27, 2003, the entire contents of which are incorporated herein by reference.

BACKGROUND OF THE INVENTION

1. Field of the Invention

The present invention generally relates to a semiconductor integrated circuit, and more particularly, to a bandgap circuit that operates at a low voltage, a bias current generation circuit, and a low voltage detection circuit that uses the bandgap circuit.

2. Description of the Related Art

A bandgap circuit is an analog circuit for generating a reference voltage independent of temperature and a power supply voltage. The bandgap circuit is widely used for analog integrated circuits, especially for CMOS analog integrated circuits that constitute a digital and analog mixed integrated circuit.

The bandgap circuit generates a reference voltage that does not depend on temperature by adding a voltage of a forward-biased pn junction and a voltage Proportional To Absolute Temperature (PTAT). Various bandgap circuits are proposed and used in practice.

FIG. 1 is a circuit diagram showing a conventional bandgap circuit. FIG. 2 is a circuit diagram showing another conventional bandgap circuit. FIG. 3 is a circuit diagram showing a conventional bias voltage generator circuit.

In FIG. 1, Q1, Q2, and Q3 denote pnp bipolar transistors. R1 and R2 denote resistors. Vref denotes an output reference voltage. Vdd denotes a positive power supply voltage. GND denotes a ground terminal. NM1 and NM2 denote NMOS transistors. PM1, PM2, and PM3 denote PMOS transistors. "10" denotes a bias voltage applied to the PMOS transistor. "20" denotes a bias voltage applied to the NMOS transistor. "30" through "33" denote internal nodes.

The ratio W/L (W: gate width, L: gate length) of the PM1, PM2, and PM3 is assumed to be equal to each other. The ratio W/L of the NM1 and NM2 is also assumed to be equal to each other, for example. Additionally, the ratio of emitter junction areas of Q1 and Q2 is assumed to be 1:6, for example.

The relation between the forward voltage (Vbe) of the pn junction and absolute temperature (T) can be approximated by the following formula (1):

$$Vbe=Veg-aT \tag{1}$$

where Veg is the bandgap voltage of silicon, and "a" is temperature dependency of Vbe. Veg is approximately 1.2 V, and "a" is approximately 2 mV/° C.

The relation between an emitter (or diode) current (I) and the forward voltage (Vbe) of a bipolar transistor can be approximated by the following formula (2):

$$I=I0*\exp(qVbe/kT) \tag{2}$$

where I0 is a constant proportional to the area of the emitter, q is the charge of an electron, and k is the Boltzman constant.

In FIG. 1, the gate electrodes of PM1 and PM2 are common, and as a result, the same current flows through PM1, PM2, NM1, NM2, Q1, and Q2. Since the same current flows through NM1 and NM2, a voltage at the internal node 30 and a voltage at the internal node 31 are equal. Because the ratio in the junction area between Q1 and Q2 is 1:6, the current that flows through Q1 and Q2 may be obtained as follows:

$$Q1\ \text{current}=I0*\exp(qVbe1/kT)$$

$$Q2\ \text{current}=6*I0*\exp(qVbe2/kT)$$

where Vbe1 is the Vbe of Q1 and Vbe2 is the Vbe of Q2. By setting the above Q1 current and Q2 current equal, and resolving the equation for Vbe1−Vbe2, voltage VR1 between both ends of the resistor R1 is obtainable as follows:

$$VR1=(kT/q)*\ln(6) \tag{3}$$

Accordingly, the current Ip that flows through PM1 and PM2 is:

$$Ip=(1/R1)*(kT/q)*\ln(6) \tag{4}$$

where R1 is the resistance of R1. Because the same current flows through PM3, the voltage drop VR2 at the resistor R2 is:

$$VR2=(R2/R1)*(kT/q)*\ln(6) \tag{5}$$

where R2 is the resistance of R2.

The sum of the voltage drop VR2 by the resistor R2 and the Vbe of Q3 is a reference voltage Vref. As temperature rises, the forward voltage Vbe of pn junction is reduced (negative temperature dependency) as shown in formula (1), but the voltage drop VR2 at the resistor R2 increases as shown in formula (5). If the values of elements are appropriately determined, the reference voltage Vref becomes independent of temperature. In such a case, the reference voltage Vref becomes approximately 1.2 V, which voltage is the bandgap voltage of silicon.

As described above, the conventional bandgap circuit shown in FIG. 1 can generate a bandgap voltage that does not depend on temperature by appropriately determining the junction area ratio of PM1, PM2, PM3, NM1, NM2, Q1, and Q2, and the values of R2 and R1.

The conventional circuit shown in FIG. 2, although different in structure from that shown in FIG. 1, can generate a reference voltage that does not depend on temperature in the same manner. The circuit shown in FIG. 2 is disclosed in the following documents: Japanese Laid-Open Patent Applications No. 8-186484 and No. 2001-147725. Similar circuits are disclosed in the following documents:

Japanese Laid-Open Patent Applications:

No. 2002-99336, No. 2003-78366, No. 10-198447, No. 5-204479, and No. 6-309052.

1) G. Tzanateas, C. A. T. Salama, and Y. P. Tsividis, "A CMOS Bandgap Voltage Reference," IEEE Journal of Solid-State Circuits, Vol. SC-14, No. 3, pp. 655–657, June 1979, for example.

In FIG. 2, D1 denotes a diode. R1, R2, and R3 denote resistors. Vref and Vdd denote an output reference voltage and a positive power supply voltage, respectively. GND denotes a ground terminal. NM3 and NM4 denote NMOS transistors. PM1, PM2, PM3, PM7, and PM8 denote PMOS transistors. "10" denotes a bias voltage of the PMOS transistors PM1 and PM2. "21" denotes the bias voltage of the NMOS transistors NM3 and NM4. "33", "35", and "90"

denote internal nodes. Components identical to those shown in FIG. 1 are referred to by the same reference symbols in FIG. 2.

For example, the ratio W/L (W: gate width, L: gate length) of PM1, PM2, and PM3 is assumed mutually equal. The W/L ratio of NM3 and NM4 is assumed 1:6, for example. NM3 and NM4 are designed to operate in a sub-threshold region.

Assuming a voltage between the gate and the source of an NMOS transistor is Vgs, the relation between a drain current ID and the voltage Vgs in the drain region can be approximated as follows:

$$ID=I0*\exp(qVgs/nkT) \quad (6)$$

where I0 is a constant proportional to W, "q" is the charge of an electron, "k" is the Boltzmann constant, T refers to absolute temperature, "n" refers to a constant depending on the capacitance of an oxide layer and the capacitance of a depletion layer. The "n" of an NMOS transistor is generally about 1.3, for example.

The gate of PM1 and the gate of PM2 are connected to each other, and as a result, the same current flows through PM1, PM2, NM3, NM4, and R1. Since the current flowing through NM3 is equal to the current flowing through NM4, and both the ratio W/L of NM3 and the ratio N/W of NM4 are assumed to be 1:6, a voltage VR1 between both ends of the resistor R1 can be approximated in the same manner as the above formula (3) as follows:

$$VR1=(nkT/q)*\ln(6) \quad (7)$$

Because the voltage VR1 between both ends of the resistor R1 is computable by the formula (7), a current Ip that flows through PM1 and the same current Ip that flows through PM2 can be expressed as follows:

$$Ip=(1/R1)*(nkT/q)*\ln(6) \quad (8)$$

The same current Ip flows through PM3. The formula (8) shows that, if the temperature dependency of resistance is ignored, the current Ip that flows through PM3 is proportional to temperature. Because the same current flows through the resistor R2 and the diode D1, the reference voltage Vref can be expressed by the following formula:

$$Vref=Vbe+(R2/R1)*(nkT/q)*\ln(6) \quad (9)$$

where Vbe is a forward voltage of D1, and R2 is the resistance of the resistor R2.

Vbe negatively depends on temperature. Accordingly, if parameters are appropriately determined so that the term (R2/R1)*(nkT/q)*ln(6) cancels the negative dependency of Vbe on temperature, the reference voltage Vref can be made indifferent of temperature. According to the above arrangements, the reference voltage Vref is made equal to the bandgap voltage of silicon, which is approximately 1.2 V.

As described above, if parameters of PM1, PM2, PM3, NM3, NM4, R2, and R1 are appropriately determined, the conventional circuit shown in FIG. 2, although it is relatively simple, can generate a bandgap voltage independent of temperature. The accuracy of the circuit shown in FIG. 1 is high because it uses the bipolar transistors. However, the circuit shown in FIG. 1 requires a high voltage to operate the PMOS transistor, the NMOS transistor, and the bipolar transistor connected in series. The circuit shown in FIG. 2 operates at a low voltage, and solves the above problem of the circuit shown in FIG. 1.

FIG. 3 is a circuit diagram showing a conventional bias current generator circuit for generating a bias current. The bias current generator circuit shown in FIG. 3 generates a bias current proportional to absolute temperature. For example, the circuit including PM3, R2, and D1 shown in FIG. 2 generates a reference voltage Vref using the bias current generated by the bias current generator circuit shown in FIG. 3. Components identical to those shown in FIG. 2 are referred to by the same reference symbols in FIG. 3.

The conventional bias current generator circuit shown in FIG. 3 generates a bias current proportional to absolute temperature (as computed by formula (8)) in the same manner as the conventional bandgap circuit shown in FIG. 2.

A portion BLK1 of the circuit shown in FIG. 3 operates as a starting-up circuit. The other portion of the circuit including a loop of PM1, PM2, NM3, NM4, and R1 is stable at a stable point computed by the formula (8), but is also stable at another stable point in which no current flows at all. The starting-up circuit BLK1 solves this problem.

When the circuit is at the undesired stable point in which no current flows, a voltage at an internal node 10 becomes Vdd, and a voltage at an internal node 21 becomes GND. Since NM6 is off in this case, a current that flows through PM4 retains a voltage at an internal node 34 at Vdd. When the voltage at the internal node 34 becomes Vdd, NM5 is turned on, and a current starts flowing through PM2. When the current starts flowing through PM2, a current starts flowing through PM1, and the circuit is transferred to the stable point of the formula (8).

When a current starts flowing through PM1, PM2, NM3, NM4, and R1, a current starts flowing through NM6. A voltage at the internal node 34 becomes about the level of GND, and as a result NM5 is turned off. According to the above arrangements, the starting-up circuit BLK1 is cut off the loop including PM1, PM2, NM3, NM4, and R1.

FIG. 4 is a circuit diagram showing yet another conventional bandgap circuit.

In FIG. 4, Q1 and Q2 denote pnp bipolar transistors. R1, R2, and R2' denote resistors. Vref and Vdd denote an output reference voltage and a positive power supply, respectively. GND denotes a ground terminal. PM1 and PM2 denote PMOS transistors. "11" denotes the bias voltage (output of an operational amplifier) of the PMOS transistors. "30", "31", and "32" denote internal nodes. OP1 denotes an operational amplifier. Components identical to those shown in FIG. 1 are referred to by the same symbols in FIG. 4.

For example, the ratio W/L (W: gate width, L: gate length) of PM1 and PM2 is assumed mutually equal. The junction area ratio of Q1 and Q2 is assumed 1:6, for example. The resistance of the resistor R2 and the resistance of the resistor R2' are assumed equal to each other.

The base-emitter voltage Vbe of a bipolar transistor and the forward voltage Vbe of pn junction are related as shown in the formula (1). The emitter current I of the bipolar transistor and the voltage Vbe are related as shown in the formula (2).

Since the gate of PM1 and the gate of PM2 are connected, the same current flows through PM1, PM2, Q1, Q2, R1, R2, and R2'. The negative feedback of OP1 makes a voltage at the node 30 and a voltage at the node 31 substantially equal to each other, and makes the circuit stable. Since the voltage at the node 30 and the voltage at the node 31 are equal to each other, and the junction area ratio between Q1 and Q2 is 1:6, a voltage VR1 between both ends of the resistor R1 can be computed as the formula (3). A current Ip as shown by the above formula (3) flows through PM1 and PM2. Because the current Ip flows through the resistor R2, a voltage drop VR2 caused by the resistor R2 is expressed by the above formula (5). A reference voltage Vref is the sum of the voltage drop VR2 caused by the resistor R2 and the Vbe of Q3. The forward voltage Vbe of the pn junction negatively depends on temperature, and the voltage drop VR2 caused by the resistor R2 has a positive dependency on temperature. Accordingly, if parameters are appropriately determined, the reference voltage Vref can be made independent of temperature. The voltage Vref becomes about 1.2 V, which corresponds to the bandgap voltage of silicon. As described above, if parameters such as the sizes of PM1 and PM2, the junction area ratio between Q1 and Q2, and the resistances of R2 and R1 are appropriately determined, the simple conventional circuit shown in FIG. 4 using an operational amplifier can generate the bandgap voltage independent of temperature. The conventional bandgap circuit using an operational amplifier is disclosed in the following documents:

2) K. N. Leung, and P. K. T. Mok, "A Sub-1-V 15-ppm/CMOS Bandgap Voltage Reference Without Requiring Low Threshold Voltage Devices," IEEE Journal of Solid-State Circuits, Vol. 37, No. 4, pp. 526–530, April 2002.

3) A. Boni, "Op-Amps and Startup Circuits for CMOS Bandgap References With Near 1-V Supply," IEEE Journal of Solid-State Circuits, Vol. 37, No. 10, pp. 1339–1343, October 2002.

4) H. Banba, H. Shiga, A. Umezawa, T. Miyaba, T. Tanzawa, S. Atsumi, and K. Sakui, "A CMOS Bandgap Reference Circuit with Sub-1-V Operation," IEEE Journal of Solid-State Circuits, Vol. 34, No. 5, pp. 670–674, May 1999.

One of the applications of the bandgap circuits shown in FIGS. 1, 2, and 4 is the detecting of a low voltage. A determination can be made whether a power supply voltage, for example, is lower than a predetermined voltage by dividing the power supply voltage and comparing the divided power supply voltage with the reference voltage of a bandgap circuit that is independent of the power supply voltage and temperature. If a determination is made that the power supply voltage is lower than the predetermined voltage, the operation of circuits to which the power supply voltage is provided may be stopped for avoiding any erroneous operation.

SUMMARY OF THE INVENTION

A semiconductor integrated circuit according to the present invention, includes:

a current generator circuit that generates a first current substantially proportional to an absolute temperature, the first current being determined by a size ratio of a MOS transistor, and by a resistor; and a starting-up circuit that causes said current generator circuit to generate the first current at a stable working point of said current generator circuit, wherein while said current generator circuit operates at the stable working point, a current that flows through said starting-up circuit is determined by a diffusion resistance and a MOS transistor connected in series.

The semiconductor integrated circuit according to the present invention, may further includes:

a voltage generator circuit that generates a reference voltage substantially independent of the absolute temperature using the first current generated by said current generator circuit.

A semiconductor integrated circuit according to another aspect of the present invention, includes:

a first NMOS transistor that is provided with a voltage to a gate thereof, which voltage is generated by dividing a power supply voltage with resistors;

a second NMOS transistor that is provided with a reference voltage to a gate thereof;

a first PMOS transistor and a second PMOS transistor diode-connected to each other;

a third PMOS transistor, a gate of which is connected to a gate electrode of said first PMOS transistor;

a fourth PMOS transistor, a gate of which is connected to a gate electrode of said second PMOS transistor;

a third NMOS transistor connected as a diode;

a fourth NMOS transistor, a gate of which connected to the gate of said third NMOS transistor; and a first resistor, wherein a source electrode of said first NMOS transistor and a source electrode of said second NMOS transistor are connected together;

a drain of said first NMOS transistor and a drain of said first PMOS transistor are connected together;

a drain of said second NMOS transistor and a drain of said second PMOS transistor are connected together;

a drain of said third PMOS transistor and a drain of said third NMOS transistor are connected together;

a drain of said fourth PMOS transistor and a drain of said fourth NMOS transistor are connected together;

a first end of said first resistor is connected to the power supply voltage;

a second end of said first resistor is connected to the drain of said fourth PMOS transistor and to the drain of said fourth NMOS transistor; and the semiconductor integrated circuit outputs a voltage of the second end of said first resistor for determining whether the power supply voltage is lower than a predetermined voltage.

A semiconductor integrated circuit according to yet another aspect of the present invention, includes:

a first pnp bipolar transistor;

a second pnp bipolar transistor;

a first resistor connected in series to an emitter of said first pnp bipolar transistor;

a second resistor connected in series to an emitter of said second pnp bipolar transistor;

a third resistor connected in series to an end of said first resistor, resistance of said third resistor is equal to the resistance of the second resistor;

an operational amplifier that is provided with a voltage generated by level-shifting an emitter voltage of said second pnp bipolar transistor to a positive direction with said second resistor as a first input, and with a voltage generated by level-shifting a voltage at the end of said first resistor to a positive direction with said third resistor as a second input, wherein said operational amplifier receives the first input and the second input as a gate input of a differential pair of NMOS transistors, and is negatively fed back so that a voltage of the first input and a voltage of the second input are equalized.

In an embodiment of the invention, when the current generator circuit starts operating at a stable operating point, resistance of the diffusion resistor and a MOS transistor connected in series determines a current that flows through a starting-up circuit. According to the an arrangement of the invention, the power consumption of the circuit can be reduced by increasing the resistance of the diffused resistor.

Additionally, the operating voltage of the circuit can be lowered by increasing the W/L ratio of the MOS transistor so as to avoid the increase in Vth due to a narrow channel effect.

The circuit may include the first element that generates a voltage that is substantially linearly reduced as the absolute temperature is increased and a resistor division circuit connected to the first element in parallel. The bandgap voltage may be divided using the resistor division circuit. Additionally, a current having positive temperature dependency may be provided to the resistor division circuit thereby to cancel the negative temperature dependency of the divided bandgap voltage. Accordingly, a reference voltage that does not depend on absolute temperature can be generated.

In an embodiment of the invention, the input stage of the operational amplifier may be structured by a differential pair of NMOS transistors, and a potential increased (level shifted to the positive direction) by a resistor may be input to the operational amplifier. Accordingly, even if the power supply voltage is lowered, the operational amplifier operates normally. The bandgap circuit according to the present invention can operate at a low power supply voltage.

Other objects, features, and advantages of the present invention will be more apparent from the following detailed description when read in conjunction with the accompanying drawings.

DETAILED DESCRIPTION OF THE PREFERED EMBODIMENTS

The finer semiconductor integrated circuits are made, the lower becomes the voltage at which the semiconductor integrated circuits operate. Analog circuits need to be operable at a low operation voltage. A CMOS bandgap circuit is one of the elements of a CMOS analog integrated circuit. The CMOS bandgap circuit is desired to become operable at a low operation voltage.

Analog circuits are often used for battery-operated mobile electronic devices such as cellular phones, personal data assistants, and notebook computers. The power consumption of an analog circuit used for such a mobile electronic device needs to be reduced for extending battery life. The power consumption needs to be reduced not only by reducing the power that the circuit consumes while it is activated, not also by making the circuit deactivated while it is not used.

If the cost of a semiconductor integrated circuit is taken into account, analog circuits need to be made compact.

The above bandgap circuits and the bias current generator circuit, however, bear the following problems.

Figure 1:
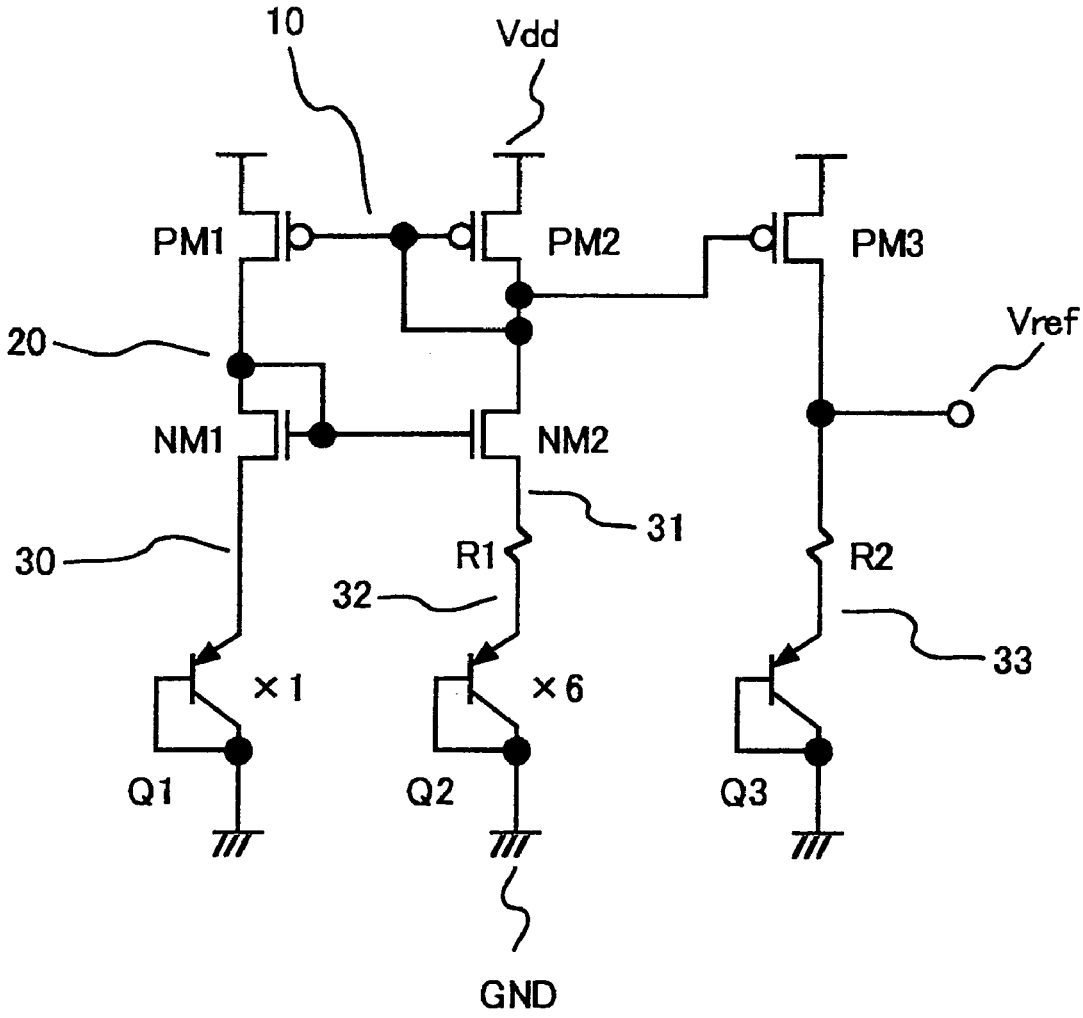
FIG.1 (PRIOR ART)
FIG. 1 is a circuit diagram showing a conventional bandgap circuit.

Although the simple bandgap circuit shown in FIG. 1 can generate the bandgap voltage, the portion of the circuit that generates the PTAT current proportional to temperature requires a high operation voltage. The reason why the portion requires the high operation voltage is that, since the portion of the circuit includes the pnp bipolar transistor Q1 and the NMOS transistor NM1 in series, and the pnp bipolar transistor Q2 and the PMOS transistor PM2 in series, the portion of the circuit requires a power supply voltage as high as the sum of the forward voltage Vbe of the pnp bipolar transistor and the threshold voltage Vth of the MOS transistor. For example, if Vbe is 0.7 V, and Vth is 0.9 V, the power supply voltage needs to be at least 1.6–1.7 V. There is little margin left to the power supply voltage, 1.8 V, of recent digital circuits.

Figure 2:
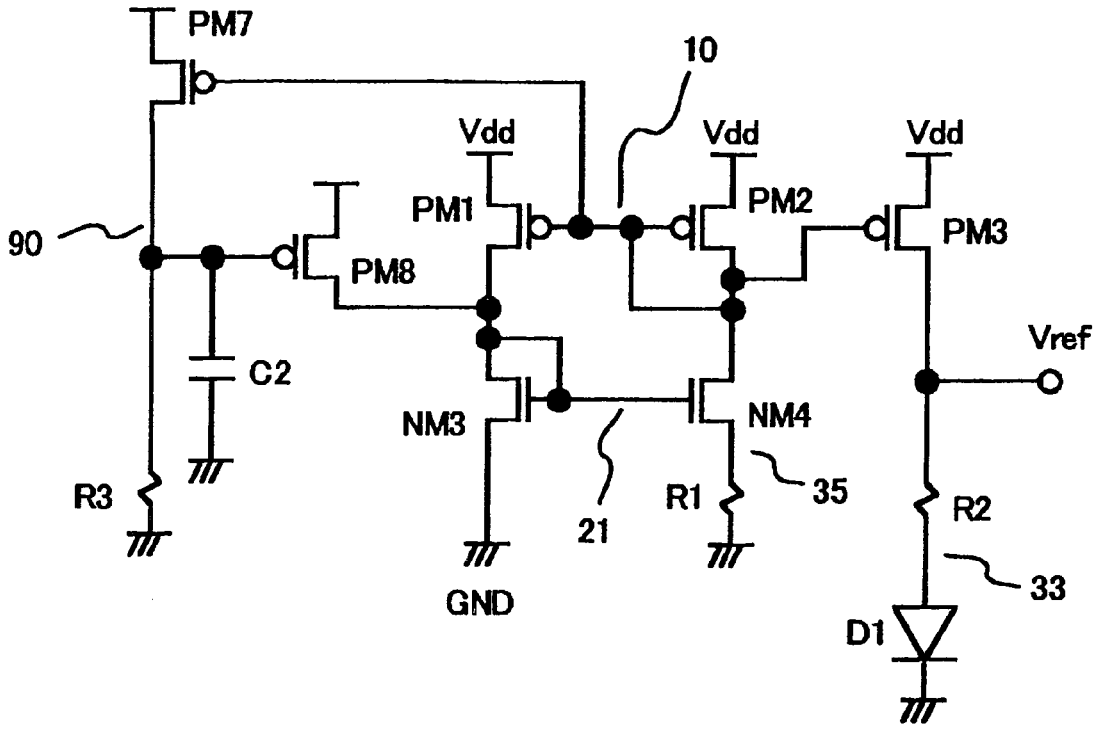
FIG.2 (PRIOR ART)
FIG. 2 is a circuit diagram showing another conventional bandgap circuit.

The circuit shown in FIG. 2 generates the bandgap voltage without using the pnp bipolar transistor (diode) and the NMOS transistor connected in series. According to this arrangement, the circuit shown in FIG. 2 can operate at a low operating voltage. The circuit shown in FIG. 2, however, uses a starting-up circuit including PM7, PM8, a resistor R3, and a capacitor C2, and as a result, still bears the following problems.

The first problem is that, while the power supply voltage is applied to the circuit, the circuit keeps operating. The circuit has no mechanism to stop its operation other than turning off the power supply. In the case where a bandgap circuit is used for generating a reference voltage for a series regulator, for example, it is preferred that the bandgap circuit be capable of being placed in a stand-by state. The circuit shown in FIG. 2 fails to satisfy the above requirement.

The second problem is that the circuit shown in FIG. 2 includes the capacitor C2 in its starting-up circuit. Even if the first problem is solved, and the circuit is able to be placed in a stand-by state, the circuit requires a longer starting-up time. The circuit additionally requires the following units to make it stoppable while the power is applied: a unit that turns the bias voltage 10 of the PMOS transistor to Vdd, a unit that turns the bias voltage of the NMOS transistor to GND, and a unit that turns the node 90 to Vdd. When the circuit returns from the stand-by state to a normal operating state, the starting-up circuit does not operate until the potential at the node 90 is reduced to a voltage at which PM8 is turned on. In the case of the circuit shown in FIG. 2, the time constant determined by C2 and R3 is longer than the rise time of the power supply. As a result, the activation of the starting-up circuit requires a long time.

Figure 3:
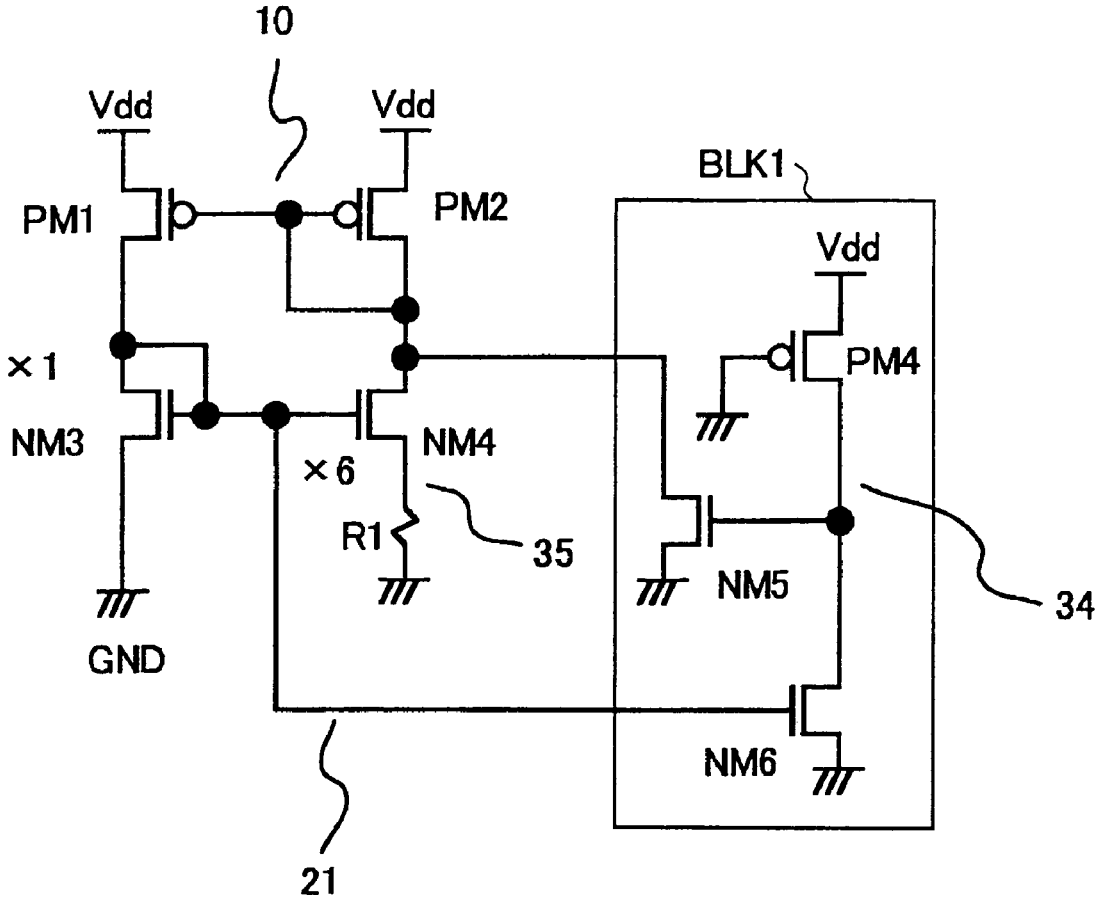
FIG.3 (PRIOR ART)
FIG. 3 is a circuit diagram showing a conventional bias current generator circuit.

The circuit of FIG. 3 is different from the circuit of FIG. 1 in that the circuit of FIG. 3 generates the PTAT current proportional to temperature determined by the W/L ratio of the MOS transistor. Since no pnp bipolar transistor (or a diode) is used, the minimum operating voltage of the circuit of FIG. 3 is lower than that of FIG. 1 by Vbe. The starting-up circuit of the circuit of FIG. 3 increases the minimum operating voltage as described below.

When no current flows through the loop including PM1, PM2, NM3, NM4, and R1, the current that flows through PM4 turns the potential at the node 34 to Vdd, and turns on NM5. Then, a current starts flowing through PM2. After the current starts flowing through the loop including PM1, PM2, NM3, NM4, and R1, and the circuit reaches a stable point, it is necessary to turn the potential at the node 34 to GND level, and to turn the NM5 off. The current keeps flowing through PM4 after a current starts flowing through the loop including PM1, PM2, NM3, NM4, and R1, and the circuit reaches the stable point. The current that flows through PM4 needs to be reduced so as to reduce the power consumption.

The current that flows through PM4 can be reduced by reducing the W of PM4 and increasing L. However, the reducing of W and the increasing of L increases Vth of PM4 due to the narrow channel effect. If the threshold voltage Vth of the PMOS transistors PM1 and PM2 is equal to 0.9 V, and the threshold voltage Vth of PM4 is equal to 1.1 V, for example, PM4 cannot be turned on at a power supply voltage lower than 1.1 V. As a result, the potential at the node 34 cannot be turned to Vdd, and the starting-up circuit BLK1 does not operate. Even if the power supply voltage can cause the loop including PM1, PM2, NM3, NM4, and R1 to operate, the bias current cannot be generated at the power supply voltage.

Figure 4:
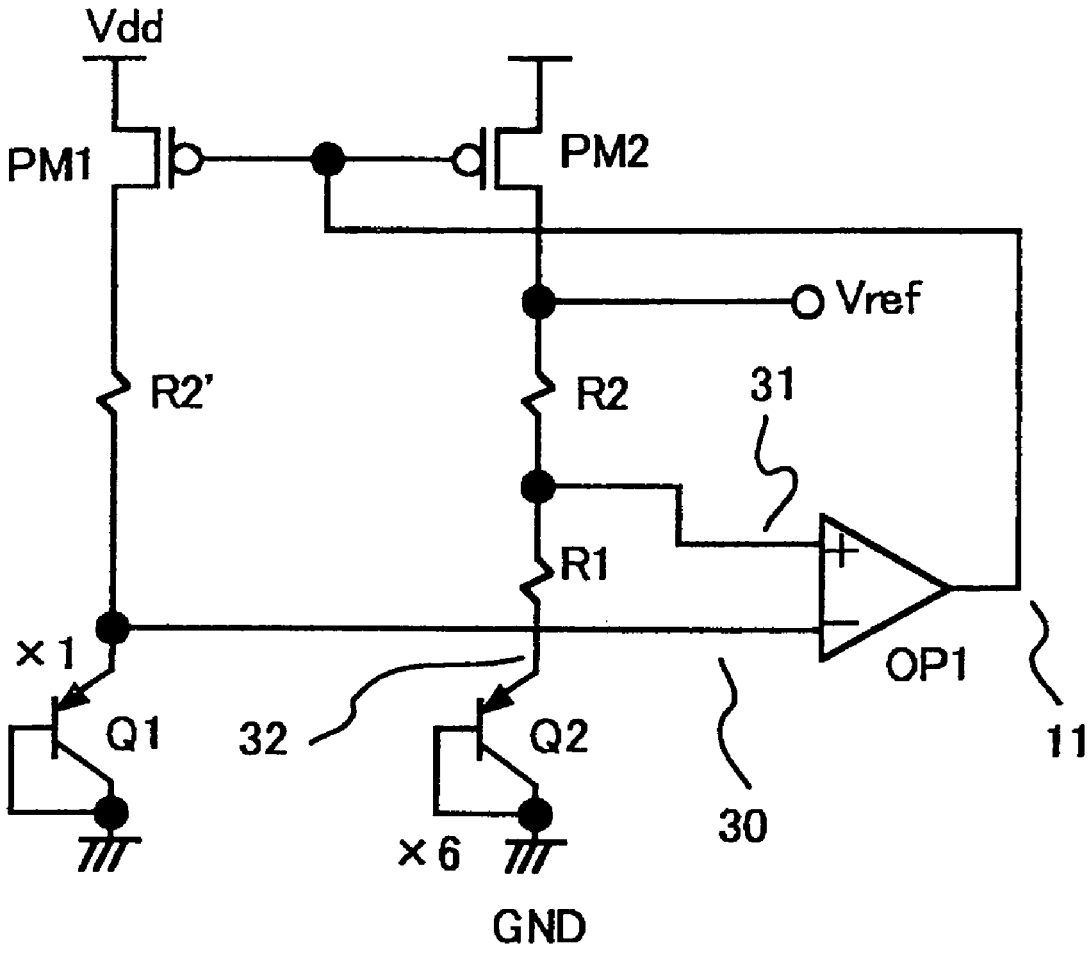
FIG.4 (PRIOR ART)
FIG. 4 is yet another conventional bandgap circuit.

As described in the above documents 2), 3), and 4), a differential circuit configured by PMOS transistors is generally disposed at the front-end of the operational amplifier circuit OP1 in the circuit shown in FIG. 4. (Otherwise, the circuit requires a special NMOS transistor of low threshold voltage Vth). The differential circuit is required because the potential at the node 30 and the potential at the node 31 are as low as Vbe (about 0.6 V, for example), and are close to the GND level. An ordinary NMOS transistor of which the threshold voltage Vth is about 0.6 V is too marginal to use. As temperature rises, the forward voltage may be reduced to about 0.4 V due to the temperature dependency.

If the differential circuit configured with the PMOS transistors is used as the operational amplifier circuit OP1, the minimum operational power supply voltage becomes about Vbe+Vth (threshold voltage of the PMOS transistor). As a result, the minimum operational power supply voltage is limited to Vbe+Vth. The circuit does not operate at a power supply voltage lower than Vbe+Vth.

The above circuits of FIGS. 1 through 4 carry a common problem that the circuits can output only the bandgap voltage (about 1.2 V) as the reference voltage. Accordingly, they fundamentally require a power supply voltage higher than the bandgap voltage.

Accordingly, it is a general object of the present invention to provide a novel and useful bandgap circuit in which one or more of the problems described above are eliminated.

More specifically, a first object of the present invention is to provide a simply-structured bandgap circuit that requires a low minimum operating voltage.

A second object of the present invention is to provide a simply-structured bias current generator circuit including a starting-up circuit that requires a low minimum operating voltage.

A third object of the present invention is to provide a bandgap circuit that can generate not only the bandgap voltage (about 1.2 V, for example) but also any desired voltage.

A fourth object of the present invention is to provide a bandgap voltage using an operational amplifier that can operate at a low voltage.

Embodiments of the present invention are explained in detail with reference to the drawings.

Figure 5:
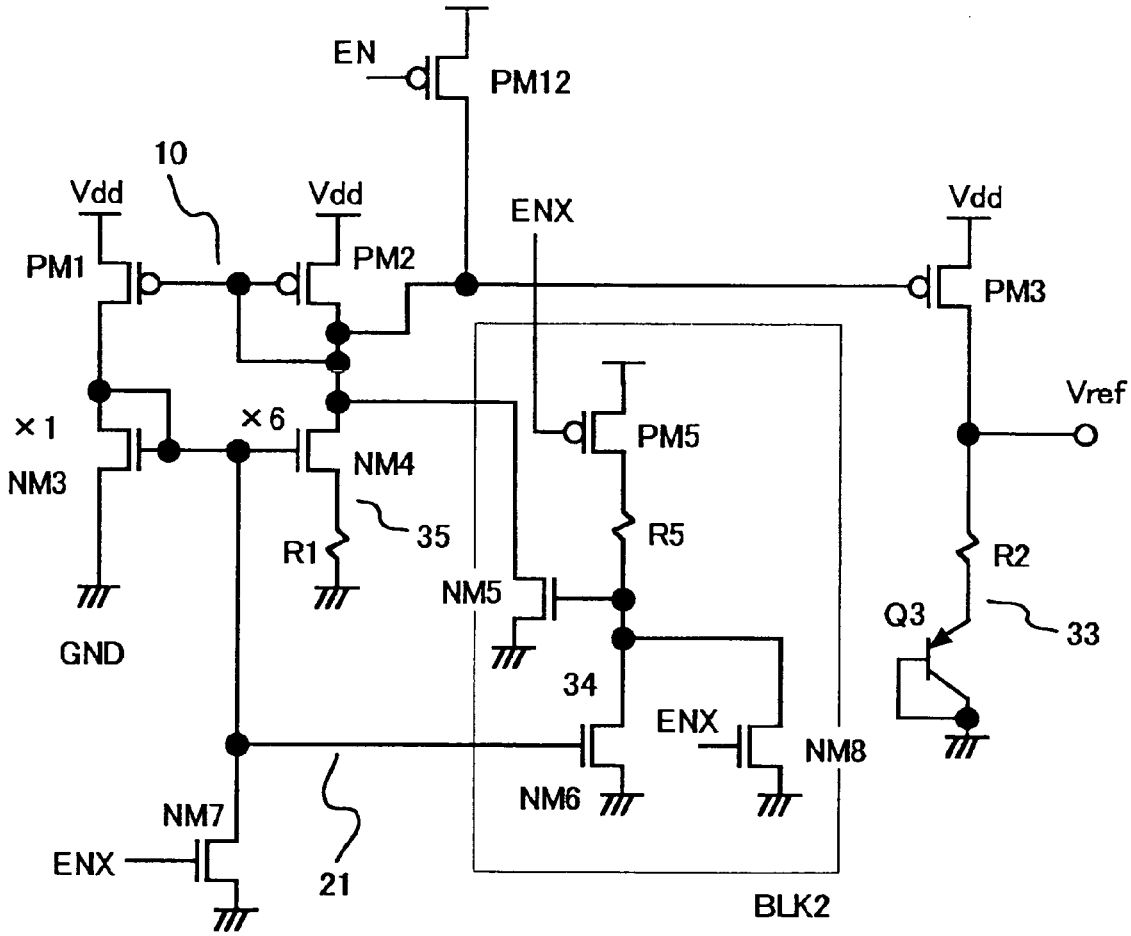
FIG. 5 is a circuit diagram showing a bandgap circuit according to an embodiment of the present invention.

FIG. 5 is a circuit diagram showing a bandgap circuit according to a first embodiment of the present invention.

In FIG. 5, Q3 indicates a pnp bipolar transistor. R1, R2, R5 indicate resistors. Vref indicates an output reference potential. Vdd indicates a positive power supply voltage. GND indicates a GND terminal. NM3 through NM8 indicate NMOS transistors. PM1, PM2, PM3, PM5, PM12 indicate PMOS transistors. "10" indicates the bias potential of a PMOS transistor. "21" indicates the bias potential of a NMOS transistor. "33", "34", and "35" indicate internal nodes. EN and ENX indicate control signals. In FIG. 5, elements identical to those having the same function and corresponding node shown in FIGS. 1 through 3 are referred to by the same reference symbols.

For example, it is assumed that W/L of PM1, PM2, PM3 (W: gate width, L: gate length) are equal. A W/L ratio of NM3 and NM4 is assumed to be 1:6, for example. NM3 and NM4 are designed to operate in sub threshold region.

The bandgap circuit of FIG. 5 operates normally when a control signal EN is H and a control signal ENX is L. At first an exemplary operation in this normal state is described. When EN becomes H, and ENX becomes L, PM12, NM7, NM8 are turned off, and they do not affect the operation of the circuit shown FIG. 5. A PM5 is turned ON then.

When voltage between the gate and the source of a NMOS transistor is expressed in Vgs, drain current ID in sub threshold region and the voltage Vgs are expressed by the above formula (6).

In the circuit of FIG. 5, the same current flows through PM1, PM2, NM3, NM4, and R1 because the gate electrode of PM1 and that of PM2 are common. Since the currents flowing through NM3 and NM4 are equal, and the W/L ratios of NM3 and NM4 are 1:6, the potential difference VR1 at both ends of the resistor R1 is expressed by the above formula (7). Because potential difference VR1 at both ends of the resistor R1 may be expressed by the formula (7), current Ip flowing through PM1 and PM2 is expressed by the above formula (8).

This current Ip flows through PM3. As it is apparent from the formula (8), the current value is proportional to temperature. As a result, the reference potential Vref is expressed by the above formula (9). The first term, Vbe, of the formula (9) has negative temperature dependency on temperature, but the second term, (R2/R1)*(nkT/q)*ln(6) has positive temperature dependency on temperature. Therefore, if parameters are chosen so that the term having negative temperature dependency and the term having positive temperature dependency cancel each other, the reference potential Vref can be set so that it does not depend on temperature. The reference potential Vref in this case becomes about the same as the bandgap voltage of silicon (about 1.2V).

In the above description, the reference voltage is expressed by the formula (9) in order to simplify the description. For example, as described in the document 1), it is known that a voltage drop VR2 by the resistor R2 can be expressed by the formula (5). However, because the difference is only a constant "n", the above description has been given based on the formula (9). The formula (8) is used in the following description. However, the formula (4) can be used in the same manner, as will be appreciated.

In FIG. 5, a circuit portion BLK2 functions as a starting-up circuit. If the circuit includes only the loop of PM1, PM2, NM3, NM4, R1, the circuit becomes stable at a stable point in which all currents are zero other than the stable point expressed by the formula (8). The starting-up circuit BLK2 is used in order to solve this problem.

In the undesirable operating point in which all currents are zero, the potential of the internal node 10 is Vdd, and the potential at the internal node 21 becomes GND. Because NM6 is OFF then, the potential of internal node 34 becomes Vdd by a current flowing through PM5 and the resistor R5. When potential of internal node 34 becomes Vdd, NM5 is turned on, and a current begins to flow through PM2. When a current begins to flow through PM2, a current begins to flow through PM1. Then, the circuit reaches the stable point expressed by the formula (8).

When a current begins to flow through PM1, PM2, NM3, NM4, R1, the current also flows through NM6. The potential of the internal node 34 becomes a GND potential level, and NM5 becomes OFF. According to the above arrangements, the starting-up circuit BLK2 is separated from a loop including PM1, PM2, NM3, NM4, R1.

As described above in reference to the conventional starting-up circuit BLK1 of FIG. 3, the steady state current flowing through PM4 needs to be set small for reducing the power consumption. However, if W of PM4 is reduced and L of PM4 is increased, the threshold voltage Vth of PM4 is increased by a narrow channel effect. The starting-up circuit BLK1 cannot function in low power supply voltage, and as a result, the starting-up circuit BLK1 fails in generating the bias current. That is, the minimum operating voltage of such a conventional circuit is increased by the starting-up circuit.

In contrast, the circuit shown in FIG. 5 can reduce the current flowing through PM5 and the resistor R5 by sufficiently increasing the resistance of the diffused resistor R5. Because the circuit is designed as described above, the circuit can operate at a low voltage by using the MOS transistors of great enough W/L and avoiding the rise of Vth due to a narrow channel effect.

The conventional circuit shown in FIG. 2 is expected to always operate with the power supply voltage being provided. The conventional circuit, however, carries a problem in that, when the circuit is provided with the power supply voltage, it keeps operating. The circuit shown in FIG. 2 requires a long time period for activating the starting up circuit since the time constant determined by C2 and R3 need to be greater than the rise time of the power supply.

Even in a state in which the power supply voltage is applied to the circuit, the starting-up circuit BLK2 according to the present invention can set the circuit in a stand-by state because PM12, NM7, NM8, and PM5 are provided. PM12 sets the bias potential of PMOS transistor at Vdd. NM7 sets the bias potential of the NMOS transistor at GND. NM8 and PM5 fix the gate potential of the MOS transistor NM5 that causes the starting-up current to flow. Even if the power supply voltage is applied to the circuit, PM12, NM7, NM8, and PM5 enable the circuit to be set in the stand-by state. The time constant of the gate electrode 34 of the NMOS transistor NM5 that causes the starting-up current to flow is determined based on parasitic capacitance and the resistance R5. When the circuit returns to an active state from the stand-by state, the circuit does not need to charge and discharge the large capacitor C2 of the conventional circuit shown in FIG. 2. As a result, the circuit operates at a high speed.

Figure 6:
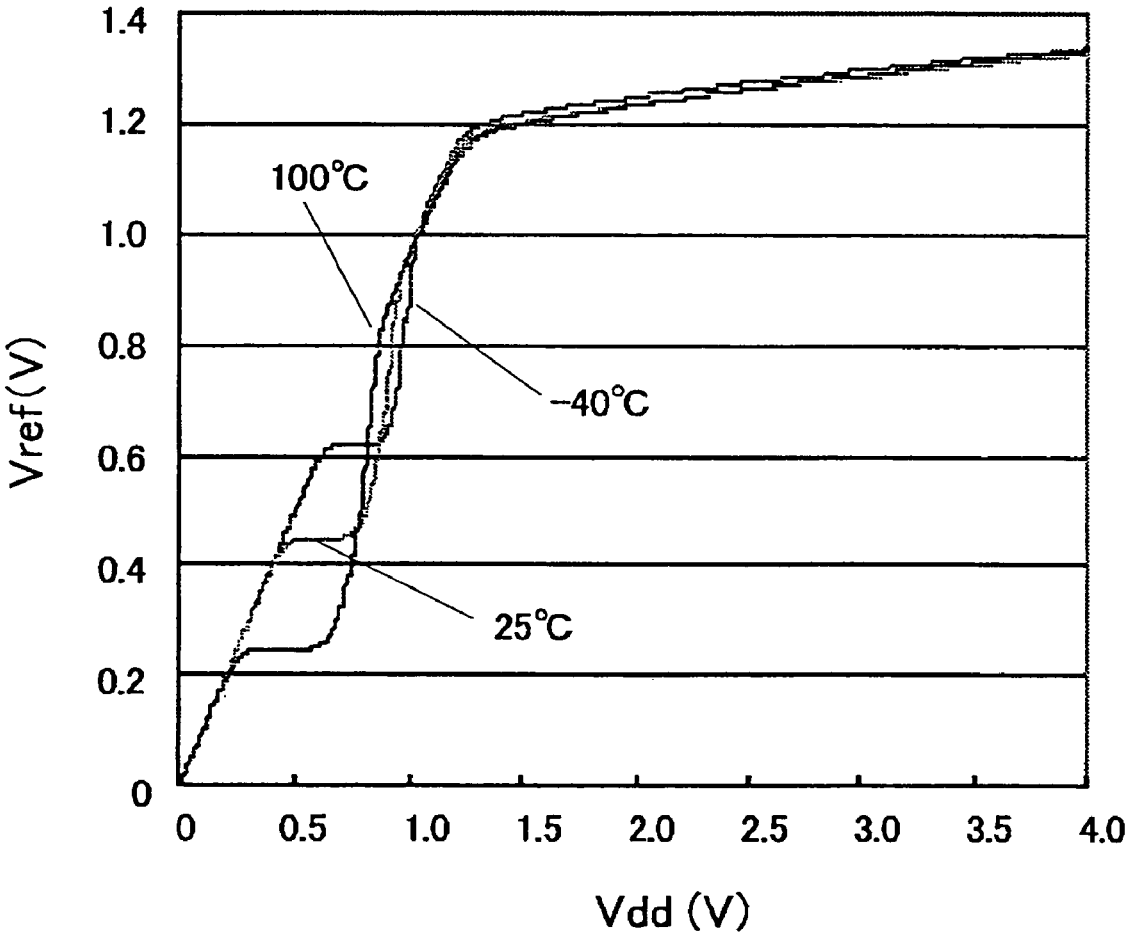
FIG. 6 is a graph showing a reference voltage Vref as a function of a power supply voltage Vdd, of the bandgap circuit shown in FIG. 5.

FIG. 6 is a graph showing the relation between the power supply voltage Vdd and the reference voltage Vref of the bandgap circuit of FIG. 5. The graph shown in FIG. 6 indicates the cases at −40 degrees Celsius, 25 degrees Celsius, and 100 degrees Celsius.

Because no negative feedback by a high gain amplifying circuit is used, as the power supply voltage Vdd rises, the circuit current increases (caused by Early effect or a channel-length modulation effect), and the reference voltage Vref gradually increases. However, the output potential Vref does not vary even if temperature changes because the circuit operates as the bandgap circuit. The circuit of FIG. 5 generates the reference voltage Vref of approximately 1.2 V, and requires the power supply voltages of about 1.2 V. FIG. 6 shows that the circuit start operating from the power supply voltage of about 1.2 V.

A description is given of an exemplary operation of the circuit of FIG. 5 in the stand-by state in which the control signal EN is L and the control signal ENX is H.

When the control signal EN is L, the control signal ENX is H, PM12, NM7, NM8 are turned ON, and PM5 is turned OFF. Since PM12 is turned on, the bias potential 10 of the PMOS transistor becomes Vdd. Because NM7 is turned on, the bias potential 21 of the NMOS transistor becomes GND. Since NM8 is turned on, the potential of node 34 becomes GND.

When the bias potential 10 of the PMOS transistor becomes Vdd, PM1, PM2, and PM3 become OFF. NM3, NM4, NM6 become OFF when the bias potential 21 of the NMOS transistor becomes GND. Additionally, NM5 becomes OFF when the node 34 becomes GND. According to the above arrangements, no current flows through the circuit of FIG. 5, and the circuit is transferred to a holding status (stand-by state).

In the above description of the exemplary bandgap circuit according to the first embodiment, it is assumed that the W/L ratios of PM1, PM2, and PM3 are equal to each other, and that the W/L ratio of NM3 and NM4 is 1:6. As will be appreciated, even if these size ratios are changed, the bandgap circuit can be designed in the same manner.

Figure 7:
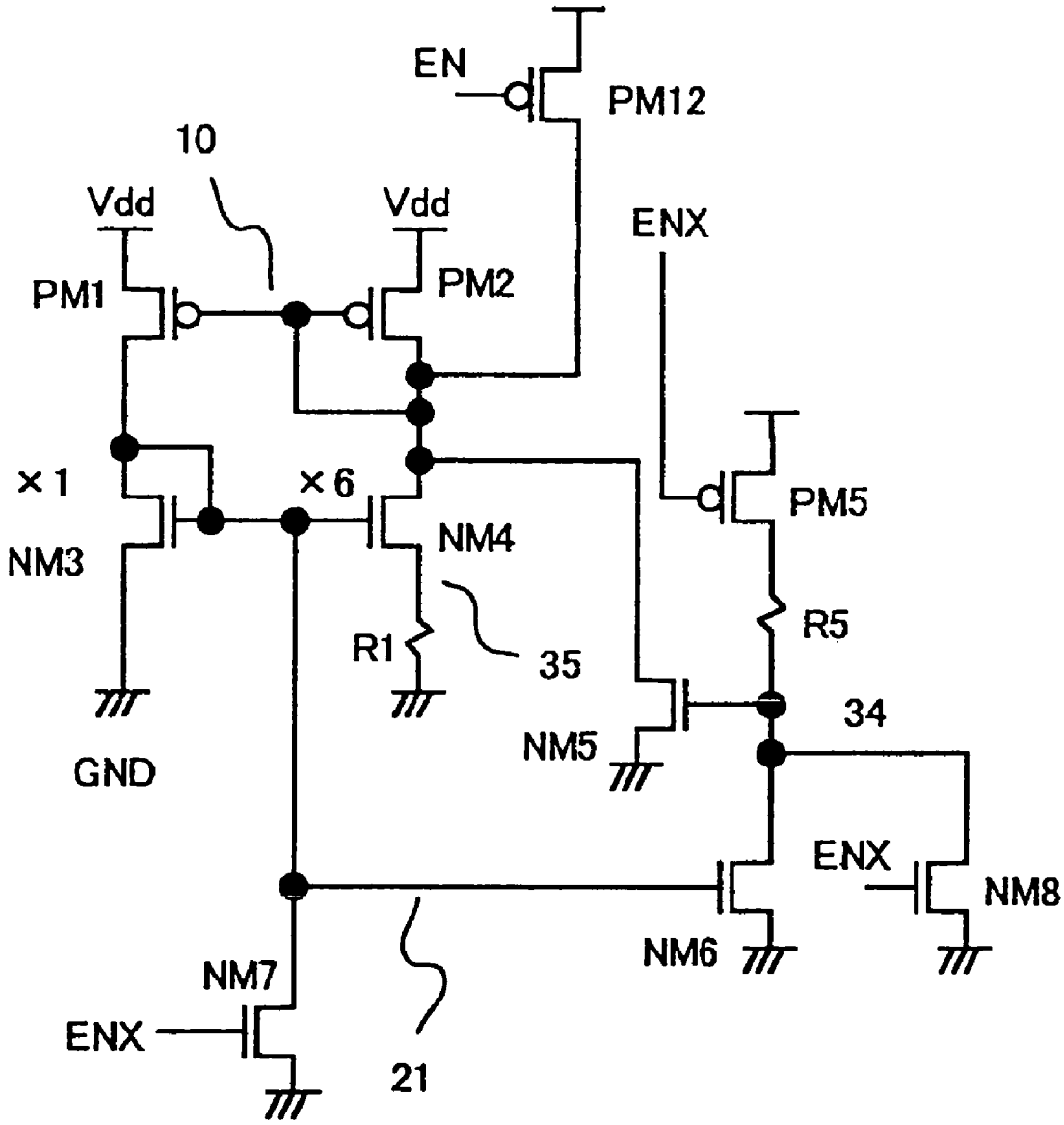
FIG. 7 is a circuit diagram showing a circuit including the bandgap circuit shown in FIG. 5 as a bias current generator circuit.

FIG. 7 is a circuit diagram showing the circuit of FIG. 5 used as a bias current generator circuit. In FIG. 7, components identical to those shown in FIG. 5 are referred to by the same reference numerals, and their description is omitted.

As shown in FIG. 7, a portion of the circuit of FIG. 5 can be use as the bias current generator circuit. When the circuit is used as the bias current generator circuit, the current flowing through the starting-up circuit may be made adjustable with PM5 and the serial equivalent resistance of the resistor R5. If a resistance of diffused resistor R5, for example, is increased enough, the W/L ratio of PM5 can be increased. According to the above arrangements, a rise of Vth due to the narrow channel effect can be avoided by using MOS transistors of which the W/L ratio is great enough, and as a result, the circuit becomes operable at a low voltage.

Figure 8:
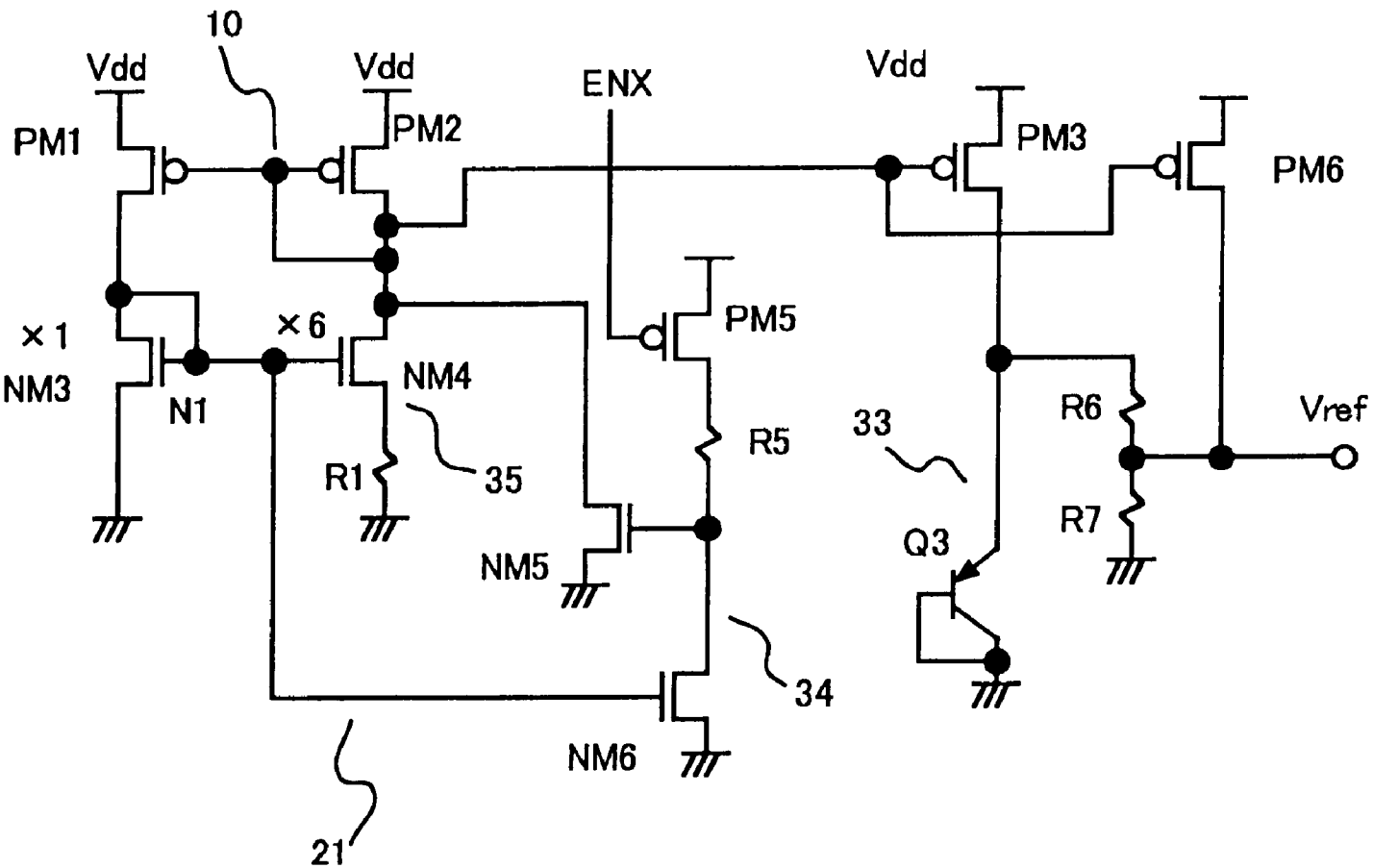
FIG. 8 is a circuit diagram showing a bandgap circuit according to another embodiment.

FIG. 8 is a circuit diagram showing a bandgap circuit according to a second embodiment of the present invention.

In FIG. 8, Q3 denotes a pnp bipolar transistor. R1, R5, R6, and R7 denote resistors. Vref denotes an output reference potential. Vdd denotes a power supply positive voltage. GND denotes a GND terminal. NM3 through NM6 denote NMOS transistors. PM1, PM2, PM3, PM5, PM6 denote PMOS transistors. "10" denotes the bias potential of a PMOS transistor. "21" denotes the bias potential of a NMOS transistor. "33" through "35" denote internal nodes. In FIG. 8, elements having the same function as those of FIG. 5 and corresponding nodes are referred to by the same symbol. The circuit of FIG. 8 can be stopped by using signals similar to the control signals EN and ENX shown in FIG. 5. The portion of the circuit that stops the operation of the circuit is not shown in FIG. 8 for simplifying the drawing.

A portion of the circuit of FIG. 8 that generates the bias current is identical to that shown in FIG. 5. The circuit of FIG. 8 is different from the circuit of FIG. 5 in the portion of the circuit PM3, PM6, R6, R7, Q3 that generates the reference voltage. The circuit of FIG. 8 is configured so as to generate a voltage other than 1.2 V (0.6 V, for example).

For example, it is assumed that the W/L ratios (W: gate width, L: gate length) of PM1, PM2, PM3, and PM6 are equal. Furthermore, the W/L ratio of NM3 and NM4 is assumed to be 1:6, for example. NM3 and NM4 are designed to operate in the sub threshold region.

The current Ip that flows through PM1 and PM2 can be expressed by the above formula (8). The current Ip is the PTAT current proportional to absolute temperature. A current of the same amount flows through PM3. It is assumed that R6 and the resistance of R7 are the same in order to simplify the description. Because a current flows to Q3 from PM3, the potential of the node 33 becomes Vbe (Vbe: forward voltage of a p-n junction). The potential of this node 33 is split into Vbe/2 by the resistors R6 and R7 of the same resistance (The resistances of R6 and R7 need to be great to some extent, so that Vbe of Q3 is not reduced too much due to current flowing through R6 and R7).

The PTAT current expressed by the formula (8) also flows through PM6. It is assumed that all the current flowing out of R6 flows into R7 in order to make the description simple. If the current of PM6 flows to R7, the potential of the reference voltage Vref is expressed by the following formula (10).

$$Vref=(1/2)Vbe+(R7/R1)(nkT/q)\ln(6) \quad (10)$$

Vbe has a negative temperature dependency on temperature, and (R7/R1)(nkT/q)ln(6) has a positive temperature dependency on temperature. If parameters are determined so that the term having a negative temperature dependency and the term having positive temperature dependency cancel each other, the reference potential Vref can be set not to depend on temperature. The reference potential Vref in this case becomes about ½ of the bandgap voltage, or about 0.6V.

An example in which the resistance of R6 and the resistance of R7 are set equal to each other so that the reference voltage becomes 0.6 V has been described. If the condition that Vref does not depend on temperature is met, the above parameters may be determined as desired. Vref can be set at any arbitrary value (0.9 V, for example) by determining the parameters appropriately.

In the exemplary embodiment, the resistance R1 is assumed to be 300 kΩ, for example. The current flowing through PM1 and PM2 is computed based on the formula (8), $$Ip = (1/R1)(nkT/q)\ln(6)$$

-continued $$= (1.3 * 26\ \text{mV} \times \ln(6))/300\ \text{k}\Omega$$

$$= 61\ \text{mV}/300\ \text{k}\Omega$$

$$= 0.2\ \text{uA},$$

where "n" is assumed to be n=1.3.

Because the current flowing through PM3 flows through not only Q3 but also R6 and R7', the W/L of PM3 and PM6 is set at 2 times the W/L of PM1 and PM2.

A current of 0.4 uA flows through PM3.

If no current flows in Q3, Vbe cannot be generated at the node 33. Accordingly, the resistance of R6 and R7 connected in series must be great to some extent. In the exemplary embodiment, it is assumed that R6 and R7 are 4500 kΩ and 1500 kΩ, respectively. The total resistance of R6 and R7 connected in series becomes 6 MΩ. If only the current flowing in PM3 is considered, when Vbe is 0.6V, a current of 0.6V/6 MΩ=0.1 uA flows in R6 and R7. Because the current flowing in PM3 is 0.4 uA, about ¼ flows to the resistors R6 and R7, and the remainder flows through Q3. Because a current of about 3 uA flows in Q3, the potential of the node 33 becomes Vbe, 0.6 V, for example. This voltage is divided by R6 and R7, a ¾ of the voltage appears as the reference voltage Vref. In other words, when only the current of PM3 is considered, the potential of Vref becomes ¾ *Vbe (=0.45 V).

Furthermore, a current of 0.4 uA flows to Vref from PM6. If viewed from PM6, the equivalent circuit of Vref includes R6 and R7 connected in parallel. If R6 is 1500 kΩ, and R7 is 4500 kΩ, the equivalent resistance of R6 and R7 becomes 1.125 MΩ. When a current of 0.4 uA flows through the above equivalent resistance of 1.125 MΩ, the voltage drops at the equivalent resistance by 0.45 V. As described above, this voltage drop is added to 0.45 V that is divided from Vbe, which makes the potential of Vref 0.9 V.

As described above, the resistances of R6 and R7 are preferably determined so that the diode voltage can be divided at the ratio of the original bandgap voltage and a voltage to be output, and so that the negative temperature dependency of the divided diode voltage is canceled by the resistance of R6 and R7 connected in parallel and the current of PM6.

Since the portion for generating the reference voltage is configured as shown in FIG. 8, Vbe is divided by R6 and R7, and as against the Vbe divided arbitrarily a potential having a positive temperature dependency can be added to the divided Vbe so that the temperature dependency is canceled. When Vbe is divided into ⅓, the current of PM6 and the combined resistance of R6 and R7 connected in parallel generate a potential that cancels the temperature dependency of ⅓*Vbe. When Vbe is divided into ⅚, the current of PM6 and the combined resistance of R6 and R7 connected in parallel generate a potential that cancels the temperature dependency of ⅚*Vbe. It is apparent from the above description that the potentials of Vref become ⅓*Veg and ⅚*Veg, respectively. In the above explanation, "n" is assumed to be 1.3. However, the value of "n" is different transistor by transistor. More precisely, the value of "n" also depends on current density. Therefore, when the circuit is designed, the parameters (the resistances and the current) need to be determined based on detailed circuit simulation.

Figure 9:
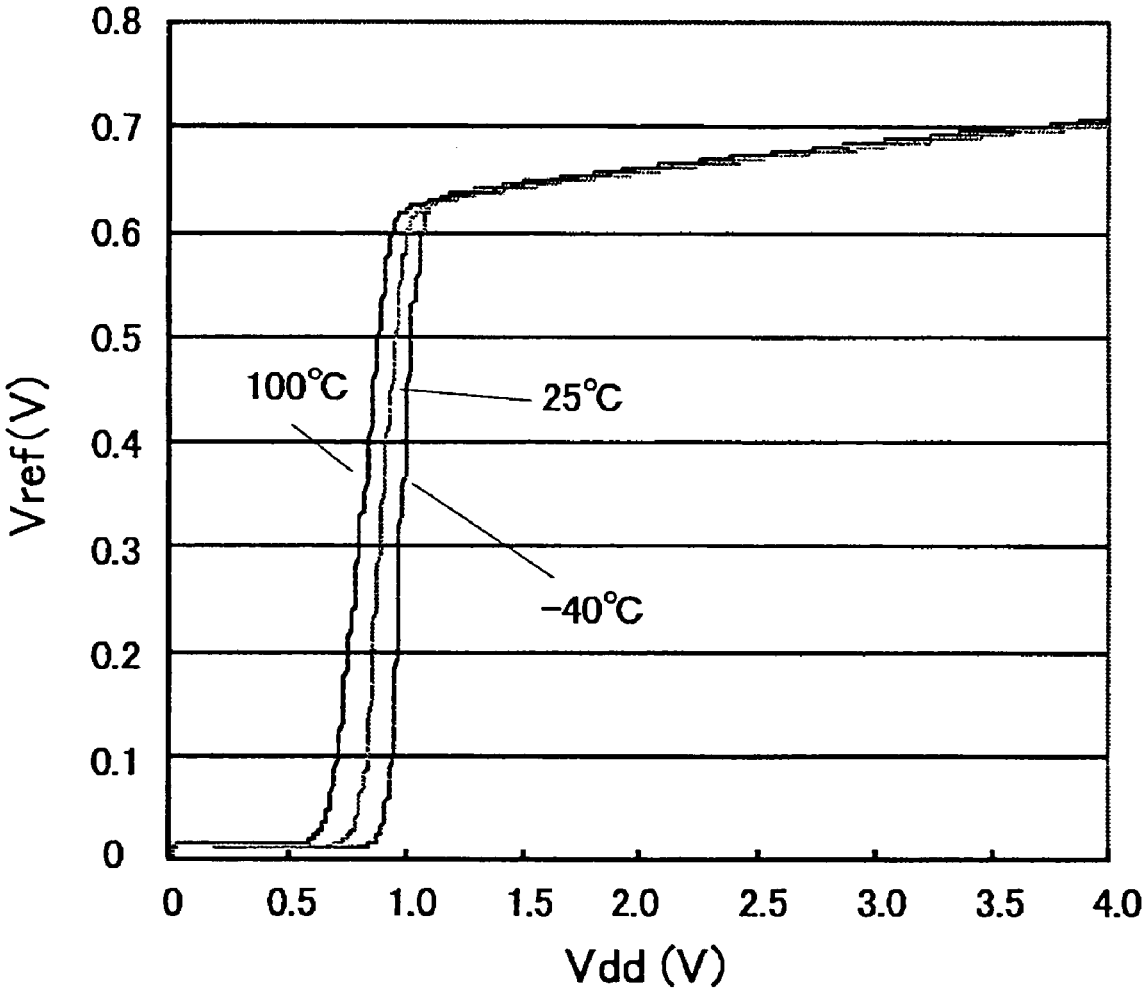
FIG. 9 is a circuit diagram showing the reference voltage of the circuit of FIG. 8 as a function of the power supply voltage.

FIG. 9 is a graph of the reference voltage Vref of the circuit shown in FIG. 8 as a function of the power supply voltage Vdd. FIG. 9 shows the cases at temperatures −40 degrees Celsius, 25 degrees Celsius, and 100 degrees Celsius.

When the power supply voltage Vdd is increased, the current of the circuit increases (by an effect of early voltage or channel-length modulation), and the reference voltage Vref gradually increases. However, output potential Vref does not vary even if temperature changes. This shows that the circuit operates as a temperature-independent reference voltage circuit. FIG. 8 shows the exemplary embodiment in which the reference voltage Vref is 0.6 V. FIG. 9 shows that the minimum operating voltage Vdd is about 1.0 V.

The reference voltage Vref of the bandgap circuit according to the second embodiment shown in FIG. 8 is less than the bandgap potential. As a result, the circuit according to the second embodiment can operate at a lower operating voltage than the bandgap circuit according to the first embodiment shown in FIG. 5.

Figure 10:
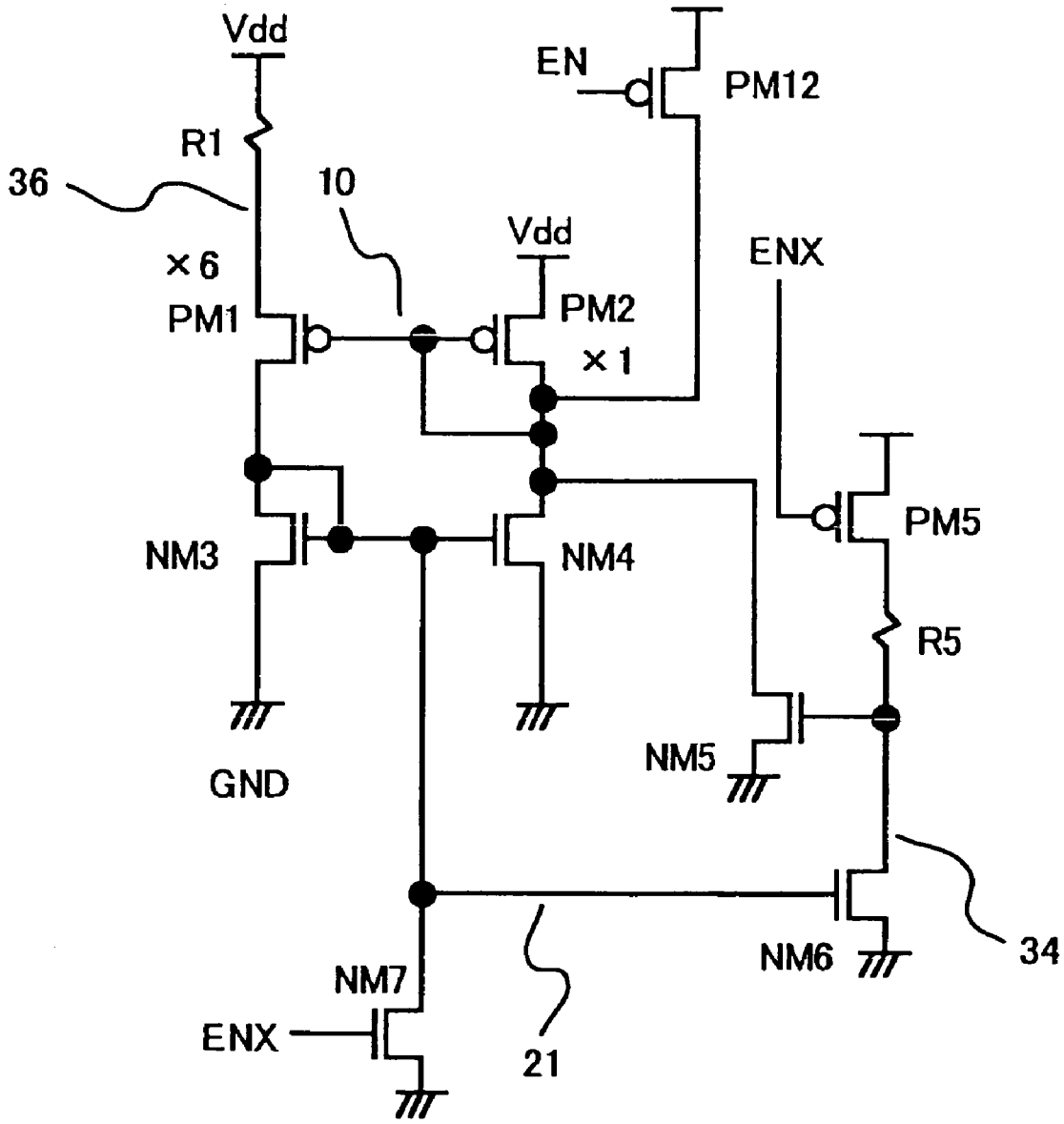
FIG. 10 is a circuit diagram showing a bias current generator circuit according to another embodiment.

FIG. 10 is a circuit diagram showing a bias current generator circuit according to a second embodiment. In FIG. 10, R1 and R5 indicate resistors. Vdd indicates a positive power supply. GND indicates a GND terminal. NM3 through NM7 indicate NMOS transistors. PM1, PM2, PM5, and PM12 indicate PMOS transistors. 10 indicates the bias potential of a PMOS transistor, and 21 indicates the bias potential of a NMOS transistor. "34" and "36" indicate internal nodes 34 and 36. EN and ENX indicate control signals. In FIG. 10, elements identical to those shown in FIG. 7 are referred to by the same reference numerals, and their description is omitted.

The bias current generator circuit shown in FIG. 10 operates almost in the same manner as the circuit shown in FIG. 7. Accordingly, only the differences between them are described below.

The W/L ratio of NM3 and NM4 and the resistance R1 of the circuit shown in FIG. 7 are determined so that the current becomes desirable. However, the W/L ratio of PM2 and PM1 and the resistance R1 may be determined in order to make the current desirable. If the circuit is designed so that the W/L ratio of PM1 is 6 times greater than that of PM2, the same current generates different gate-source voltages in PM1 and PM2, and the difference between the gate-source voltages is applied to the resistance R1. Parameters can be determined so as to make the current desirable in the same manner as the circuit shown in FIG. 7.

Figure 11:
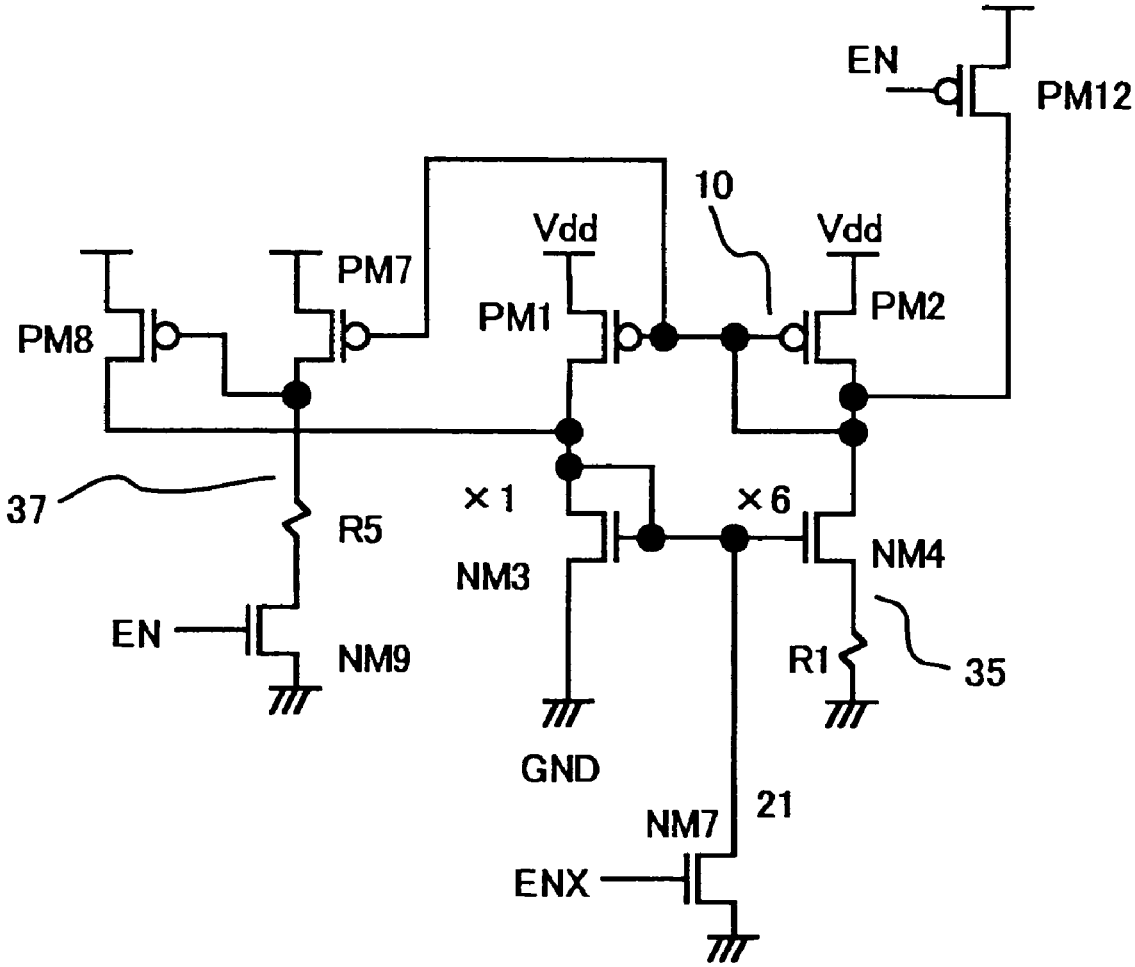
FIG. 11 is a circuit diagram showing a bias current generator circuit according to yet another embodiment.

FIG. 11 is a circuit diagram showing a bias current generator circuit according to another embodiment of the present invention.

In FIG. 11, R1 and R5 indicate resistors. Vdd indicates a positive power supply. GND indicates a GND terminal. NM3, NM4, NM7, and NM9 indicate NMOS transistors. PM1, PM2, PM7, PM8 and PM12 indicate PMOS transistors. "10" indicates the bias potential of a PMOS transistor. "21" indicates the bias potential of a NMOS transistor. "35" and "37" indicate internal nodes 35 and 37. EN and ENX indicate control signals. In FIG. 11, elements identical to those in the circuit shown in FIG. 7 are referred to by the same numerals, and their description is omitted.

The circuit shown in FIG. 11 operates substantially in the same manner as the bias current generator circuits shown in FIGS. 7 and 10. The circuit shown in FIG. 11 is different from the circuit shown in FIG. 7 in starting-up circuit. A description is given of the circuit shown in FIG. 11 focusing on the operation of the starting-up circuit. It is assumed that the control signal EN is H, and the control signal ENX is L.

The bias current is determined based on the parameters of the loop including PM1, PM2, NM3, NM4, and the resistance R1 as the bias current of the circuit shown in FIG. 7 is determined. The starting-up circuit including PM7, PM8, R5, and NM9 is desired so that the circuit does not become stable in the undesirable operating point in which all current is zero. When all currents are zero, the bias potential 10 of the PMOS transistor becomes Vdd, and the bias potential 21 of the NMOS transistor becomes GND. Because PM7 is OFF then, the potential of the node 37 becomes GND by the current flowing in NM9 and resistor R5. When potential of node 37 becomes GND, PM8 becomes ON, and a current begins to flow through NM3. When the current begins to flow through NM3, a current begins to flow through NM4, and the circuit becomes stable.

When current begins to flow through PM1, PM2, NM3, NM4, and R1, a current flows through PM7. The current makes the potential of node 37 Vdd level, and as a result, PM8 is turned OFF. The starting-up circuit is separated from the loop including PM1, PM2, NM3, NM4, R1.

The current flowing through NM9 and resistor R5 needs to be reduced to reduce the power consumption of the circuit shown in FIG. 11. If the resistance R5 is increased enough, the current flowing through NM9 and the resistor R5 is reduced. According to the above configuration of the circuit, the resistance of the diffused resistor and the MOS transistor connected in series can be determined by the resistance of the diffused resistor. As a result, when the circuit is being designed, the W/L ratio of the MOS transistor can be determined to be great. If the W/L ratio of the MOS transistor is determined at a great value, the threshold voltage Vth is prevented from being increased due to the narrow channel effect, and the circuit becomes operable at a low operating voltage.

As described above, the role of the NMOS transistor and the role of the PMOS transistor are exchanged in the starting-up circuit of FIG. 11 compared to the starting-up circuits of FIGS. 5 and 7.

Figure 12:
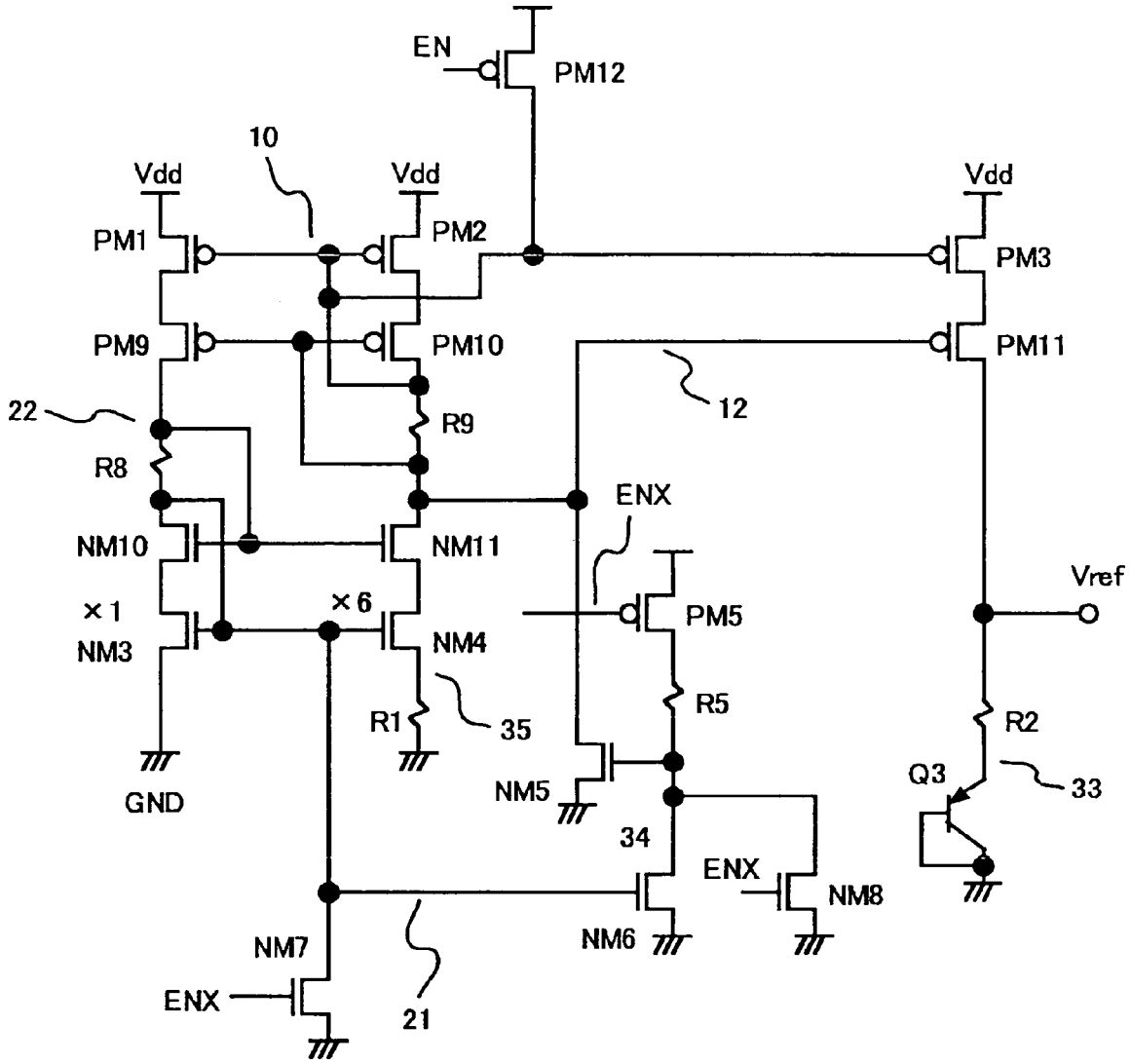
FIG. 12 is a circuit diagram showing a bandgap circuit according to yet another embodiment.

FIG. 12 is a circuit diagram showing a bandgap circuit according to yet another embodiment of the present invention.

The circuit of FIG. 12 operates almost in the same manner as the circuit of FIG. 5. However, the circuit of FIG. 12 includes the MOS transistors connected in cascode as a current source, and as a result, the dependency of the circuit on the power supply voltage is improved.

In FIG. 12, Q3 indicates a pnp bipolar transistor. R1, R2, R5, R8, and R9 indicate resistors. Vref indicates an output reference potential. Vdd indicates a positive power supply. GND indicates a GND terminal. NM3 through NM8, NM10, and NM11 indicate NMOS transistors. PM1, PM3, PM5, PM9, Pm10, PM11, and PM12 indicate PMOS transistors. "10" and "12" indicate the bias potential of PMOS transistors. "21" and "22" indicate the bias potentials of NMOS transistors. "33" through "35" indicate internal nodes. EN and ENX indicate control signals.

In the illustrated exemplary embodiment, it is assumed that the W/L (W: gate width, L: gate length) ratios of PM1, PM2, and PM3 are equal to each other, the W/L ratios of PM9, PM10, and PM11 are equal to each other, and the W/L ratios of NM10 and NM11 are equal to each other. It is further assumed in the exemplary embodiment that the W/L ratio of NM3 and the W/L ratio of NM4 are 1:6. NM3 and NM4 operate in a sub-threshold region.

When the control signal EN is L, and the control signal ENX is H, the circuit stops as the circuit of FIG. 5 does. When the control signal EN is H, and the control signal ENX is L, the circuit operates normally. The operation of the circuit in this state is described below. Since EN is H, and ENX is L, PM12, NM7, and NM8 are turned OFF, and do not affect the operation of the circuit of FIG. 12. PM5 is turned ON.

The gate electrode of PM1 and that of PM2 are common. The gate electrode of PM9 and that of PM10 are common. The gate electrode of NM10 and that of NM11 are common. Accordingly, the currents that flow through PM1, PM2, PM9, PM10, R8, R9, NM10, NM11, NM3, NM4, and R1 become equal to each other. The current flowing through NM3 and the current flowing through NM4 are equal to each other. Since the W/L ratio of NM3 and the W/L ratio of NM4 are 1:6, the potential difference VR1 of both ends of the resistance R1 can be computed by the above formula (7) in a manner similar to that of the circuit of FIG. 5. Accordingly, the current Ip that flows through PM1 and PM2 can be computed by the above formula (8) in a manner similar to that of the circuit of FIG. 5.

If the drain-gate voltages of PM1, Pm2, PM9, Pm10, NM10, NM11, NM3, and NM4 are greater than respective effective gate voltages (Vgs−Vth, where Vth is the threshold voltage), the current Ip can be expressed by the formula (8). The sizes of PM1, PM2, PM9, PM10, NM10, NM11, NM3, and NM4, and the resistances of the resistors R8, R9, and R1 are determined so that the above condition is satisfied. If the circuit is designed so that when a current expressed by the formula (8) flows, the resistors R8 and R9 cause voltage drops of 0.2 V, for example, the above condition is satisfied.

The gate voltages of PM9 and PM10 are lower than the gate voltages of PM1 and PM2 by 0.2 V, for example. As a result, even if the sizes of PM1, PM2, PM9, and PM10 are equal to each other, the source potential of PM9 and PM10 are lower than Vdd by 0.2 V. The sizes can be determined so that, when the drain voltages are applied, PM1 and PM2 operate with their drain currents in saturation region. The size ratio between PM1 and PM9 may be 1:1. But, the size ratio between PM1 and PM9 may be 1:4 or 4:1. Cascode circuits are well known in the art, and the sizes may be freely determined as long as the cascode circuits realize desired characteristics.

The resistor R8 makes the gate potentials of NM10 and NM11 higher than the gate potentials of NM3 and NM4 by 0.2 V, for example. Accordingly, the cascode circuit consisting of NM10, NM3, NM11, and NM4 can be used. The using of the cascode circuit reduces dependency on power supply voltage due to the channel length modulation effect of the MOS transistors.

In the circuit shown in FIG. 12, the portion that generates a bias current expressed by the formula (8) is structured by a cascode circuit. The PMOS transistors in the portion that generates the voltage, PM3 and PM11 are also in cascode connection. The bias current generated by the circuit shown in FIG. 12 is equal to the bias current generated by the circuit shown in FIG. 5. Accordingly, the reference voltage Vref of the circuit of FIG. 12 is equal to that of FIG. 5.

Because a cascode circuit is used in the circuit of FIG. 12, a power supply voltage dependency is improved in comparison with the circuit of FIG. 5.

Figure 13:
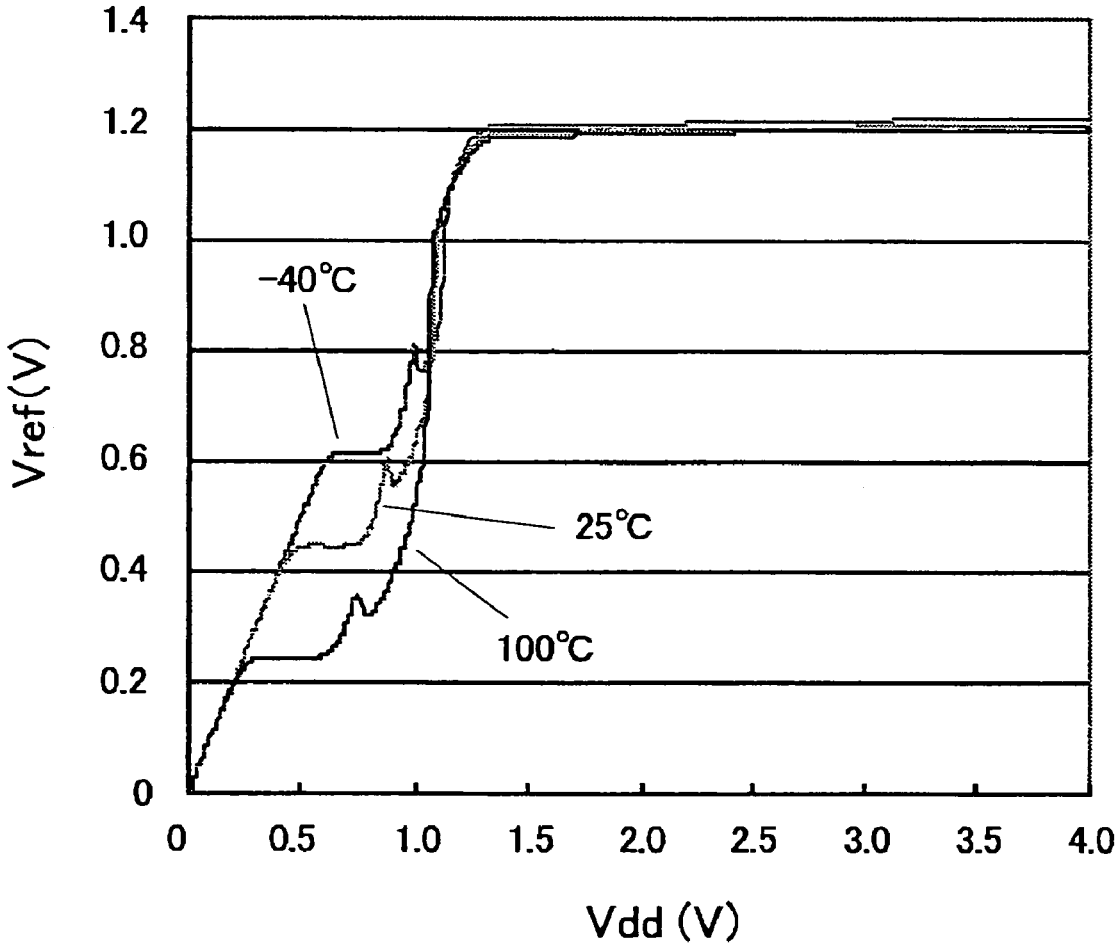
FIG. 13 is a graph showing a reference voltage of a bandgap circuit shown in FIG. 12 as a function of a power supply voltage.

FIG. 13 is a graph showing the characteristics of the power supply voltage Vdd and the reference voltage Vref of the circuit of FIG. 12. FIG. 13 shows the characteristics at temperatures −40 degrees Celsius, 25 degrees Celsius, and 100 degrees Celsius.

The output potential Vref does not change even if the temperature changes. This characteristic shows that the circuit of FIG. 12 operates as a bandgap circuit. It has been found that the power supply voltage dependency is improved with respect to the circuit of FIG. 5 since the cascode circuit is used. In addition, it has been found that the circuit of FIG. 12 operates from a power supply voltage of 1.2 V. The reason is as follows. The minimum operating voltage of the bias current generating portion rises since the cascode circuit is used. However, the resulting operating voltage is limited at voltage 1.2V of the voltage generating unit if operating voltage of the current generating portion is lower than 1.2 V.

In the above description, both the PMOS side and the NMOS side are replaced with corresponding cascode circuits. However, for example, either the PMOS side or the NMOS side may be replaced with a corresponding cascode circuit. Needless to say, a cascode circuit can be applied to the circuits shown in FIGS. 7, 8, 10, and 11 in the same manner.

Figure 14:
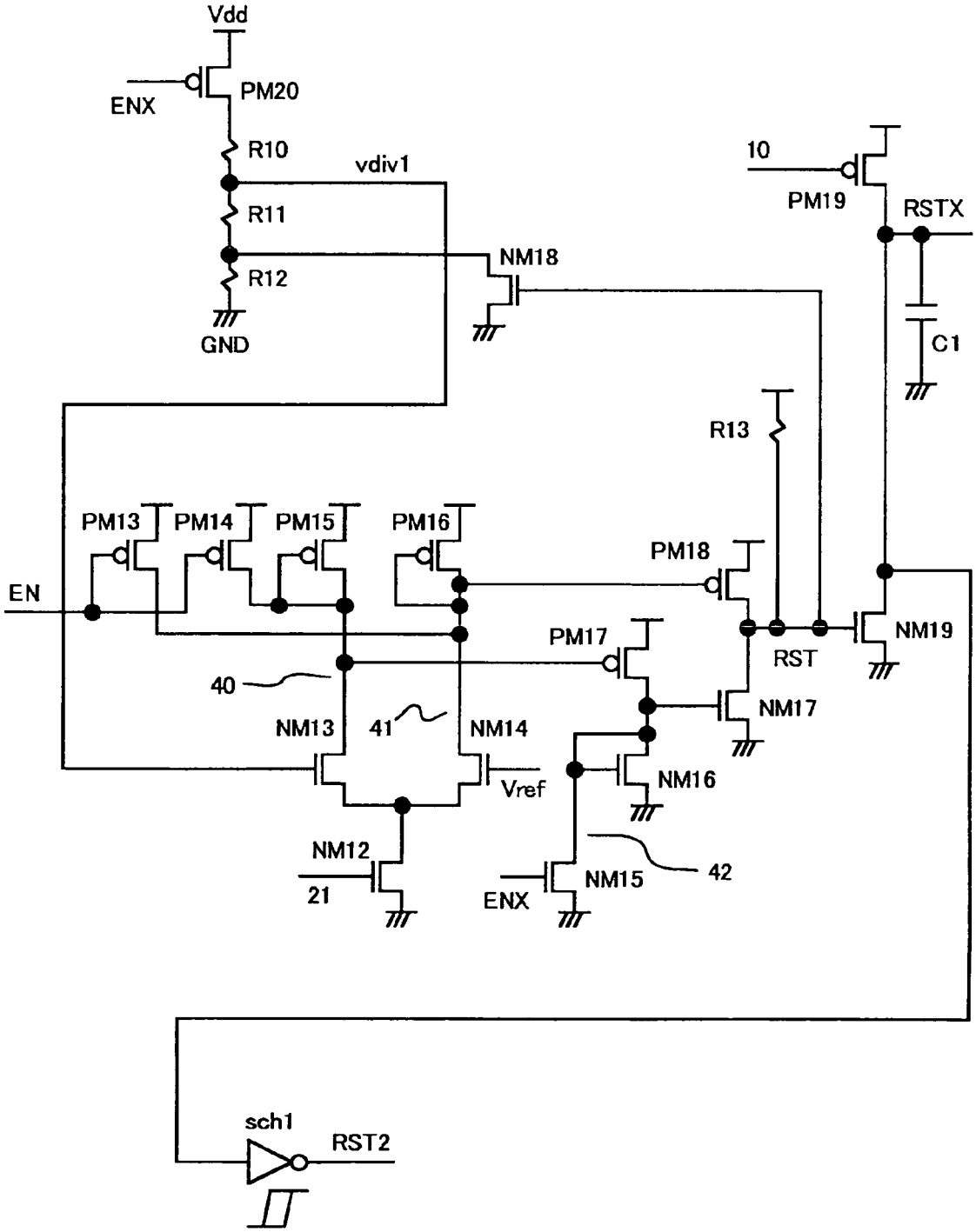
FIG. 14 is a circuit diagram showing a low voltage detection circuit according to an embodiment.
Figure 15:
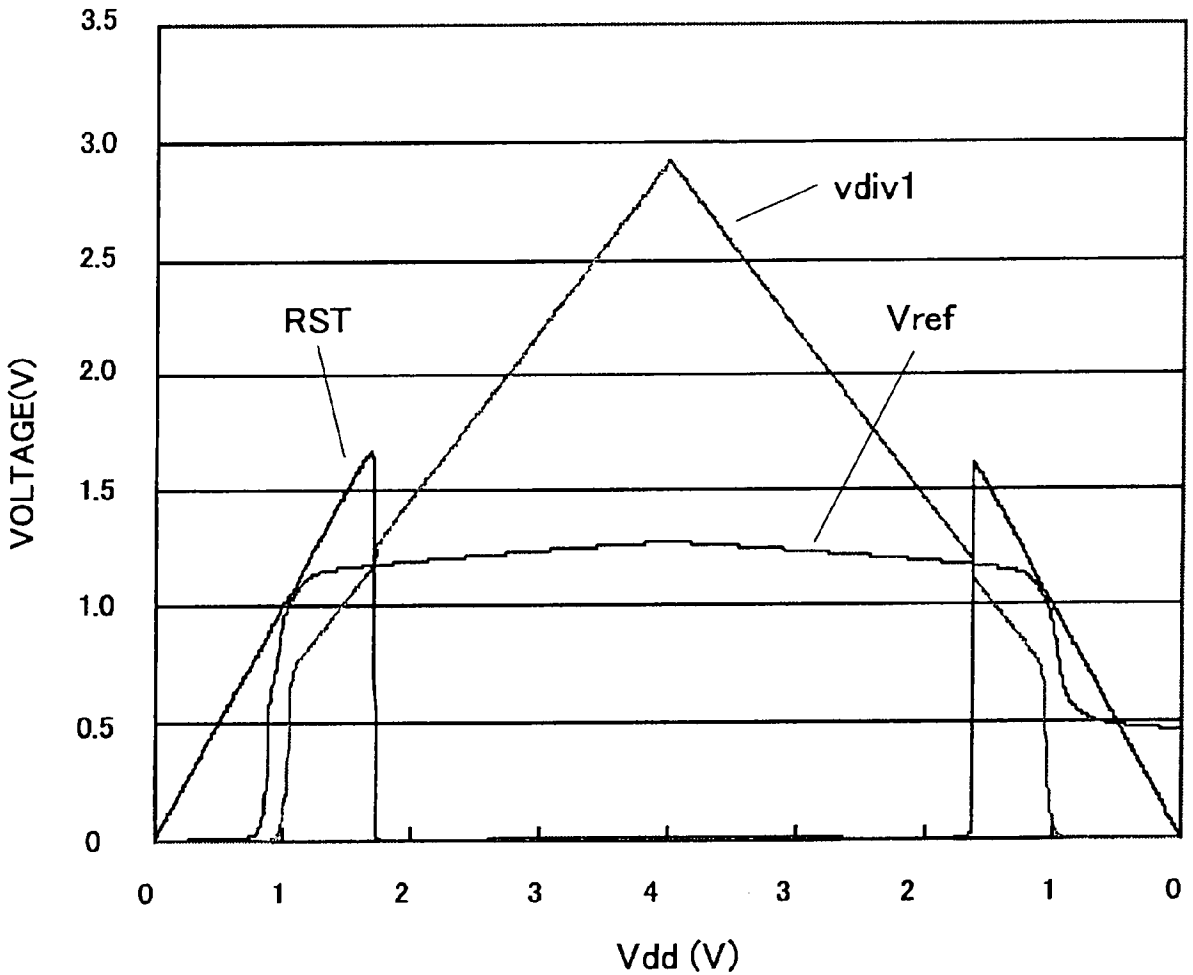
FIG. 15 is a graph showing the operational characteristics of the low voltage detection circuit shown in FIG. 14.

FIG. 14 is a circuit diagram showing a low voltage detector circuit according to an embodiment of the present invention. FIG. 15 is a circuit diagram for explaining operational characteristics of the circuit of FIG. 14.

The circuit of FIG. 14, using the reference voltage Vref generated by the circuit of FIG. 5, determines whether the power supply voltage becomes lower than a predetermined voltage. If the power supply voltage becomes lower than the predetermined voltage, the circuit of FIG. 14 outputs a reset signal. When the power supply voltage becomes higher than the predetermined value, the circuit of FIG. 14 discharges the reset signal. Even if the power supply voltage is low, and the circuit of FIG. 5 for generating the reference voltage does not operate normally, the circuit of FIG. 14 is configured to output the reset signal RST.

FIG. 14 is now described. C1 shows capacitor. R10, R11, R12, R13 indicate resistors. Vref indicates a reference potential. Vdd indicates a positive power supply. GND indicates GND terminal. Vdiv1 indicates a power supply voltage divided by resistors. NM12 through NM19 indicate NMOS transistors. PM13 through PM20 indicate PMOS transistors. 10 indicates bias potential of a PMOS transistor. 21 indicates bias potential of a NMOS transistor. 40 through 42 indicate internal nodes. EN, ENX indicate a control signal. RST, RSTX, RST2 indicate an output reset signal. sch1 indicates a Schmitt circuit. The circuit of FIG. 5 generates the reference voltage Vref, and provides the generated reference voltage Vref to the circuit of FIG. 14.

FIG. 15 is a graph in which the horizontal axis indicates the power supply voltage Vdd, and the vertical axis indicates potentials of some points of FIG. 14 (the reference voltage Vref, vdiv1, and RST). The full scale of the horizontal axis is equivalent to one second, and corresponds to an operation in which the power supply voltage is increased from 0V to 4V, and then, is lowered from 4V to 0V. The horizontal axis is equivalent to one second, but the horizontal axis is scaled in accordance with the power supply voltage Vdd to make the description easy to understand. The circuit of FIG. 5 generates the reference voltage Vref, and provides the reference voltage Vref to the circuit of FIG. 14. Therefore, the relation between the reference voltage Vref and the power supply voltage Vdd becomes almost identical to that of FIG. 6. As the power supply voltage Vdd is increased from 0V to 4V, the reference voltage generator circuit of FIG. 5 starts operating at a power supply voltage higher than about 1V. When the power supply voltage exceeds 1.2V, the reference voltage Vref becomes about 1.2V.

The control signals EN and ENX of FIG. 14 are signals to stop the circuit. When EN is L, and ENX is H, the circuit stops. In a normal operation, EN is set to H, and ENX is set to L. At first a normal operation in this state is described below.

PM20 and resistors R10, R11, and R12 function as a voltage dividing circuit that divides the power supply voltage Vdd with the resistors, and generates vdiv1. PM20 functions as an electric switch to control current so that, when the circuit is stopped, steady state current does not flow. A ratio of resistor R10 and R11 is determined based on the voltage to be detected. In the case of FIG. 14, R10:R11=1:2.2. Accordingly, if NM18 is ON, the "potential of vdiv1"=2.2Vdd/3.2=0.69 Vdd. The power supply potential that makes this voltage dividing potential 1.2 V is 1.74 V. It can be determined, by comparing this voltage vdiv1 and the reference voltage 1.2V, whether the power supply voltage is higher or lower than a certain value (1.74 V). If the power supply voltage is lower than the certain value, the circuit may malfunction. To prevent such a problem, the low voltage detection circuit determines that the power supply voltage is lowered, and generates a reset signal RST.

The reset signal RST being H indicates that the power supply voltage is lower than a predetermined value.

The resistor R12 and the NMOS transistor NM18 are components to give the circuit hysteresis so that the output RST does not oscillate in the neighborhood of the detected voltage. When the power supply voltage Vdd is lower than a predetermined value, RST is set to H, and NM18 is set to ON. When the power supply voltage rises, and RST varies towards L, NM18 is turned OFF, and the potential of voltage dividing output vdiv1 rises. Once RST is turned to L, RST does not turn to H until the divided voltage determined by the resistors R10, R11, and R12 (the divided voltage being higher than that in the case NM18 is ON) becomes lower than the reference potential Vref.

In the exemplary embodiment of FIG. 14, it is assumed that the resistors R10:R11:R12=1:2.2:0.47. If NM18 is ON (it is assumed that the ON resistance of NM18 is low enough), the potential of vdiv1=0.69 Vdd. If NM18 is OFF, the potential of vdiv1=2.67 Vdd/3.67=0.73 Vdd. In both cases, the potential vdiv1 becomes 1.2 V at the power supply voltages 1.74 V and 1.64 V, respectively. A hysteresis characteristic of 0.1V can be given to the circuit. PM15, PM16, PM17, PM18, NM13, NM14, NM12, NM16, NM17, and resistor R13 function as a comparator to compare the reference potential Vref and the divided power supply voltage vdiv1. NM12 functions as the tail current source of the differential circuit NM13 and NM14. A gate bias can be provided from the bias potential 21 of the NMOS transistor of FIG. 5.

When EN is H, and ENX is L, the gate potential of PM20 becomes 0 V. When the power supply voltage Vdd of the circuit of FIG. 14 is increased from 0 V to 4 V, the waveform of the divided power supply voltage vdiv1 exhibits a characteristic shown in FIG. 15. If the power supply voltage Vdd is low, the potential of vdiv1 becomes about 0 V, and the power supply voltage vdiv1 is not divided accurately. The above problem is a result that, although the gate potential of PM20 becomes 0 V, if the power supply voltage Vdd is lower than the threshold voltage of PM20, PM20 is not fully turned ON. A description is given of the case in which the power supply voltage Vdd is lower than 1 V, and vdiv1 and the reference potential Vref is about 0 V.

When both vdiv1 and the reference potential Vref are about 0 V, NM13 and NM14 become OFF irrespective of the gate potential of NM12. Therefore, no current flows through NM13 and NM14, and no current flows through the load circuit PM15 and PM16 of a differential circuit. Because no current flows through PM15 and PM16, no current flows through PM17 and PM18. Because current does not flow to PM17, a current does not flow to NM16 and NM17. Because both PM18 and NM17 are OFF, the output from the comparator RST, which is determined by the resistor R13, becomes Vdd.

When the power supply voltage Vdd exceeds 1 V, and is increased up to around 1.2V, the reference potential Vref becomes 1.2 V. A description is given on the operation of the circuit shown in FIG. 14 in a state in which the power supply voltage is not high enough, the reference potential Vref has not arrived at the designed voltage 1.2 V, and the divided voltage vdiv1 has not arrived at a value to be determined by a division ratio of resistors R10:R11=1:2.2.

As shown in FIG. 15, the combination of the circuit of FIG. 14 and the circuit of FIG. 5 realizes a characteristic in which the reference potential Vref increases before the potential vdiv1 does.

If the sizes of PM1, PM2, PM3 of FIG. 5 and the size of PM20 of the circuit of FIG. 14 are almost equal, when the power supply voltage Vdd is in the neighborhood of the threshold voltage of the PMOS transistor, almost the same currents flow through PM1, PM2, PM3, and PM20. It will be appreciated that the relation between the reference potential Vref and the current is exponential because of Q3. (Even if current flowing in PM3 is reduced, the potential of the node 33 of the diode does not decrease rapidly. Even if the current is reduced by 1/10, the potential of the node 33 decreases only by 60 mV.) On the other hand, the relation between the divided voltage vdiv1 and the current flowing through PM20 is almost proportional (If the current flowing through PM20 is small, the potential of vdiv1 is proportional to the flowing current.)

According to the above relation, when the power supply voltage is low, and the current flowing in the circuit is small, even if the reference potential Vref does not reach the designed voltage, 1.2V, the reference potential Vref becomes greater than the divided voltage vdiv1.

Because the reference potential Vref becomes higher than the divided voltage vdiv1, once a current begins to flow through NM13 and NM14, a current greater than the current of NM13 flows through NM14, and a current greater than the current of PM15 flows through PM16. Since a current greater than the current of PM15 flows through PM16, a current greater than the current of PM17 flows through PM18. The current of PM17 flows to NM16 (assuming that NM16 and NM17 are equal in size), and the same current flows to NM17. Because the current of PM18 is greater than the current of NM17, the potential of output RST becomes Vdd.

As described above, even in the case that the power supply voltage is too low for the reference voltage generator circuit to generate a desired reference potential, the potential of the reset signal RST can be set at the correct potential, Vdd, by devising a comparator (PM15, PM16, PM17, PM18, NM13, NM14, NM12, NM16, NM17, and resistor R13), the reference potential generator circuit, and a voltage division circuit (PM20, resistors R10, R1, and R12).

After the power supply voltage rises enough, the reference potential Vref reaches the designed voltage 1.2 V, and the divided voltage vdiv1 reaches a value determined based on a divisional ratio of resistors, R10:R11=1:2.2, the comparator (PM15, PM16, PM17, PM18, NM13, NM14, NM12, NM16, NM17, resistor R13) operates as an ordinary differential circuit. As will be appreciated, the resistance of resistor R13 and the current of NM17 are determined so that, when NM17 is turned ON, the potential of RST is turned to L.

The circuit operates in the following manner in the case in which the power supply voltage becomes great enough, the reference potential Vref reaches the designed voltage, 1.2 V, and the divided voltage vdiv1 reach a value determined based on the divisional ratio of resistors R10:R11=1:2.2.

When the reference potential Vref is greater than the divided voltage vdiv1, a current greater than the current of NM13 flows through NM14, and a current greater than the current of PM15 flows through PM16. Because the current flows through PM16 greater than that of PM15, a current flows through PM18 greater than that of PM17. The current of PM17 flows to NM16 (assuming NM16 and NM17 are equal in size), and the same current flows to NM17. Because the current of PM18 is greater than the current of NM17, the potential of output RST becomes Vdd.

In the case in which the divided voltage vdiv1 is greater than the reference potential Vref, a current greater than the current of NM14 flows through NM13, and a current greater than the current of PM16 flows through PM15. Because a greater current flows through PM15 than PM16, a greater current flows through PM17 than PM18. The current of PM17 flows to NM16 (assuming NM16 and NM17 being equal in size), and the same current flows to NM17. Because the current of PM17 is greater than the current of NM18, the potential of the output RST becomes GND.

As described above, if a change in the power supply voltage is gradual as shown in FIG. 15, the reset signal RST can be generated based on the relation between the divided voltage vdiv1 and the reference potential Vref. On the other hand, if the power supply voltage changes steeply, specifically, when the power supply voltage steps up from 0 V to 3 V, for example, a reset signal for initializing the circuit (a power-on reset signal) is required.

The circuit of FIG. 14 is designed so as to generate the reset signal in this case.

The power-on reset signal is used in order to initialize the circuit upon the turning on of the power supply. Accordingly, if the power supply voltage increases to the extent in which the circuit can be initialized, the circuit is required to generate the power-on reset signal. The circuit may be preferably configured so that, for example, when the power supply voltage Vdd steps up from 0 V to 3 V, the circuit keeps outputting the reset signal for initializing the circuit for a while.

PM19, a capacitor C1, and NM19 configure the circuit for outputting the power-on reset signal. When the power supply voltage Vdd steps up from 0 V to 3 V, the potential of RSTX is charged up to Vdd in a time period determined by the capacity C1 and the current of PM19. The potential of RSTX being GND indicates a reset state. The time constant of charging is approximately a time period from the turning-on of the power supply to the reference voltage circuit of FIG. 5 beginning to operate. When the bandgap circuit starts operating, the reference potential Vref becomes the designed voltage, 1.2 V, and as a result, the potential of RST is determined based on the relation with the divided voltage vdiv1.

The circuit of FIG. 14 is an exemplary circuit in which RSTX is charged by PM19, the gate of which is at the potential of "10". Alternatively, RSTX may be charged by a resistor. However, if a long time period for charging RSTX is desired, PM19 is advantageous in size to a resistor that occupies a larger area than does PM19. But, in the circuit of FIG. 5, for example, which generates a bias potential 10 while the starting-up circuit BLK2 operates, a great current flows to NM5. The great current may reduce the bias potential 10 lower than that of the steady state. The capacitor C1 shown in FIG. 14 may be charged with the low bias potential 10. If the charging of the capacitor C1 with the low bias potential 10 does not matter, PM19 can be used as shown in FIG. 14. Even though the generator circuit of the bias potential 10 is not in the steady-state, if the current for charging the capacitor C1 needs to be determined precisely, PM19 is desired to be replaced with the resistor.

When RSTX is fully charged, the reset is discharged, that is, the circuit starts operating. Accordingly, it does not matter that it takes a long time to charge RSTX. On the other hand, when the power supply voltage is lowered, it is necessary to detect degradation of voltage in a short time in order to prevent the circuit from malfunctioning. For such a purpose, when the power supply voltage is reduced, and RST is turned to H, RSTX is discharged more quickly than NM19 is in the circuit shown in FIG. 14.

In addition, the waveform of the reset signal RSTX is shaped by a Schmitt circuit.

The circuit of FIG. 14 has been described with the assumption that it is combined with the bandgap circuit of FIG. 5. According to another embodiment, the circuit of FIG. 14 may be combined with a bandgap circuit according to another embodiment of the present invention or the conventional bandgap circuits.

Figure 16:
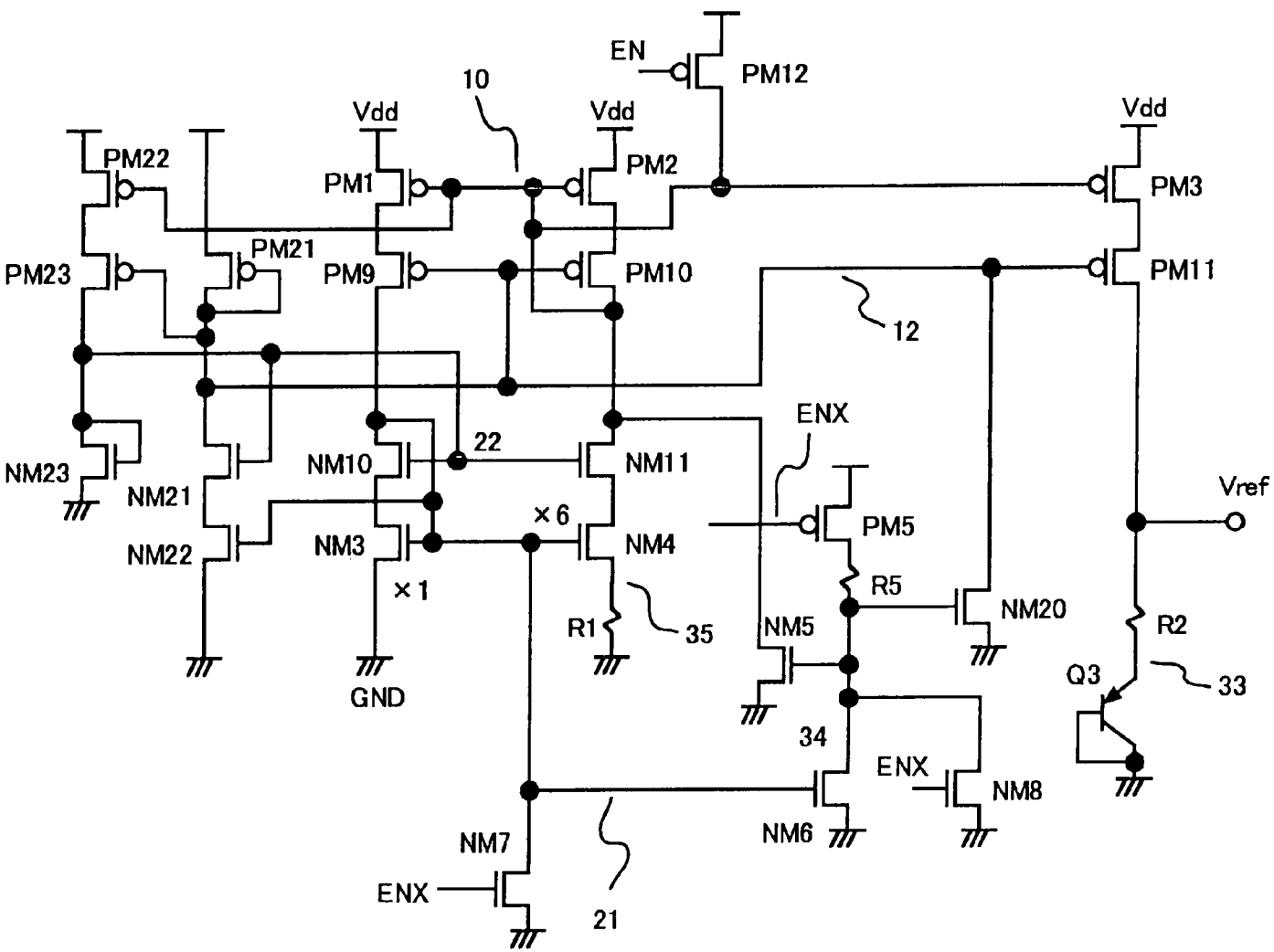
FIG. 16 is a circuit diagram showing a bandgap circuit according to yet another embodiment.

FIG. 16 is a circuit diagram showing a bandgap circuit according to yet another embodiment of the present invention.

The circuit of FIG. 16 operates almost in the same manner as the circuit of FIG. 12. The bandgap circuit of FIG. 16 is described with an emphasis on the difference from the bandgap circuit of FIG. 12.

In FIG. 16, Q3 indicates a pnp bipolar transistor. R1, R2, and R5 indicate resistors. Vref indicates an output reference potential. Vdd indicates a positive power supply. GND indicates the GND terminal. NM3 through NM8, NM10, NM11, NM21, NM22, and NM23 indicate NMOS transistors. PM1 through PM3, PM5, PM9, PM10, PM11, PM12, PM21, PM22, and PM23 indicate PMOS transistors. "10" and "12" indicate bias potentials of PMOS transistors. "21" and "22" indicate bias potentials of NMOS transistors. "33" through "35" indicate internal nodes. EN and ENX indicate control signals. In FIG. 16, elements identical to those shown in FIG. 8 are referred to by the same numerals and their description is omitted.

The circuit of FIG. 16 is different from the circuit of FIG. 12 in a method of generating bias potentials 22 and 12 of a cascode circuit. A description is given below of a method for generating the bias potentials 22 and 12 of the cascode circuit configured as shown in FIG. 16.

In the circuit shown in FIG. 12, the potential 12 is generated based on the bias potential 10 of the PMOS transistors and the voltage drop of the resistor R9 (determined by the resistor R9 and a flowing current). In the circuit shown in FIG. 16, however, NM21 and NM22 cause a current flow through PM21 thereby to generate the gate and source potential of PM21. The gate and source potential of PM21 becomes the bias potential 12.

In addition, the circuit of FIG. 12 generates the potential 22 based on the bias potential 21 and the voltage increase of the resistor R8 determined by the flowing current therethrough and the resistance. The circuit of FIG. 16 causes a current flow through NM23 using PM22 and PM23 to generate the gate and source potential of NM23. The gate and source potential is used as the bias potential 22.

In this case, if the W/L ratio of PM21 is determined to be lower than those of PM1, PM2, PM3, PM9, PM10, PM11, PM22, and PM23, the bias potential 12 can be set lower than the bias potential 10 as long as needed. In addition, if the W/L ratio of NM23 is determined to be lower than those of NM3, NM4, NM10, NM11, NM21, and NM22, the bias potential 22 can be set higher than the bias potential 21 as long as needed.

The circuit of FIG. 16 generates the bias potential 12 using PM21 independently from the bias potential 10. According to the above arrangement, NM20 is additionally provided for flowing a starting-up current through PM21.

Figure 17:
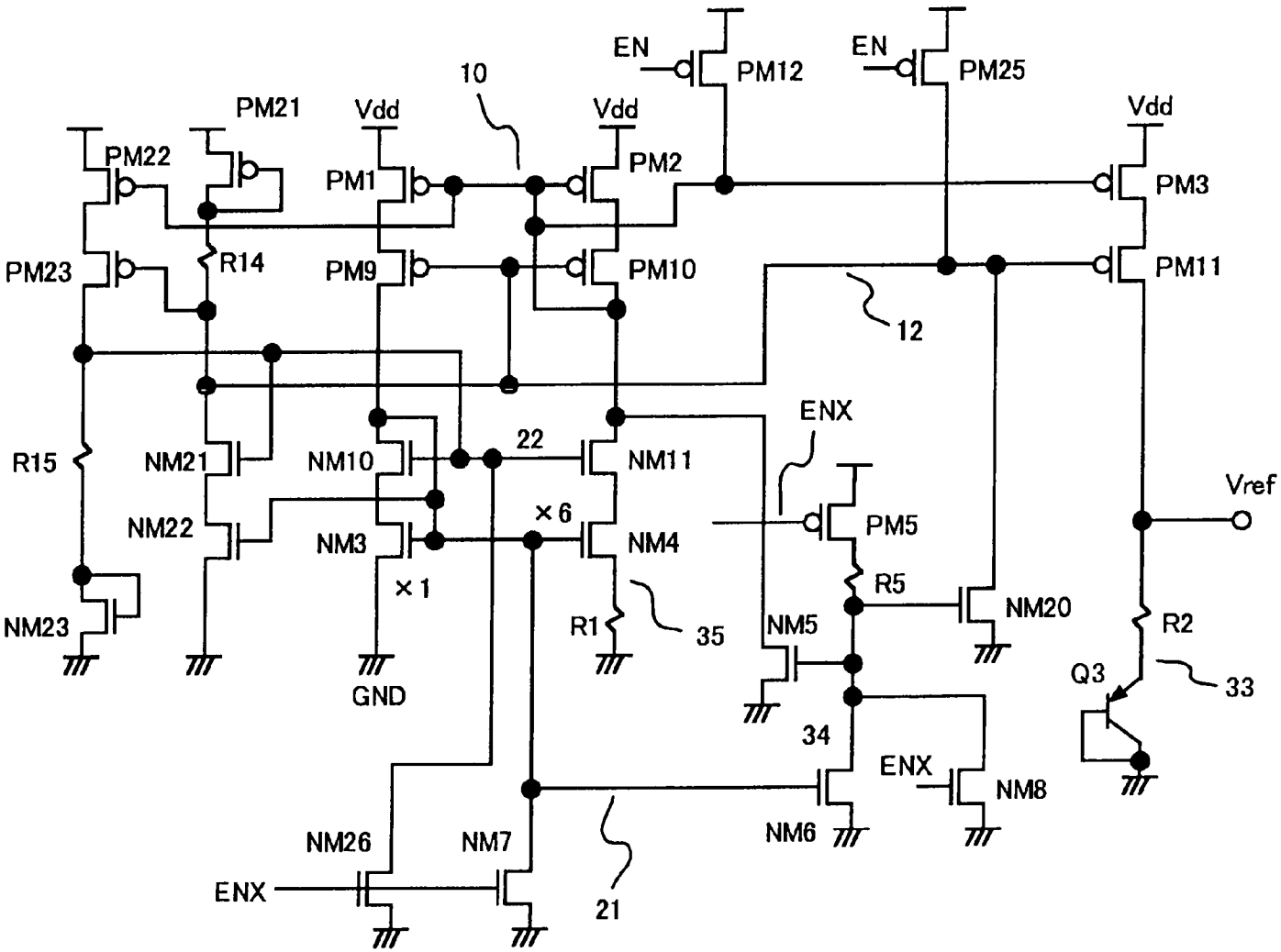
FIG. 17 is a circuit diagram showing a bandgap circuit according to yet another embodiment.

FIG. 17 is a circuit diagram showing a bandgap circuit according to yet another embodiment of the present invention.

The circuit of FIG. 17 operates almost in the same manner as the circuit of FIG. 16. A description is given mainly of the difference of the bandgap circuit of FIG. 17 from the band gap circuit of FIG. 16.

In FIG. 17, Q3 indicates a pnp bipolar transistor. R1, R2, R5, R14, and R15 indicate resistors. Vref indicates the output reference potential. Vdd indicates a positive power supply. GND indicates a GND terminal. NM3 through NM8, NM10, NM11, NM21, NM22, NM23 indicate NMOS transistors. PM1 through PM3, PM5, PM9, PM10, PM11, PM12, PM21, PM22, and PM23 indicate PMOS transistors. 10 and 12 indicate bias potential of a PMOS transistor. 21 and 22 indicate bias potential of a NMOS transistor. 33 through 35 indicate internal nodes. EN and ENX indicate control signals. In FIG. 17, elements having the same functions as those shown in FIG. 16 and corresponding nodes are referred to by the same symbols.

The circuit of FIG. 17 is different from the circuit of FIG. 16 in a method of generating the bias potentials 22 and 12 of a cascode circuit. A method of generating the bias potentials 22 and 12 of the cascode circuit configured as shown in FIG. 17 is described below.

The circuit of FIG. 16 generates the bias potential 12 using PM21 of a low W/L ratio. The W/L ratio of PM21 is almost equal to the W/L ratio of PM1, PM2, PM3, PM9, PM10, PM11, PM22, and PM23. The circuit of FIG. 17, however, can generate the bias potential 12 lower than the bias potential 10 as long as desired since the resistor R14 is provided therein.

Though the W/L ratio of NM23 is almost equal to the W/L ratios of NM3, NM4, NM10, NM11, NM21, and NM22, the circuit of FIG. 17 can generate the bias potential 22 as long as desired higher than the bias potential 21 because the resistor R15 is additionally provided therein.

The resistor R15 and the NMOS transistor NM23 are connected in series, and a current flows through them. As a result, a cascode bias 22 is generated. The temperature dependency of the cascode bias 22 is determinable as desired since the voltage between gate and sources negatively depends on temperature, and to the contrary, the voltage drop by the PTAT current flowing through the resistor R15 positively depends on temperature.

The potential at node 35 of the circuit shown in FIG. 17 is proportional to absolute temperature because the bias current flowing through the circuit is a PTAT current that changes proportionally to absolute temperature. If the drain potential of NM4 is fixed independently from temperature, the potential difference between the drain and the source of NM4 decreases as temperature rises. Ideally speaking, if the potential difference between the drain-source of NM4 is great to some extent, a PTAT current flows in the circuit. In practice, however, the current through a MOS transistor depends on the potential difference between a drain and a source. When temperature rises, if the potential difference between the drain and the source of NM4 does not increase greatly, a current less than the ideal PTAT current flows in the circuit. Since an accurate PTAT current needs to be generated thereby to secure the accuracy of a reference potential, it is necessary to prevent the potential difference between the drain and the source of NM4 from being reduced as the temperature rises. Because the potential of the node 35 increases proportional to temperature, the drain potential of NM4 is desired to increase as temperature rises. Accordingly, the circuit needs to be designed so that the cascode bias 22 becomes a potential equal to the sum of the ideal drain potential of NM4 and the threshold voltage of a NMOS transistor. In other words, if the temperature dependency of the gate-source voltage and the temperature dependency of the PTAT current are taken into consideration, a more accurate PTAT current can be generated.

As described above, in the case of the circuit shown in FIG. 17, as the temperature dependency of the cascode bias 22 is a design issue that a circuit designer can determine at his/her discretion, the temperature dependency of the source potential of NM11 is a design issue. Accordingly, the circuit designer can determine the temperature dependency of the NM4 drain-source potential difference at his/her discretion. In other words, the NM4 drain-source potential difference can be fine tuned in accordance with the temperature dependency of the cascode bias 22, and as a result, the temperature dependency of the bias current can be fine tuned to a desired characteristic.

Figure 18:
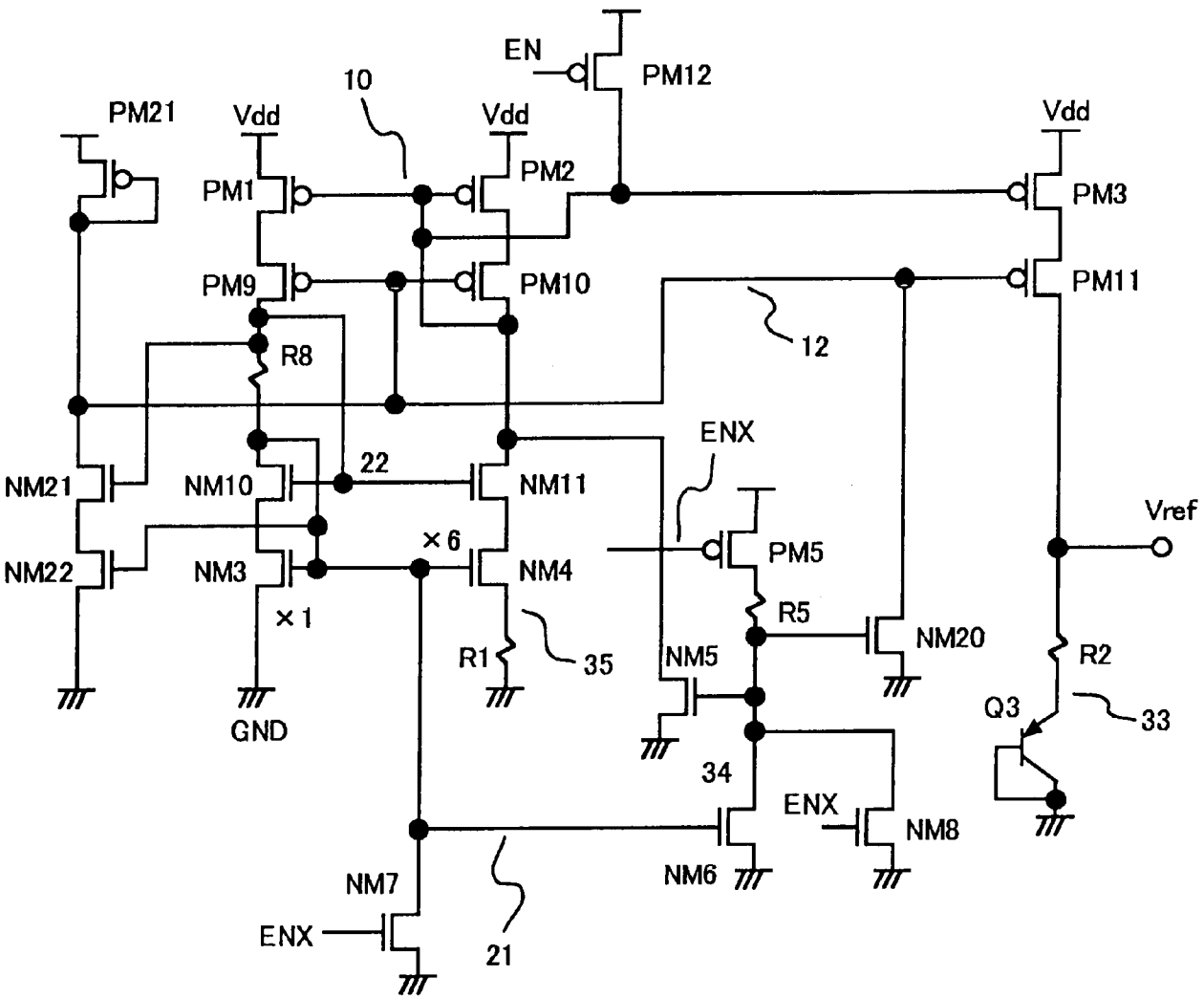
FIG. 18 is a circuit diagram showing a bandgap circuit according to yet another embodiment.

FIG. 18 is a circuit diagram showing a bandgap circuit according to another embodiment of the present invention.

The circuit of FIG. 18 operates almost in the same manner as the circuits of FIG. 16 and FIG. 17. The differences of the bandgap circuit of FIG. 18 from the bandgap circuit of FIG. 16 are mainly described below.

In FIG. 18, Q3 indicates a pnp bipolar transistor. R1, R2, R5, and R8 indicate resistors. Vref indicates an output reference potential. Vdd indicates a positive power supply. GND indicates a GND terminal. NM3 through NM8, NM10, NM11, NM21, and NM22 indicate NMOS transistors. PM1 through PM3, PM5, PM9, PM10, PM11, PM12, and PM21 indicate PMOS transistors. Numerals 10 and 12 indicate the bias potentials of PMOS transistors. Numerals 21 and 22 indicate the bias potentials of NMOS transistors. Numerals 33 through 35 indicate internal nodes. EN and ENX indicate control signals. In the circuit of FIG. 18, elements having the same functions as those of FIGS. 12, 16, and 17, and corresponding nodes are referred to by the same reference symbols.

The circuit of FIG. 18 is different from the circuit of FIG. 16 in the method of generating the bias potentials 22 and 12 of the cascode circuit. The method of generating the bias potentials 22 and 12 of the cascode circuit are configured as shown in FIG. 18.

The circuit of FIG. 16 generates the bias potential 12 using PM21 of low W/L ratio. The circuit of FIG. 18 generates the bias potential 12 in the same manner, but employs a different method of generating the bias potential of the NMOS transistor. The circuit of FIG. 18 generates the bias potential 22 using a resistor R8 in the same manner as does the circuit of FIG. 12. As described above, the method of generating bias potential of the circuit shown in FIG. 12 and the method of generating bias potential of the circuits shown in FIGS. 16 and 17 may be combined together.

The advantage of the circuit for generating the cascode bias 22 of the NMOS transistor is almost the same as the advantage of the circuit for generating the cascode bias 22 of the NMOS transistor shown in FIG. 17.

The cascode bias potential 22 of the circuit shown in FIG. 18 is generated by shifting the bias potential 21 of the NMOS transistor using the resistor R8 and the PTAT current. The temperature dependency of the cascode bias potential 22 is determined by the temperature dependency of the gate-source voltage and the positive temperature dependency of a voltage drop generated by the resistor R8.

As described with reference to FIG. 17, if the drain-source potential difference of NM4 is reduced greatly as temperature rises, a current that actually flows in the circuit becomes less than the ideal PTAT current. Even if temperature rises, the drain-source potential difference of NM4 is required not to decrease greatly in order to avoid the above problem and to generate an accurate PTAT current thereby to secure the accuracy of the reference potential. As the temperature rises, since the potential of the node 35 increases, the drain potential of NM4 is desired to increase too. If the circuit is designed so that, as temperature rises, the cascode bias potential 22 at least increases, the drain-source potential difference of the circuit does not decrease even if temperature rises. According to the above arrangements, a more accurate PTAT current can be generated, and as a result, the reference voltage becomes accurate.

On the other hand, the bias potential of the PMOS transistor functions only as a current mirror, and does not need to determine the bias current (PTAT current) of the entire circuit. As a result, the circuit designer can design the circuit for generating the cascode bias 12 of the PMOS transistor taking a required area, a power consumption, and a minimum operating voltage into consideration. The using of the resistor R9 for generating the cascode bias 12 of the PMOS transistor as shown in FIG. 12 is advantageous in power consumption, but is disadvantageous in minimum operating voltage and the required area.

In order to reduce the required area and to lower power consumption, the circuit for generating the cascode bias 12 of the PMOS transistor in the circuit of FIG. 18 is similar to the corresponding circuit shown in FIG. 16 without use of the level shift of the resistor R9 because the circuit for generating the cascode bias 12 affects only a little the accuracy of the PTAT current and the reference voltage. The cascode bias 12 of PMOS transistors is generated by the PMOS transistor PM21 of a low W/L ratio. According to the above arrangements, the drain-source potential difference of NM11 that is a cascode transistor of NM4 is prevented from being reduced even when temperature rises, wherein NM4 generates a current proportional to absolute temperature. The above arrangement contributes to preventing the accuracy of the PTAT current from degrading.

As described above, the circuit shown in FIG. 18 secures the accuracy of the PTAT current because the resistor R8 is used only for generating the cascode bias 22, and the PMOS transistor PM21 of low W/L ratio is used for generating the cascode bias 12 of the PMOS transistors.

Figure 19:
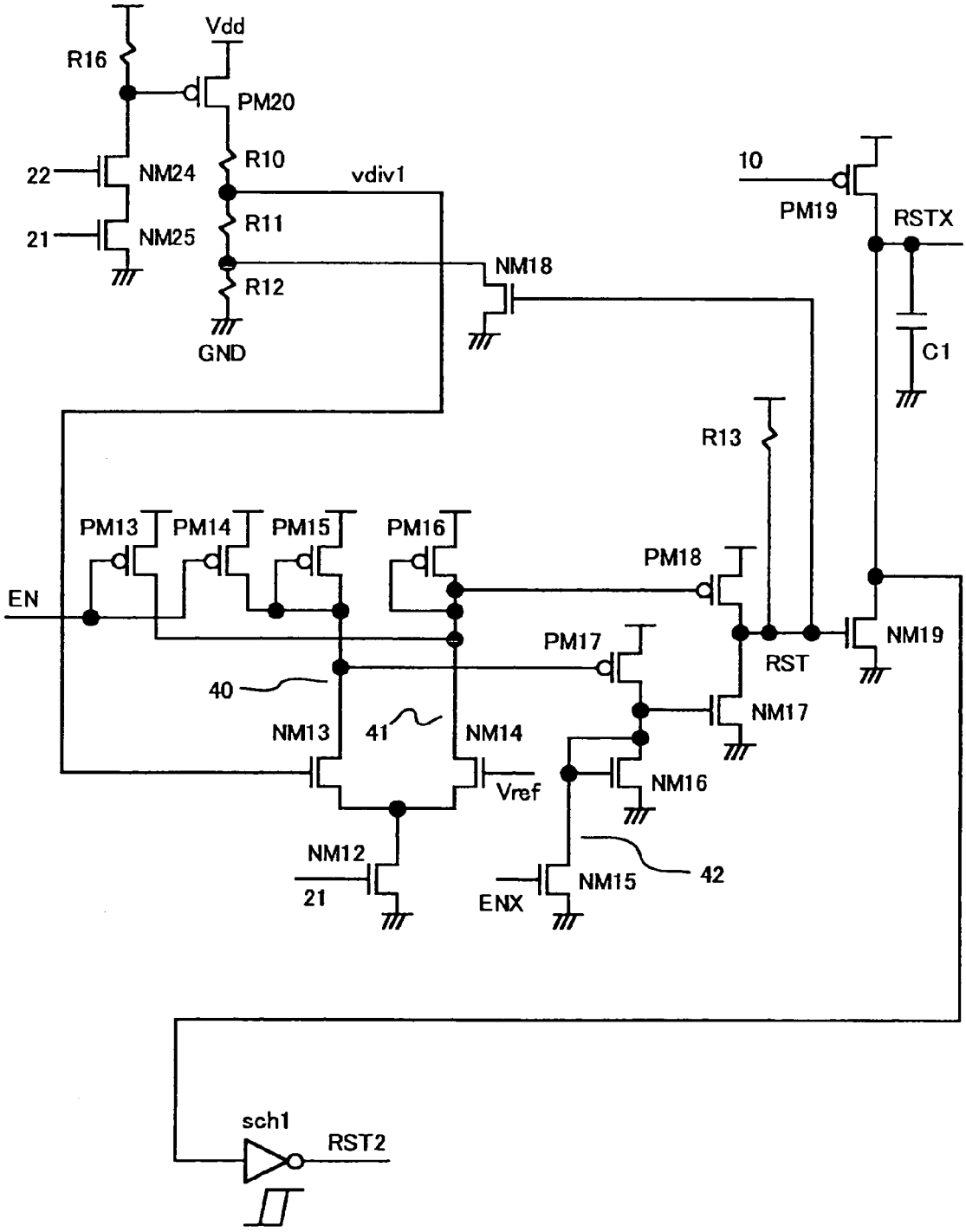
FIG. 19 is a circuit diagram showing a low voltage detection circuit according to another embodiment.

FIG. 19 is a circuit diagram showing a low voltage detection circuit according to another embodiment of the present invention.

The circuit of FIG. 19 determines whether the power supply voltage becomes lower than a predetermined voltage using the reference voltage Vref of the circuits shown in FIGS. 12, 16, 17, and 18, and when the power supply voltage becomes lower than the predetermined value, outputs a reset signal. In FIG. 19, components having the same function as those shown in FIG. 14 and corresponding node are referred to by the same reference symbols.

In FIG. 19, C1 indicates a capacitor. R10, R11, R12, R13, and R16 indicate resistors. Vref indicates a reference potential. Vdd indicates a positive power supply. GND indicates a GND terminal. vdiv1 indicates a power supply voltage divided by resistors. NM12 through NM19, NM24, and NM25 indicate NMOS transistors. PM13 through PM20 indicate PMOS transistors. A numeral 10 indicates the bias potential of a PMOS transistor. Numerals 21 and 22 indicate the bias potential of NMOS transistors. Numerals 40 through 42 indicate internal nodes. EN and ENX indicate control signals. RST, RSTX, RST2 indicate output reset signals. sch1 indicates a Schmitt circuit. If the power supply voltage is lower than the predetermined voltage, the potential of RST becomes Vdd.

The circuit of FIG. 19 is almost the same as the circuit of FIG. 14, but is different in a portion for generating the divisional voltage vdiv1 because it uses a cascode circuit for generating the bandgap voltage as in the circuits shown in FIGS. 12, 16, 17, and 18.

The circuit of FIG. 14 uses PM20 and resistors R10, R11, R12 for generating the divisional voltage vdiv1. The control signal ENX is directly applied to the gate electrode of PM20.

The circuit of FIG. 19, on the other hand, generates the gate signal of PM20 using the resistor R16, and the NMOS transistors NM24 and NM25. As described above, even if the power supply voltage is low, and the reference potential Vref does not reach the designed voltage 1.2V, the circuit can generate the reference potential Vref greater than the divisional voltage vdiv1 with certainty because the gate signal of PM20 is generated using the resistor R16, and the NMOS transistors NM24 and NM25.

In the exemplary embodiment, it is assumed that Vref is provided by the bandgap circuit of FIG. 16, for example.

When the power supply voltage Vdd is lower than the threshold voltage of PM20, even if the gate potential of PM20 becomes 0 V, PM20 is not fully turned ON, and accordingly, the potential of the divided voltage vdiv1 becomes about 0 V. When the power supply voltage Vdd exceeds the threshold voltage Vth of PM20, the ON resistance of PM20 begins to decrease, and the potential of the divided voltage vdiv1 begins to rise. However, the power supply voltage at which Vref of the bandgap circuit of FIG. 15 begins to rise is higher than the threshold voltage of MOS transistor because the bias potential 22 and 12 of the cascode circuit are greater than the threshold voltage of the MOS transistors.

When the circuit of FIG. 14 and the circuit of FIG. 16 are combined, the divisional voltage vdiv1 may become greater than the reference potential Vref in a state in which the power supply voltage is not high, the reference potential Vref does not reach the designed voltage 1.2 V, and the divisional voltage vdiv1 does not reach the value determined by the divisional ratio of resistors R10 and R11. If the above problem does not matter, the circuit of FIG. 14 and the circuit of FIG. 16 can be combined. Otherwise, if the divisional voltage vdiv1 is desired to be greater than the reference potential Vref in a state in which the power supply voltage is not high, the reference potential Vref does not reach the designed voltage 1.2 V, and the divisional voltage vdiv1 does not reach the value determined by the divisional ratio of resistors R10 and R11, the circuit of FIG. 19 and the circuit of FIG. 16 may, alternatively, be combined.

If the bias potentials 22 and 21 of the bandgap circuit are added to NM24 and NM25, a current equal to (or a multiple of) the current that flows in the cascode circuit of the bandgap circuit flows in NM24 and NM25. If the circuit is designed so that the voltage drop by R16 increases in the status that the current flowing in the bandgap circuit approaches enough to the final value, PM20 is not turned on until the current starts flowing in the bandgap circuit.

According to the above arrangements, PM20 shown in FIG. 19 is turned on after the bias potentials 22 and 21 of the bandgap circuit shown in FIG. 16 are increased, and the bandgap circuit starts operating. Therefore, even if the power supply voltage is not great, and the reference potential Vref does not reach the designed voltage 1.2 V, the reference voltage Vref becomes greater than the divided voltage vdiv1 without fail.

Figure 20:
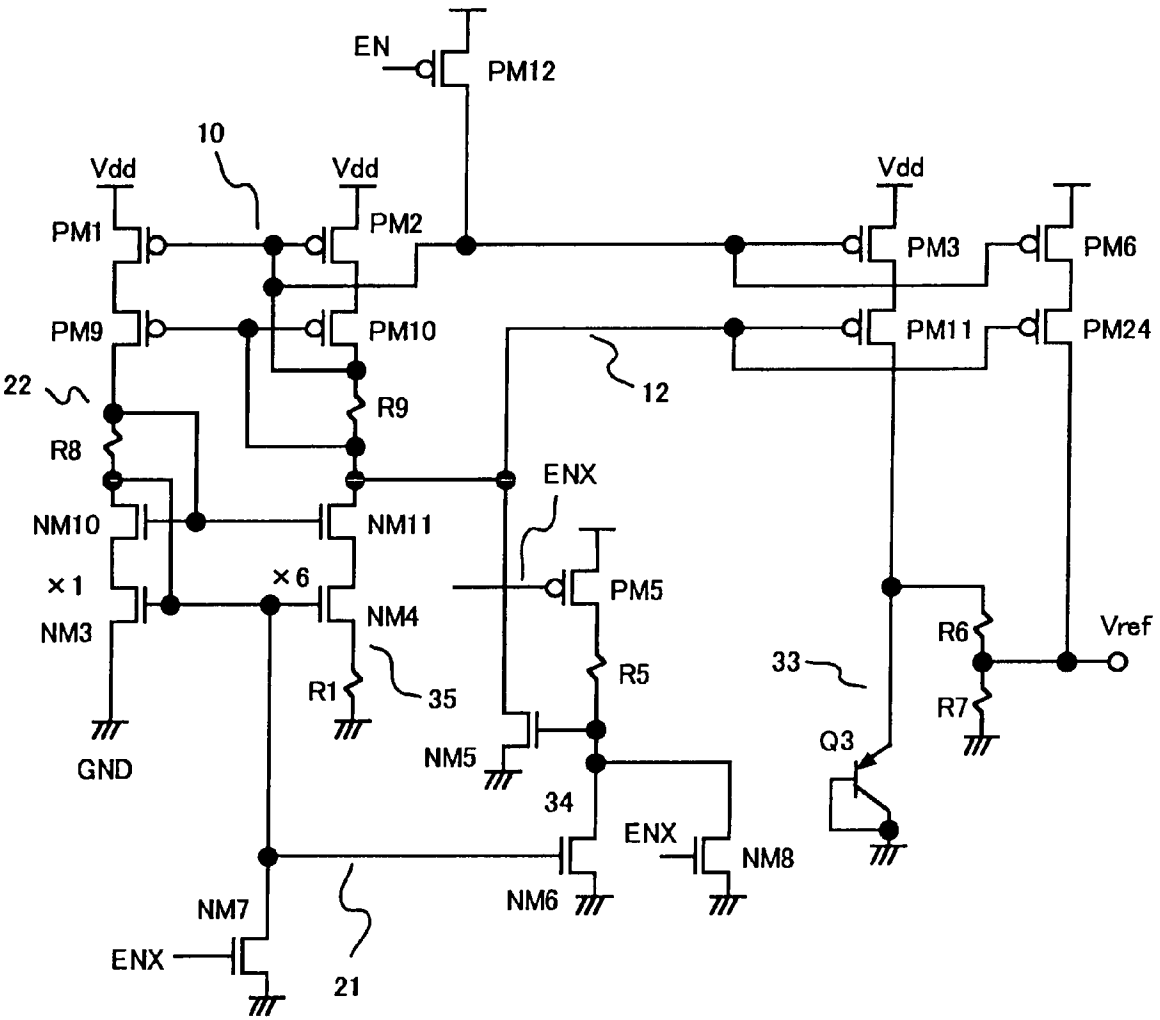
FIG. 20 is a circuit diagram showing a bandgap circuit according to yet another embodiment.

FIG. 20 is a circuit diagram showing a bandgap circuit according to another embodiment of the present invention.

The circuit of FIG. 20 operates almost in the same manner as do the circuits of FIGS. 12 and 8. The circuit of FIG. 20 uses MOS transistors that operate as a current source as shown in FIG. 7 in a cascode connection as the circuit of FIG. 12.

As will be appreciated, the operation of the circuit shown in FIG. 20 can be easily understood based on the operations of the circuits shown in FIGS. 12 and 8, and therefore its detailed description is omitted. The circuit of FIG. 20 is configured, as is the circuit of FIG. 8, so as to generate a voltage other than 1.2 V, for example, 0.6 V. The cascode connection in the circuit of FIG. 20 reduces the power supply voltage dependency of the reference voltage as in the manner of the cascode connection in the circuit of FIG. 12.

Figure 21:
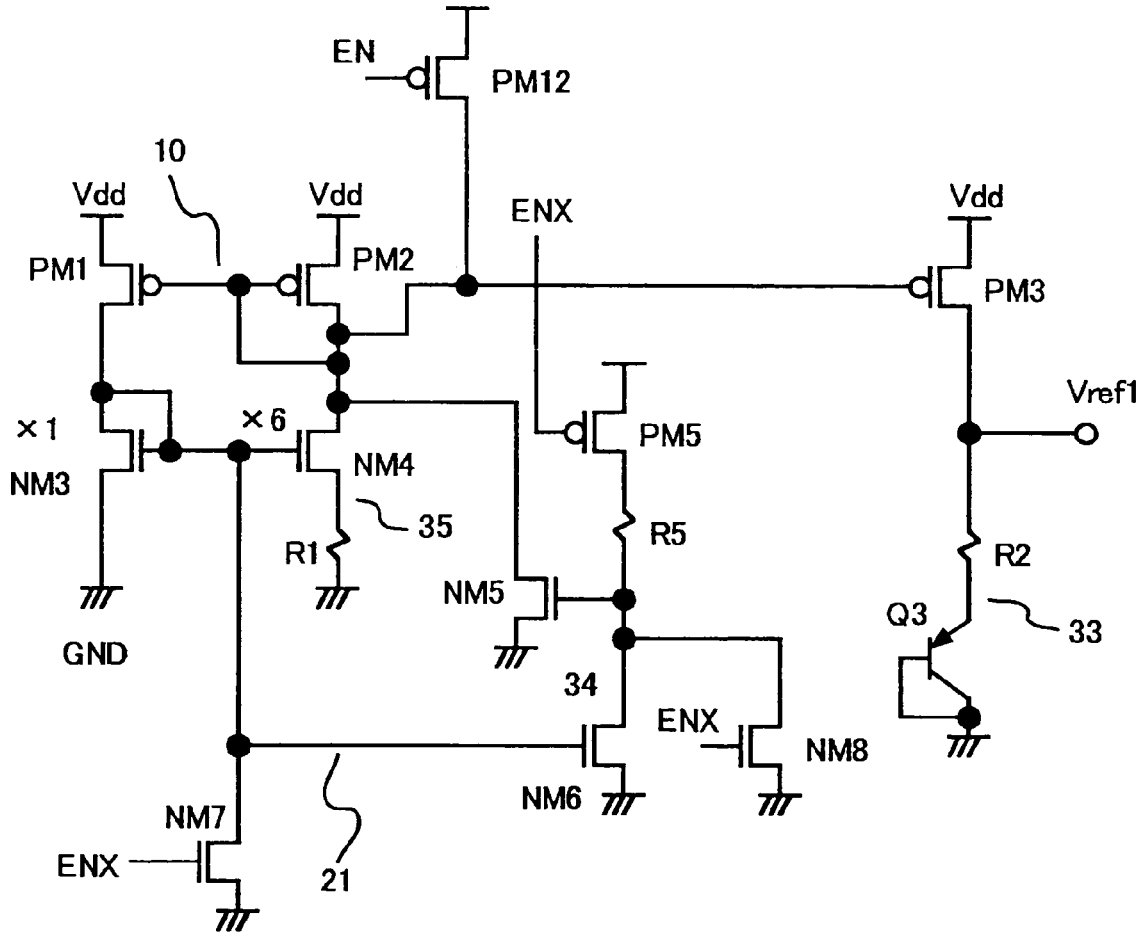
FIG. 21 is a circuit diagram showing a part of a low voltage detection circuit according to another embodiment.
Figure 22:
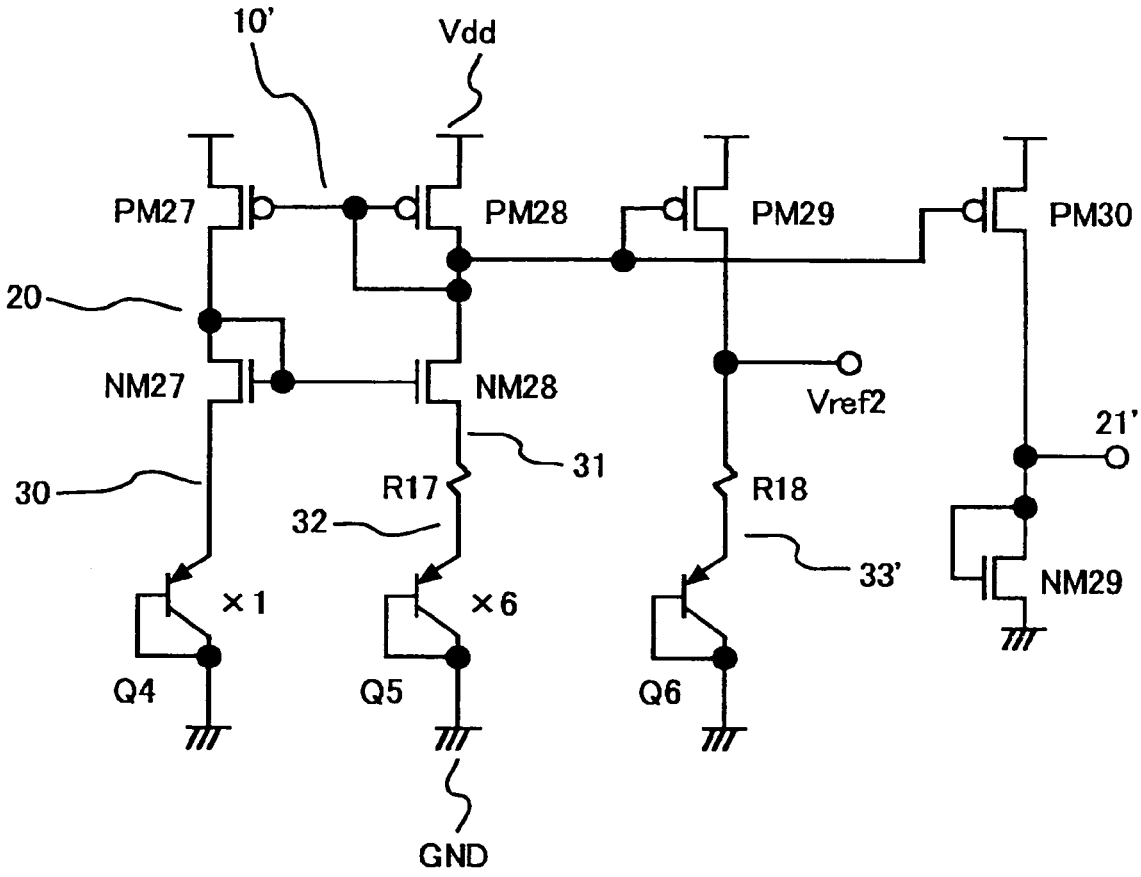
FIG. 22 is a circuit diagram showing a part of a low voltage detection circuit according to another embodiment.
Figure 23:
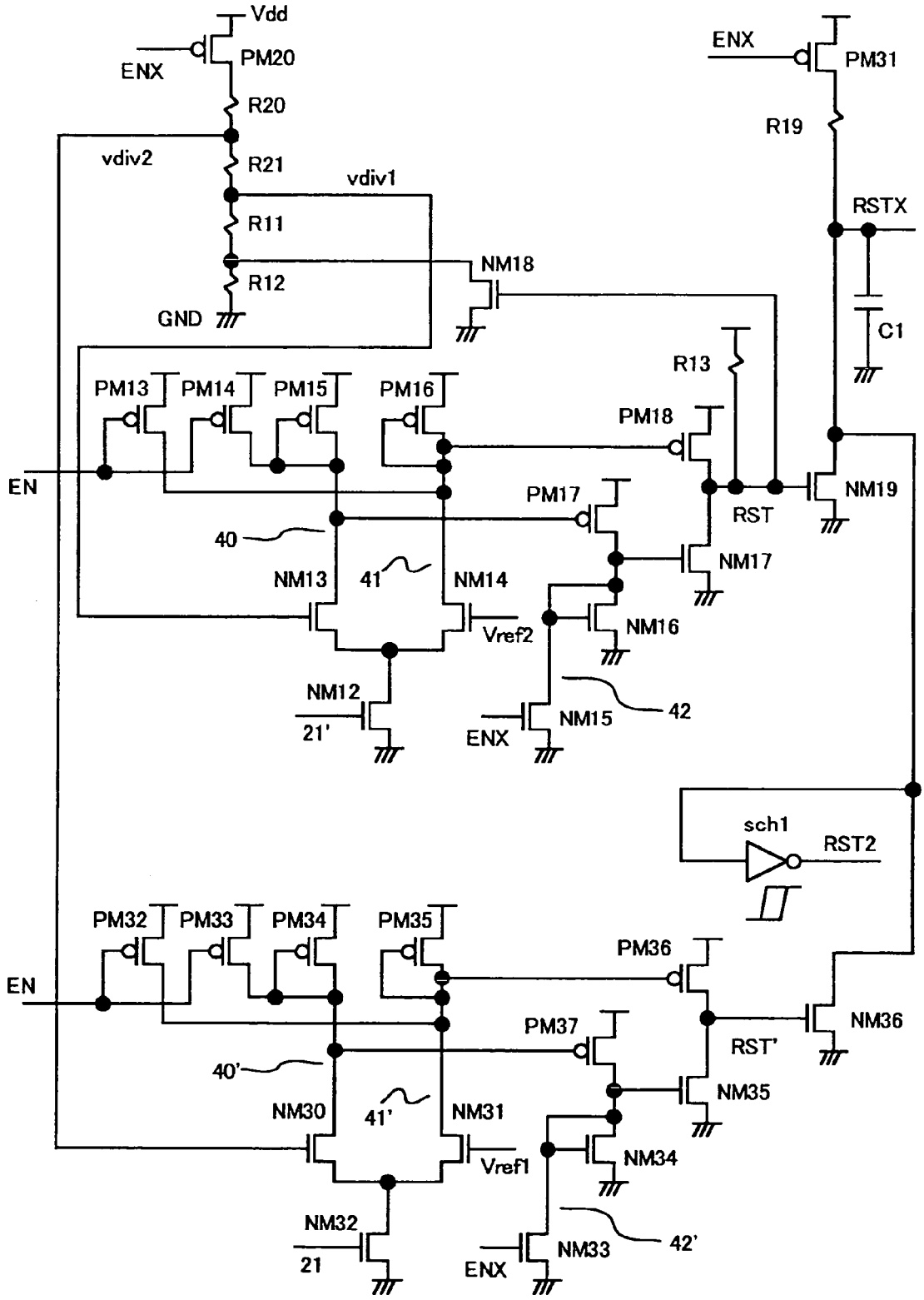
FIG. 23 is a circuit diagram showing a part of a low voltage detection circuit according to another embodiment.

FIGS. 21, 22 and 23 are circuit diagrams showing voltage detection circuits according to other embodiments of the present invention.

FIG. 21 shows the same reference voltage circuit as FIG. 5. FIG. 22 shows a reference voltage circuit partially including the conventional reference voltage circuit shown in FIG. 1. FIG. 23 shows a low voltage detection circuit that detects a low voltage using the reference voltages of FIGS. 21 and 22.

One way in which the circuit of FIG. 22 is different from the circuit of FIG. 1 is in PM30 and NM29. When the power supply voltage rises and the circuit of FIG. 22 becomes operable, a current flows to PM30, and a bias potential corresponding to the current is generated by NM29, and is output to the node 21'.

As described with reference to FIG. 5, the reference voltage circuit (bandgap circuit) of FIG. 21 is suitable for operating at a low voltage. On the other hand, the characteristics of MOS transistors does not easily affect the reference voltage generated by the reference voltage circuit (bandgap circuit) of FIG. 22 since the PTAT current is generated using the ratio of emitter junction areas of the pnp bipolar transistors. That is, the circuit of FIG. 22 has a minimum operating power supply voltage higher than the circuit of FIG. 21, but controls the reference voltage at a higher accuracy.

According to the advantage of the circuit of FIG. 22, the circuit of FIG. 23 uses, when the power supply voltage is within a normal range, the reference voltage of high accuracy generated by the circuit of FIG. 22, and uses, when the power supply voltage is so low that the circuit of FIG. 22 does not operate, the reference voltage Vref1 generated by the circuit of FIG. 21. Since the two reference voltage circuits are combined, the low voltage detection circuit inherits the advantage of the circuit of FIG. 22 that the output reference voltage is highly accurate and the advantage of the circuit of FIG. 21 that the minimum operating voltage is low.

The circuit of FIG. 23 determines whether the power supply voltage is reduced lower than a predetermined voltage using the reference voltages Vref1 and Vref2 of the circuits shown in FIG. 21 and FIG. 22, respectively, and when the power supply voltage becomes lower than the predetermined voltage, outputs a reset signal. When the power supply voltage rises higher than the predetermined voltage, the circuit of FIG. 23 discharges the reset signal. The circuit of FIG. 23 is configured so as to output the reset signal RST appropriately even if the power supply voltage is reduced down to a voltage at which both the circuits of FIGS. 21 and 22 can not operate.

In FIG. 23, C1 indicates a capacitor. R11, R12, R13, R19, R20, and R21 indicate resistors. Vref1 and Vref2 indicate reference potentials. Vdd indicates a positive power supply voltage. GND indicates a GND terminal. vdiv1 and vdiv2 indicate power supply voltages divided by the resistors. NM12 through NM19, and NM30 through NM36 indicate NMOS transistors. PM13 through PM18, PM20, and PM31 through PM37 indicate PMOS transistors. Numerals 21 and 21' indicate the bias potentials of the NMOS transistors. Numerals 40 through 42, 40', 41', and 42' indicate internal nodes. EN and ENX indicate control signals. RST, RST', RSTX, and RST2 indicate output reset signals. sch1 indicates a Schmitt circuit.

The structure and the operation of the circuit shown in FIG. 23 is similar to those of the circuit shown in FIG. 14, and accordingly, mainly their differences are described below.

The circuit shown in the top half of FIG. 23 includes C1, R11, R12, R13, R20, R21, Vref2, vdiv1, NM12–NM19, PM13–PM18, and PM20, and is structured almost in the same manner as the circuit of FIG. 14. The differences are as follows: PM31 and R19 are connected in series for charging C1, vdiv2 is generated by the voltage dividing circuit structured by R11, R12, R13, R20, and R21, the bias potential 21' generated by the circuit of FIG. 22 is provided to the tail current source NM12 of the comparison circuit, and Vref2 generated by the circuit of FIG. 22 is compared with the divided voltage vdiv1.

EN and ENX shown in FIG. 22 are control signals for stopping the circuit. When EN is L, and ENX is H, the circuit stops. When EN is H, and ENX is L, the circuit operates normally. This state is described below.

In the illustrated exemplary embodiment, it is assumed that the minimum operating voltage of the circuit of FIG. 21 is 1.3 V, the minimum operating voltage of the circuit of FIG. 22 is 1.7 V, the reference voltages Vref1 and Vref2 are 1.2 V, the voltage at which the circuit of FIG. 23 is discharged from a reset state is 2.4 V, and a ratio of voltage dividing resistors R20, R21, and R11 of the circuit of FIG. 23 is R20:R21:R11=4:1:5.

The resistors R20, R21, and R11 operate as a voltage dividing circuit that divides the power supply voltage Vdd and generates vdiv1. When NM18 is ON, the potential of vdiv1 is vdiv1=(R11) Vdd/(R20+R21+R11)=Vdd/2=0.5Vdd. The power supply potential at which the divided voltage vdiv1 becomes 1.2 V is 2.4 V. A determination can be made of whether the power supply voltage is greater than the predetermined voltage (2.4 V) by comparing the voltage vdiv1 with the reference voltage 1.2 V (Vref2).

The signal RST is used for the above purpose. The RST being H indicates the power supply voltage being less than the predetermined voltage. The resistor R12 and NM18 gives a hysteresis characteristic to the circuit for preventing the output RST from oscillating in the neighborhood of the detected voltage.

If the minimum operating voltage of the circuit of FIG. 23 is 1.7 V, for example, when the power supply voltage is less than 1.7 V, the bias potential 21' and the reference voltage Vref2 may become nonconstant. To avoid the above problem and make RSTX fixable to L, the portion including Vref1 vdiv2, NM30 through NM36, and PM32 through PM37 is added to the circuit as shown in the bottom half of FIG. 23. The portion Vref1, vdiv2, NM30 through NM36, and PM32 through PM37 shown in the bottom half of FIG. 23 operates as a comparator. Because the comparator operates in almost the same manner as the comparator circuit shown in FIG. 14, its description is omitted. A description is given about how RSTX is fixed to L at a power supply voltage lower than the lowest operating voltage 1.7 V of the circuit of FIG. 22.

The second comparator consisting of NM30 through NM36, and PM32 through PM37 compares the reference voltage output Vref1 of the circuit shown in FIG. 21 with the divided voltage vdiv2. If the divided voltage vdiv2 is less than Vref1, the second comparator circuit turns on NM36, and if the divided voltage vidiv 2 is greater than Vref1, the second comparator circuit turns off NM36. RSTX is fixed to L by turning on NM36.

When NM18 is ON, the potential of vdiv2=(R21+R11) Vdd/(R20+R21+R11)=(1+5)Vdd/(4+1+5)=(6)Vdd/(10) =3Vdd/5=0.6Vdd. The power supply potential at which the divided potential vdiv2 becomes 1.2 V is 2 V. When the power supply voltage is less than 2 V, RSTX is turned to L by comparing the divided potential vdiv2 and the reference voltage 1.2 V (Vref1) and further turning on NM36. According to the above arrangements, even if the circuit of FIG. 22 does not operate, RSTX is turned to L without fail.

Figure 24:
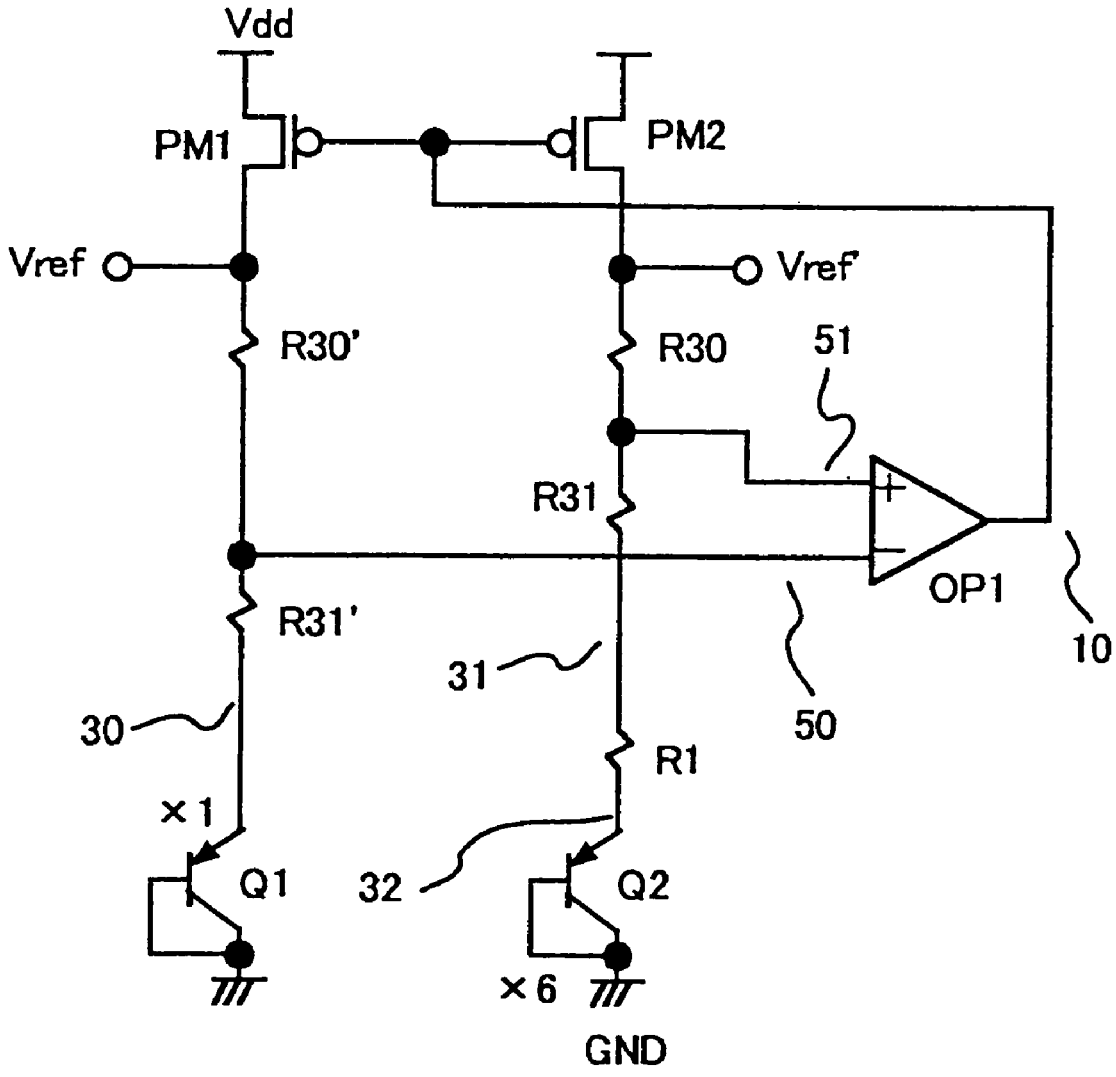
FIG. 24 is a circuit diagram showing a bandgap circuit including an operational amplifier according to an embodiment.

FIG. 24 is a circuit diagram showing a bandgap circuit in which an operational amplifier (op-amp) is used according to an embodiment of the present invention.

In FIG. 24, Q1 and Q2 indicate pnp bipolar transistors. R1, R30, R30', R31, and R31' indicate resistors. Vref and Vref' indicate output reference potentials. Vdd indicates a positive power supply voltage. GND indicates a GND terminal. PM1 and PM2 indicate PMOS transistors. Numeral 10 indicates the bias potential of a PMOS transistor (op-amp output). Numerals 30, 31, 32, 50, and 51 indicate internal nodes. OP1 indicates the op-amp. In FIG. 24, components having the same functions as those of the circuit shown in FIG. 4 and corresponding nodes are referred to by the same reference numerals.

The operation of the circuit shown in FIG. 24 is described below.

In the illustrated exemplary embodiment, an assumption is made that, for example, the W/L ratio (W: gate width L: gate length) of PM1 and that of PM2 are equal, and the junction area ratio of Q1 and Q2 is 1:6. It is also assumed that the resistance of R30 and that of R30' are equal, and the resistance of R31 and that of R31' are equal.

If the base-emitter voltage of the bipolar transistor, or the forward voltage of the pn junction, is expressed by Vbe, the above formula (1) expresses the relation between the forward voltage of the pn junction of a bipolar transistor and absolute temperature T as described above in the related art section.

In addition, it is known that the emitter current I of a bipolar transistor is related to the voltage Vbe thereof as by the above formula (2).

Because PM1 and PM2 of the circuit shown in FIG. 24 share the same gate electrode in common, currents of the same quantity flow to PM1, PM2, Q1, Q2, R1, R30, R30', R31, and R31'. The negative feedback of OP1 makes the potential of the node 50 and that of the node 51 substantially equal, and causes the circuit to operate stably.

Since the resistance of R30 and that of R30' are equal to each other, and the resistance of R31 and that of R31' are equal to each other, the voltage drop by R30 and that of R30' are equal, and the voltage drop by R31 and that of R31' are equal.

As shown in the formula (2), because the emitter current of a bipolar transistor is exponential to the forward voltage Vbe thereof, a change in current by one order of magnitude is caused only by a change in voltage by 60 mV. Therefore, when currents of the same amount flow in Q1 and Q2, the potential of the node 30 varies little even if the currents change. On the other hand, since the potential at the node 31 is the sum of the voltage drop by the resistor R1 and the forward voltage of Q2, if the current is increased, the potential at the node 31 is increased substantially proportional to the current. As a result, if a great current flows, the potential at the node 31 increases higher than the potential of the node 30, and if a little current flows, the potential at the node 31 is reduced lower than the potential at the node 30.

Because the voltage drop of R31 is equal to that of R31', the potential of the node 50 is related to that of the node 51 in the same manner in which the potential of the node 30 is related to that of the node 31. If a great current flows, the potential of the node 51 becomes higher than that of the node 50, and if a little current flows, the potential of the node 51 becomes lower than that of the node 50.

Because the potential of the node 50 and the potential of the node 51 are input to OP1, when a great current flows and the potential of the node 51 is higher than that of the node 50, the output potential 10 of the op-amp becomes high, and as a result, the currents of PM1 and PM2 are reduced. When the current is little, and the potential of the node 51 is lower than that of the node 50, the output potential 10 of the op-amp is reduced, and the currents of PM1 and PM2 increase. As a result, the potential of the node 51 and that of the node 50 become substantially equal to each other, and the circuit becomes stable.

Because the potential of the node 51 and that of the node 50 are equal, and the current of PM1 and that of PM2 are equal, the potential of the node 30 and that of the node 31 becomes equal. That is, the resistors R31' and R31 function as a level shift circuit that increases the potential of the node 30 and the node 31 to a positive direction.

Since the junction area ratio of Q1 and Q2 is 1:6, the potential difference VR1 of both ends of the resistor R1 is expressed by the above formula (3). Because the potential difference between both ends of the resistor R1 is expressed by the above formula (3), the current Ip that flows through PM1 and PM2 is expressed by the above formula (4). Because this current flows to the resistor R30 and R31, the voltage drop VR3031 by the resistor R30 and R31 is expressed by the following formula (11).

$$VR3031=(R3031/R1)(kT/q)\ln(6) \quad (11)$$

where R3031 is the combined resistance of the resistors R30 and R31 connected in series. The sum of the voltage drop VR3031 caused by the resistors R30 and R31 and Vbe becomes the reference voltage Vref. As temperature rises, the forward voltage Vbe of the pn junction is reduced (negative temperature dependency) as expressed by the formula (1), and the voltage drop VR3031 of the resistors R30 and R31 increases proportional to the temperature (positive temperature dependency) as expressed by the formula (11). It is possible to design the circuit by determining parameters appropriately so that the reference voltage Vref does not depend on temperature. In this case, Vref becomes about 1.2 V corresponding to the bandgap voltage of silicon.

Since Vref and Vref' of the circuit shown in FIG. 24 become equal to each other, either one may be used as the reference potential.

In the case of the conventional circuit shown in FIG. 4, the potential of the node 30 and the potential of the node 31 are input to the op-amp OP1. However, the circuit of FIG. 24 is different from the conventional circuit of FIG. 4 in that the potentials 50 and 51 that are obtained by shifting the potentials 30 and 31 to the positive direction using the resistors R31' and R31, respectively, are input to the op-amp OP1.

In the illustrated exemplary embodiment, an assumption is made that Vbe is 0.6 V, and Vth is 0.8 V. Even if the potentials 30 and 31, which are 0.6 V, are input to the gate electrodes of the NMOS transistors, the circuit does not operate. It is further assumed in the exemplary embodiment that the voltage drop of the resistors R31' and R31 caused by currents flowing therein is 0.3 V. As a result, the potentials 50 and 51 become a potential higher than the potentials 30 and 31 by 0.3 V, which is 0.9 V. If the threshold voltage Vth of the NMOS transistor is 0.8 V, the potential can be input to the gate electrode of the NMOS transistor.

In this case, the potentials 30 and 31 become 0.6 V, the potentials 50 and 51 become 0.9 V, and the potentials Vref and Vref' become 1.2 V, for example. The potentials Vref and Vref', which are 1.2 V, do not depend on temperature, but the potentials 50 and 51 change as temperature changes. Since the potential 50 (51) is between the potential 30 (31) having negative temperature dependency and the potential Vref (Vref') having no temperature dependency, the potential 50 (51) has negative temperature dependency. The temperature dependency of the potential 50 (51) is less than the temperature dependency of the potential 30 (31). Taking the temperature dependency into account, the circuit designer is required to determine the potential 50 (51) so that the op-amp OP1 operates within the operating temperature range.

Figure 40:
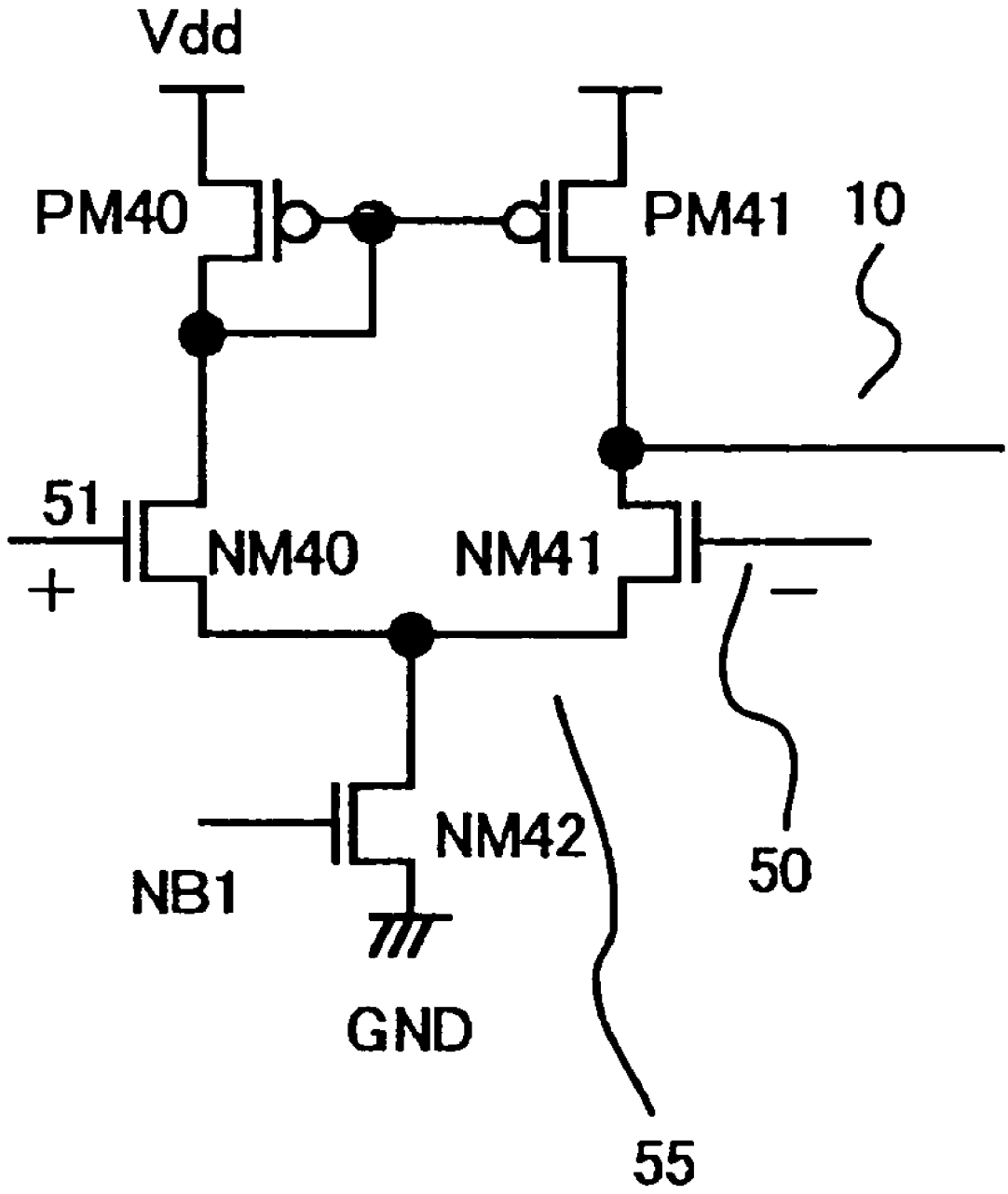
FIG. 40 is a circuit diagram showing a general operational amplifier to be used for the circuits according to an embodiment.

A circuit shown in FIG. 40, for example, can be used as the op-amp OP1. In FIG. 40, Vdd indicates a positive power supply voltage. GND indicates a GND terminal. PM40 and PM41 indicate PMOS transistors. NM40, NM41, and NM42 indicate NMOS transistors. Numerals 50 and 51 indicate the inputs of the op-amp. Numeral 10 indicates the output of the op-amp. Numeral 55 indicates an internal node. Elements corresponding to those shown in FIG. 24 are referred to by the same numerals. A "+" mark is shown in FIG. 40 for indicating the forward input 51 of the op-amp, and a "−" mark is shown in FIG. 40 for indicating the inverting input 50 of the op-amp. If the potential of the input 51 is higher than the potential of the input 50, the potential of the output 10 increases. If the potential of the input 51 is lower than the potential of the input 50, the potential of the output 10 is reduced.

If the potentials 50 and 51 shown in FIG. 24 are input to the NMOS transistor differential circuit as shown in FIG. 40, the circuit becomes operable even if 0.9 V is provided to 50 and 51. The threshold voltage Vth of the NMOS transistor is assumed to be 0.8 V, for example. Since the potential of the node 55 can be set at about 0.1 V, NM42 can operate as a current source, and the circuit functions as a differential circuit.

As described above, the circuit shown in FIG. 24 generates a current proportional to absolute temperature by controlling the potential 30 and the potential 31 and generating a reference voltage that does not depend on temperature. The circuit shown in FIG. 24 is indifferent in this aspect from the conventional circuit shown in FIG. 1. However, the circuit shown in FIG. 24 is different from the conventional circuit shown in FIG. 1 in that, whereas the conventional circuit uses the node 31 corresponding to the emitter 30 of the pnp bipolar transistor as the direct input of the op-amp, the circuit shown in FIG. 24 uses a potential increased by the resistors R31' and R31 as the input of op-amp, and as a result, the circuit shown in FIG. 24 can operate at a relatively lower power supply voltage. FIG. 24 is a circuit diagram for explaining the basic concept of the circuit, and the details of the circuit are omitted. A more detailed circuit diagram is shown in FIG. 25.

Figure 25:
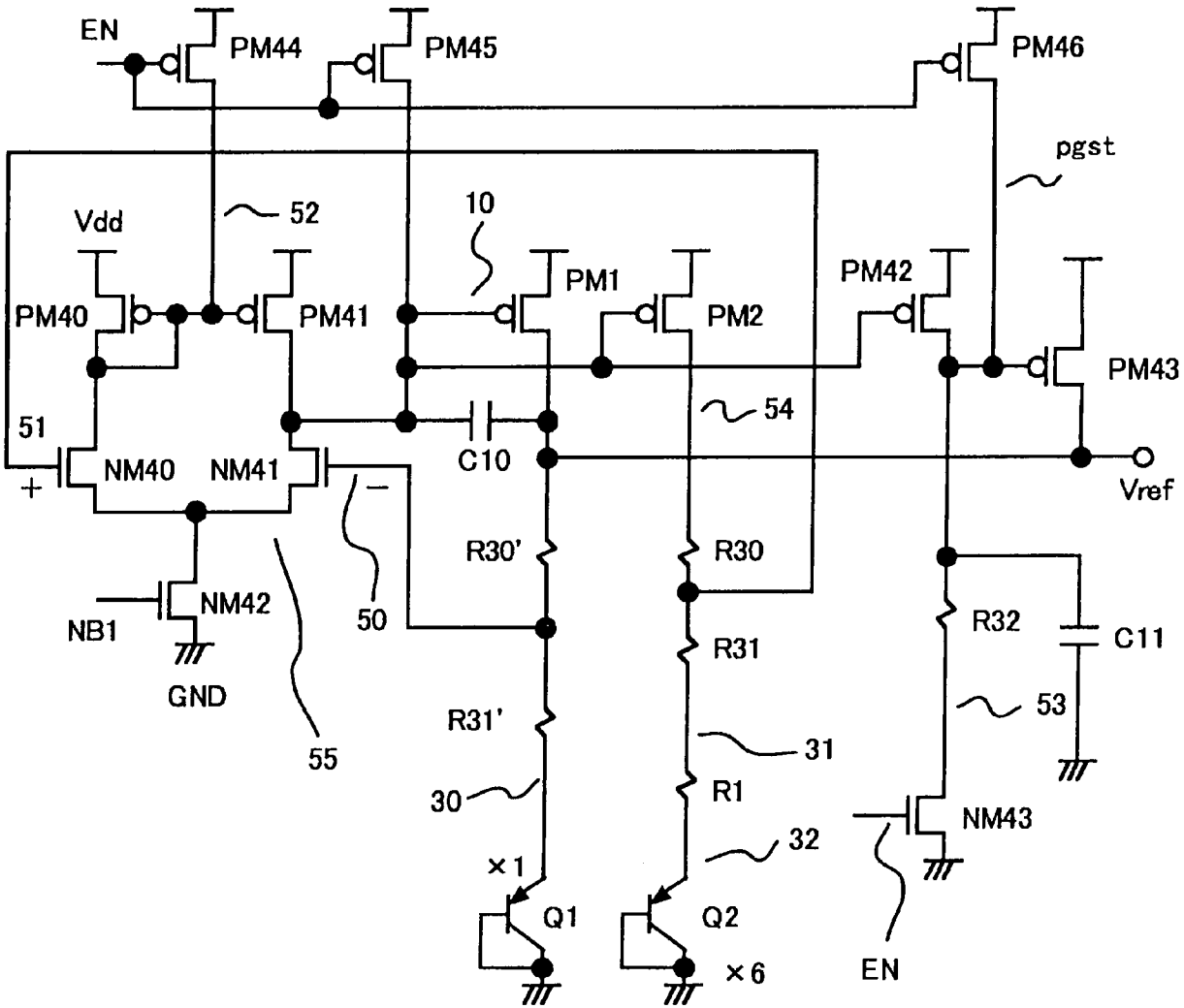
FIG. 25 is a circuit diagram showing the detail of the bandgap circuit shown in FIG. 24.

In FIG. 25, Q1 and Q2 indicate pnp bipolar transistors. R1, R30, R30', R31, R31' and R32 indicate resistors. C10 and C11 indicate capacitors. Vref indicates an output reference potential. Vdd indicates a positive power supply voltage. GND indicates a GND terminal. PM1, PM2, PM40, and PM46 indicate PMOS transistors. NM40, NM41, NM42, and NM43 indicate NMOS transistors. Numeral 10 indicates an op-amp output. Numerals 30, 31, 32, 50, 51, 52, 53, 54, 55, and pgst indicate internal nodes. EN indicates a control signal. NB1 indicates the bias potential of the NMOS transistor. Components having the same functions as those shown in FIGS. 23, 24, and 40, and corresponding nodes are referred to by the same reference numerals. Numeral 54 of FIG. 25 corresponds to Vref' of FIG. 24.

The basic concept of the circuit shown in FIG. 25 has been described with reference to FIG. 24. Further details with reference to FIG. 24 and FIG. 25 are described below.

When the control signal EN shown in FIG. 25 is H, the circuit operates normally. When the control signal EN is L, the circuit stops.

A description is given on the operation of the circuit during a time period in which the control signal EN is H.

PM42, PM43, R32, C11, and NM43 function as a starting-up circuit. When a current does not flow in PM1 and PM2, the potential at 50 and 51 is turned to GND, and an op-amp consisting of PM40, PM41, NM40, NM41, and NM42 does not operate. If a starting-up circuit is not provided, the circuit shown in FIG. 25 can not be activated. To avoid this problem, a starting-up circuit is needed.

When no current flows in PM1 and PM2, no current flows in PM42 that shares the gate electrode 10. Since EN is at a H level, the potential of pgst is turned to GND, and a current flows in PM43. Since a current flows in PM43, the potential of Vref rises as does the potential of 50. Because the potential of the node 50 is turned to GND, and the potential of the node 50 rises, the potential of the node 10 starts falling, and currents flow in PM1 and PM2. When the currents flow in PM1 and Pm2, the op-amp starts functioning, and makes the potential of the node 50 and the potential of the node 51 equal thereby to stabilize the circuit.

When the circuit reaches a stable state, a current flows to PM42, and the potential of pgst is turned to Vdd. As a result, the starting-up circuit is separated from the other portion of the circuit. After the circuit reaches a stable state, R32 limits the current that flows in PM42, and makes the potential of pgst Vdd. C11 is provided to adjust the time constant of the node pgst. C10 functions as a general phase compensation capacitor.

Figure 26:
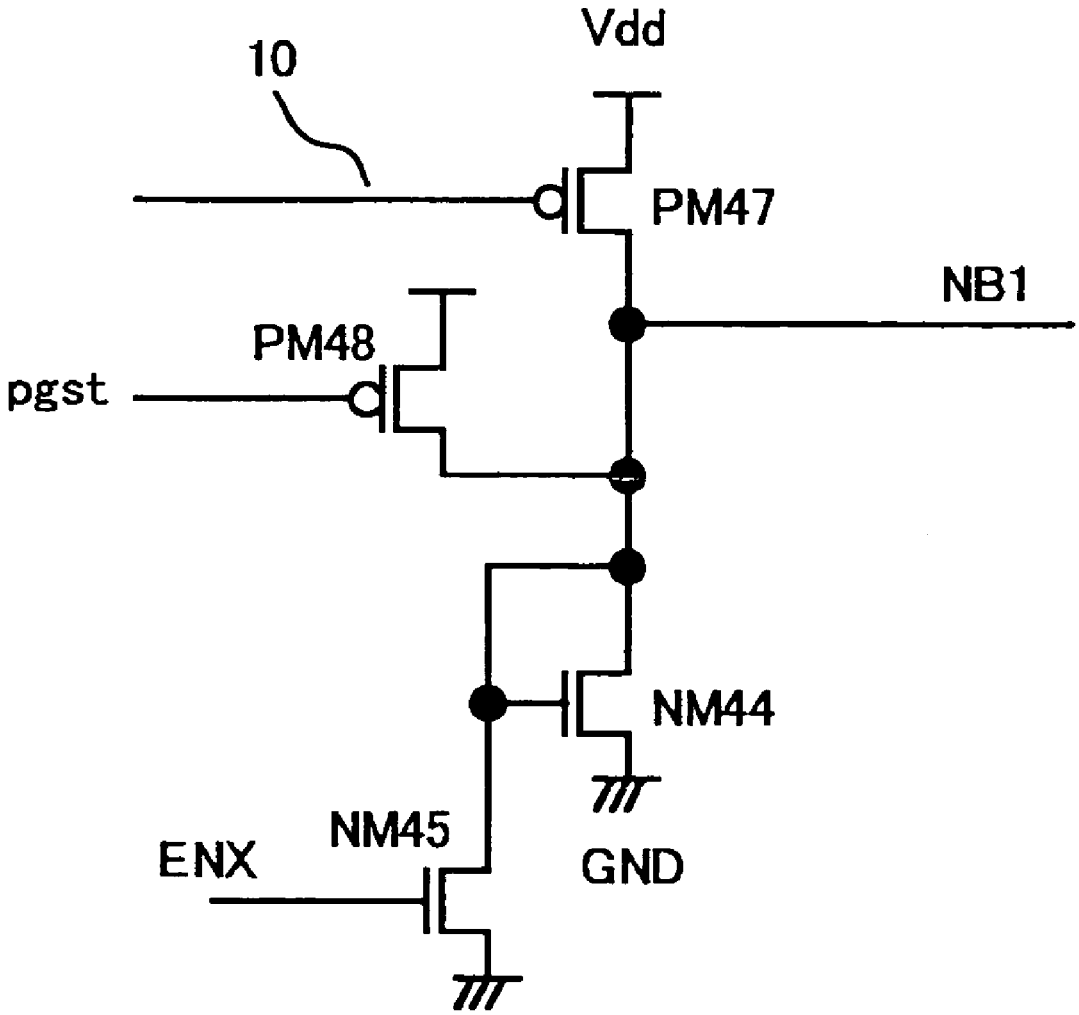
FIG. 26 is a circuit diagram showing a circuit for generating a bias current of the tail current source of an operational amplifier according to an embodiment.

FIG. 26 is a circuit diagram showing a circuit for generating a bias potential NB1 of a tail current source NM42 of the op-amp.

In FIG. 26, Vdd indicates a positive power supply voltage. GND indicates a GND terminal. PM47 and PM48 indicate PMOS transistors. NM44 and NM45 indicate NMOS transistors. Numeral 10 indicates the bias potential of a PMOS transistor (op-amp output). "pgst" indicates an internal node. ENX indicates a control signal. NB1 indicates the bias potential of a NMOS transistor. Elements and nodes corresponding to those of FIG. 25 are referred to by the same reference numerals.

When the control signal ENX is at a L level, the circuit operates normally, and when the control signal ENX is at a H level, the circuit stops. The operation of the circuit during a time period in which the control signal ENX is at a L level is described below.

As described above with reference to FIG. 25, when the circuit is activated, the node "pgst" is at a GND level. As a result, a current flows in PM48, and NM44 generates NB1. The node NB1 is maintained at a certain potential, and the circuit is set at a state in which a current is provided to the op-amp. When the circuit reaches a stable state, the potential of the node "pgst" is turned to Vdd, which turns off PM48. On the other hand, when the circuit of FIG. 25 reaches a stable state, the potential of the op-amp output 10 becomes a potential at which currents flow in PM1 and PM2. As a result, a current flows to PM47, and the node NB1 shown in FIG. 25 is turned to a certain potential. A simple circuit shown in FIG. 26 can generate the bias potential NB1 of the NMOS transistor.

As discussed above, the conventional circuit shown in FIG. 4 uses the potential at the nodes 30 and 31 as the input of the op-amp. However, the circuits shown in FIGS. 24, 25, and 26 use a potential obtained by increasing the potential of the nodes 30 and 31 by the resistors R31' and R31 as the input of the op-amp. As a result, the op-amp can be made of a NMOS differential circuit that can operate at a low operating voltage.

Figure 27:
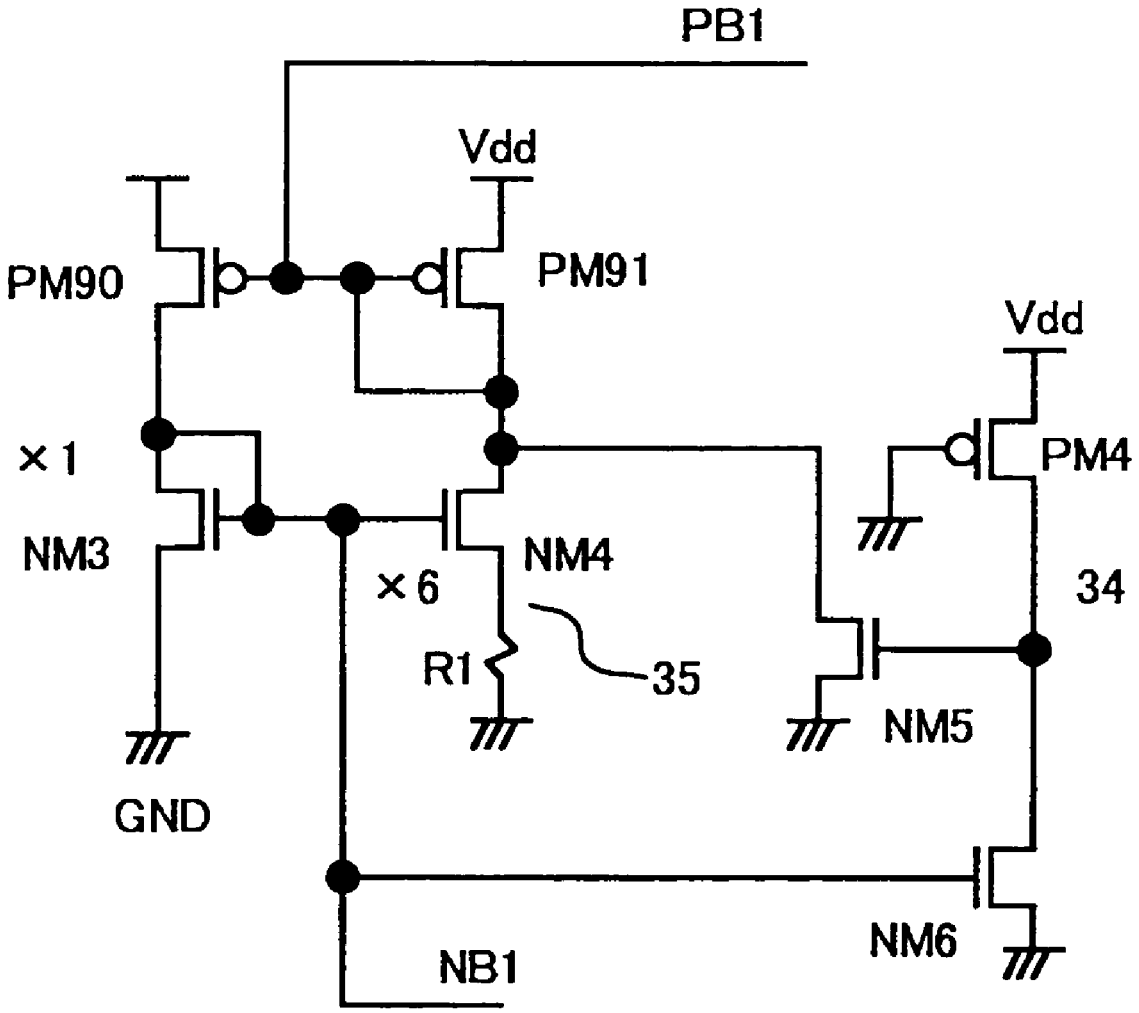
FIG. 27 is a circuit diagram showing a circuit for generating a bias current of the tail current source of an operational amplifier according to another embodiment.

A circuit for generating the bias potential NB1 of the tail current source NM42 of the op-amp is shown in FIG. 27.

In FIG. 27, R1 indicates a resistor. Vdd indicates a positive power supply voltage. GND indicates a GND terminal. PM90, PM91, and PM4 indicate PMOS transistors. NM3 and NM6 indicate NMOS transistors. NB1 indicates the bias potential of the NMOS transistors. PB1 indicates the bias potential of the PMOS transistors. Numerals 34 and 35 indicate internal nodes. Elements having the same functions as those of the conventional circuit shown in FIG. 3 and corresponding nodes are referred to by the same reference numerals. To make the drawing simple, elements for stopping the circuit are not shown in FIG. 27.

The circuit of FIG. 27 is the same as the conventional circuit shown in FIG. 3. The conventional circuit shown in FIG. 3 can generate the bias potential NB1 of the NMOS transistors and the bias potential PB1 of the PMOS transistors. The circuit shown in FIG. 27 can generate the bias potential NB1, and provide the generated bias potential NB1 to the circuit shown in FIG. 25. The bias potential NB1 can be generated by various circuits (the circuit shown in FIG. 7, for example) other than the circuit shown in FIG. 27.

Figure 28:
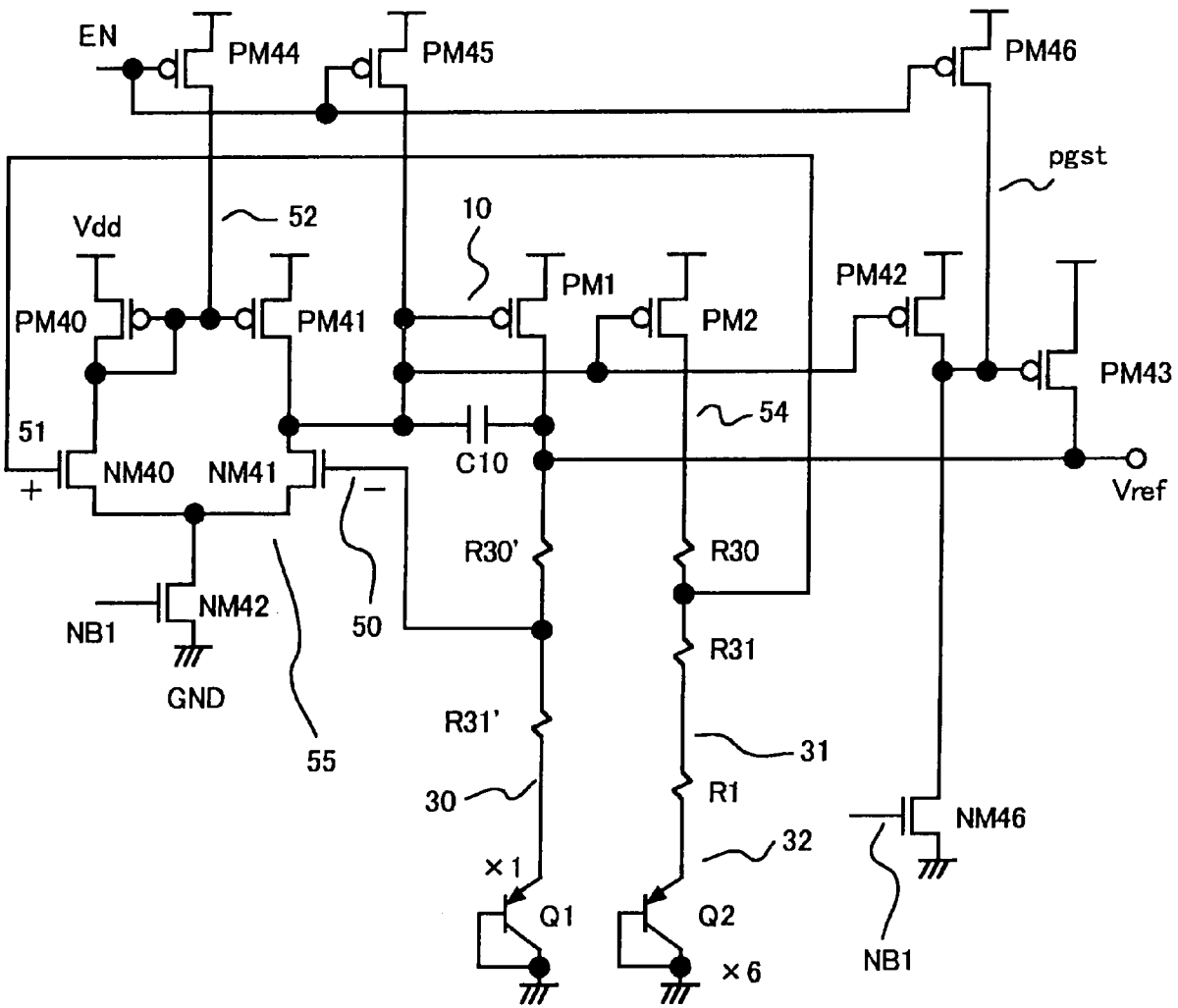
FIG. 28 is a circuit diagram showing a starting-up circuit of different structure from the starting-up circuit shown in FIG. 25.

FIG. 28 is a circuit diagram showing a starting-up circuit, the structure of which is different form the starting-up circuit shown in FIG. 25, according to another embodiment.

In FIG. 28, Q1 and Q2 indicate pnp bipolar transistors. R1, R30, R30', R31, and R31' indicate resistors. C10 indicates a capacitor. Vref indicates an output reference potential. Vdd indicates a positive power supply voltage. GND indicates a GND terminal. PM1, PM2, PM40, and PM46 indicate PMOS transistors. NM40, NM41, NM42, and NM46 indicate NMOS transistors. Numeral 10 indicates an op-amp output. 30, 31, 32, 50, 51, 52, 54, 55, and "pgst" show internal nodes. EN indicates a control signal. NB1 indicates the bias potential of the NMOS transistors. Elements having the same functions as the circuits shown in FIGS. 23, 24, and 25, and corresponding nodes are referred to by the same reference numerals.

The circuit of FIG. 28 is identical to the circuit of FIG. 25 except for the starting-up circuit. A description is given below of the structure of the starting-up circuit.

The operation during a time period in which the control signal EN is at a H level is described below. It is assumed that NB1 of the circuit shown in FIG. 28 is provided by the circuit of FIG. 27.

In FIG. 28, when a current does not flow to PM1 and PM2, a current does not flow to PM42 that shares the gate electrode 10. NB1 is applied to NM46, and a current flows through NM46. Accordingly, the potential of the node "pgst" is turned to a GND level, and a current flows through PM43. When a current flows to PM43, the potential of Vref rises, and the potential of the node "50" also rises. The potential of 51 is at a GND level, and the potential of 50 rises. Accordingly, the potential of 10 begins to decrease, and currents begin to flow through PM1 and PM2. When the currents flow through PM1 and PM2, the op-amp functions. Accordingly, the potential of the node 50 and the potential of the node 51 become equal, and the circuit becomes stable.

When the circuit reaches the stable state, a current flows to PM42, and the potential of "pgst" is turned to Vdd. As a result, the starting-up circuit is separated from the other portion of the circuit. If the circuit is designed so that the current that flows through NM46 becomes greater than the current that flows through PM42, the potential of "pgst" can be turned to Vdd.

As shown in FIG. 28, the starting-up circuit can be modified without departing from the scope of the present invention.

Figure 29:
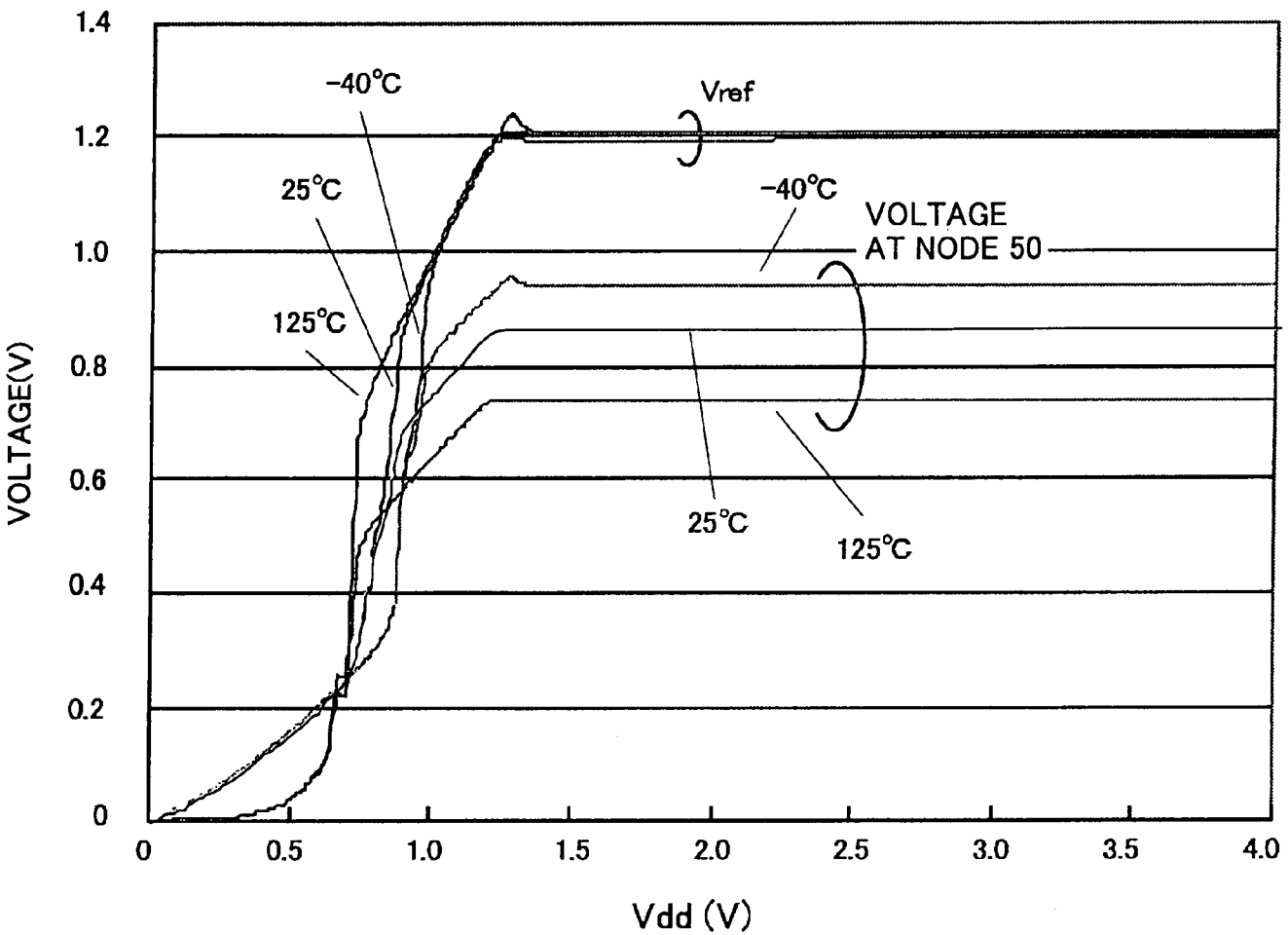
FIG. 29 is a graph of a reference voltage of the starting-up circuit shown in FIG. 28 as a function of a power supply voltage.

FIG. 29 is a graph showing the reference voltage Vref, as a function of the power supply voltage Vdd, of the circuit shown in FIG. 28. FIG. 29 shows the cases in which temperature is −40 degrees Celsius, 25 degrees Celsius, and 125 degrees Celsius. The drawing shows that a constant reference voltage Vref is provided even if the power supply voltage Vdd and temperature changes.

As described above, the potential of the node 50 fluctuates as temperature changes, and decreases as temperature rises. However, the temperature dependency of the node 50 is less than that of the node 30 and 31. As explained above, a circuit designer needs to take this temperature dependency into account, and determine the potentials of the nodes 50 and 51 so that the op-amp can operate within the operating temperature range. Since the reference voltage Vref is about 1.2 V, the power supply needs to be about 1.2 V or more. FIG. 29 shows that the circuit operates at a power supply voltage more than about 1.2 V.

Figure 30:
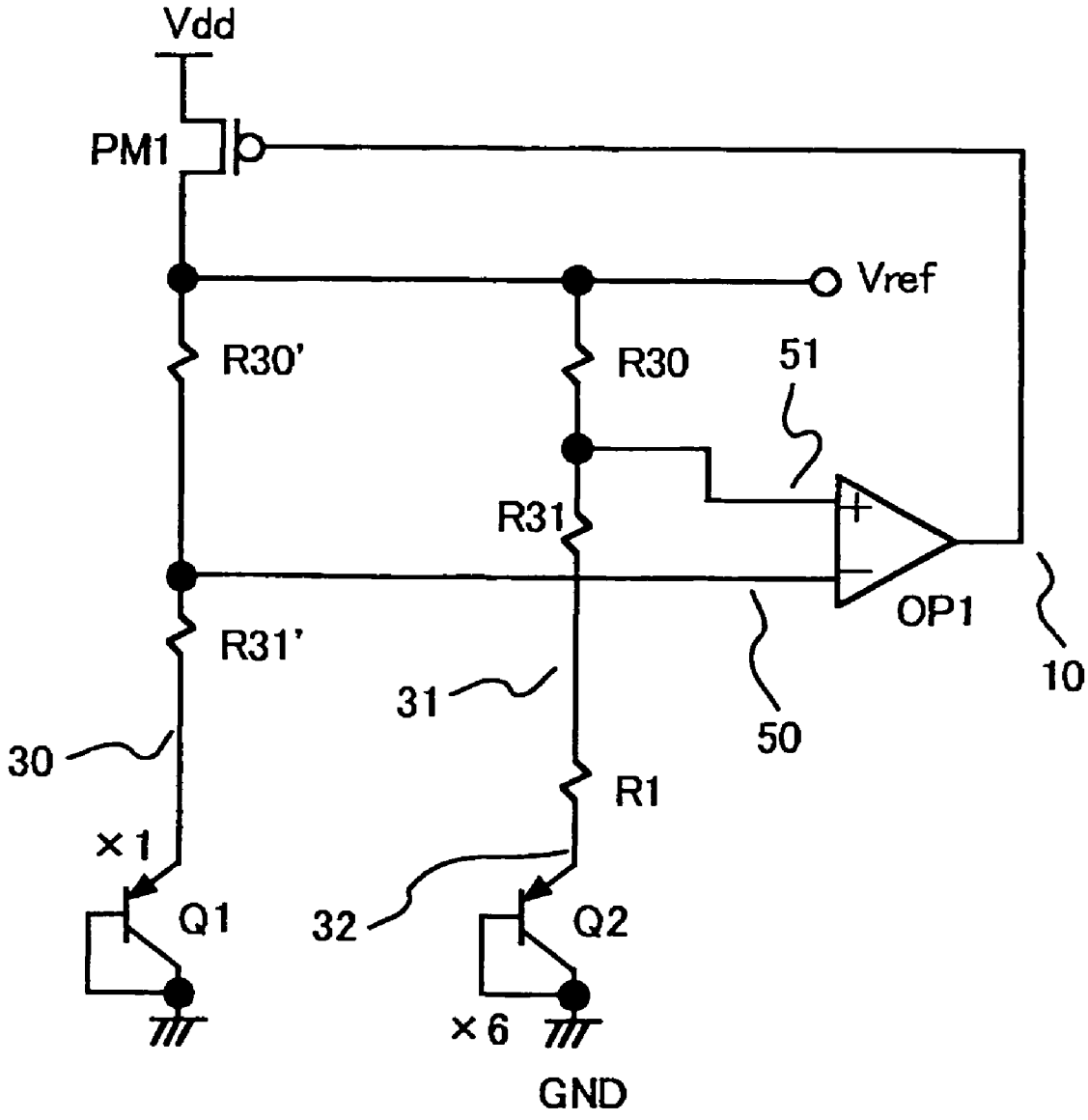
FIG. 30 is a circuit diagram showing a bandgap circuit including an operational amplifier according to another embodiment.

FIG. 30 is a circuit diagram showing a bandgap circuit using an op-amp according to another embodiment of the present invention.

In FIG. 30, Q1 and Q2 indicate pnp bipolar transistors. R1, R30, R30', R31, R31' indicate resistors. Vref indicates an output reference potential. Vdd indicates a positive power supply voltage. GND indicates a GND terminal. PM1 indicates a PMOS transistor. Numeral 10 indicates the bias potential of the PMOS transistor (op-amp output). Numerals 30, 31, 32, 50, and 51 indicate internal nodes. OP1 indicates an op-amp. Elements having the same functions as those shown in FIG. 24 and corresponding nodes are referred to by the same reference numerals.

A difference of the circuit of FIG. 30 and the circuit of FIG. 24 is explained below.

In the case of the circuit shown in FIG. 24, PM1 and PM2 are separately provided, and currents flow through Vref and Vref'. The potential of Vref and the potential of Vref' ideally become equal in the final stable state. Accordingly, these two nodes may be combined into one. FIG. 30 shows a circuit according to an embodiment in which Vref and Vref' are the same node.

Figure 31:
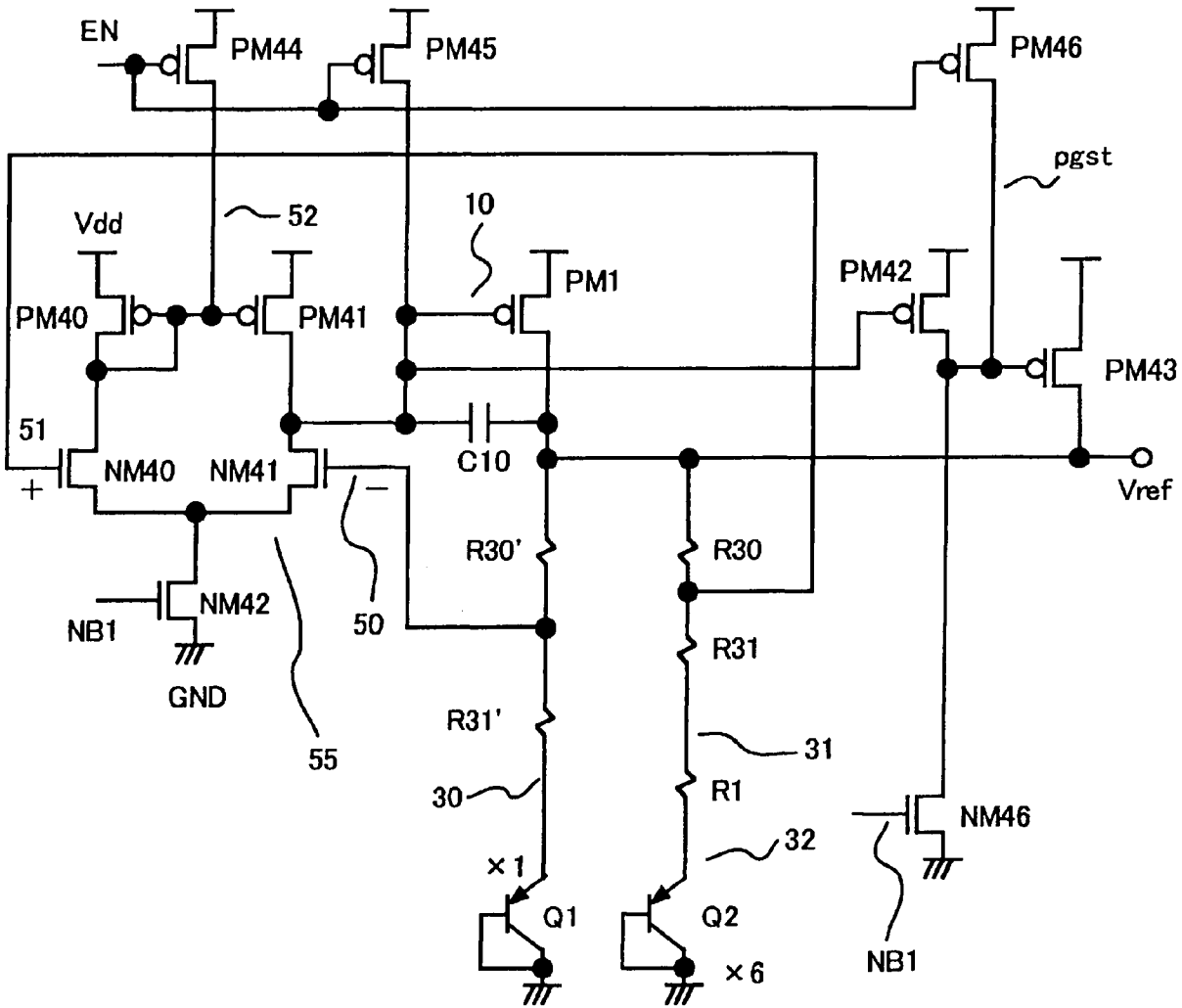
FIG. 31 is a circuit diagram showing the specific structure of the circuit shown in FIG. 30.

FIG. 31 is a circuit diagram showing a more detailed structure of the circuit shown in FIG. 30.

In FIG. 31, Q1 and Q2 indicate pnp bipolar transistors. R1, R30, R30', R31, and R31' indicate resistors. C10 indicates a capacitor. Vref indicates an output reference potential. Vdd indicates a positive power supply voltage. GND indicates a GND terminal. PM1, PM2, and PM40 through PM46 indicate PMOS transistors. NM40, NM41, NM42, and NM46 indicate NMOS transistors. A numeral 10 indicates an op-amp output. Numerals 30, 31, 32, 50, 51, 52, 55, and "pgst" show internal nodes. EN indicates a control signal. NB1 indicates the bias potential of the NMOS transistors. In FIG. 30, elements having the same functions as those shown in FIG. 25 are referred to by the same reference numerals.

As shown in FIGS. 30 and 31, the circuit according to an embodiment shown in FIG. 24 can be modified.

Figure 32:
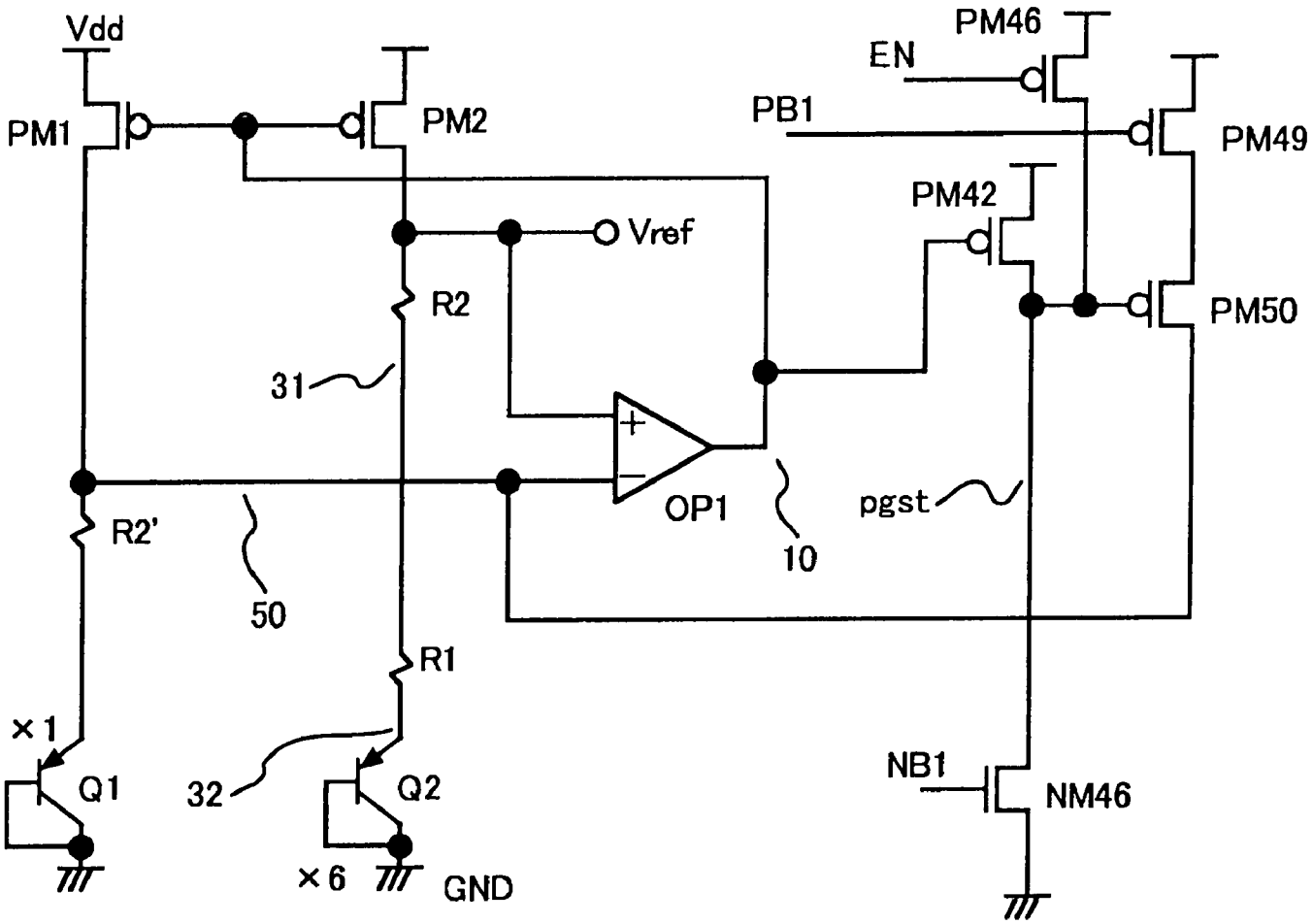
FIG. 32 is a circuit diagram showing a bandgap circuit including an operational amplifier according to another embodiment.

FIG. 32 is a circuit diagram showing a bandgap circuit according to another embodiment of the present invention.

In FIG. 32, Q1 and Q2 indicate pnp bipolar transistors. R1, R2, and R2' indicate resistors. Vref indicates an output reference potential. Vdd indicates a positive power supply voltage. GND indicates a GND terminal. PM1, PM2, PM42, PM46, PM49, and PM50 indicate PMOS transistors. NM46 indicates a NMOS transistor. Numeral 10 indicates the bias potential of the PMOS transistors (op-amp output). NB1 indicates the bias potential of the NMOS transistor. PB1 indicates the bias potential of the PMOS transistor. Numerals 31, 32, and 50, and "pgst" indicate internal nodes. OP1 indicates an op-amp. EN indicates a control signal. Elements having the same functions as those shown in FIGS. 24 and 25, and corresponding nodes are referred to by the same reference numerals.

The differences between the circuit of FIG. 32 and the circuit of FIG. 24 are explained below.

In the case of the circuit of FIG. 24 described above, R30, R30', R31, and R31' are provided separately for generating a potential that does not depend on temperature, and for generating potentials 50 and 51 lower than the potential that does not depend on temperature, which potentials 50 and 51 are input to the op-amp. Since the op-amp is structured by a NMOS differential circuit, the input potential of the op-amp does not need to be higher than the input potential of the circuit shown in FIG. 24. Therefore, the circuit of FIG. 32 inputs the potentials of Vref and the node 50 to the op-amp OP 1. In addition, the resistances of R2 and R2' are adjusted so that the the circuit can generate the bandgap voltage Vref (assuming that the resistance R2 and the resistance R2' are equal to each other).

The current flowing in PM1 is equal to the current flowing in PM2, and OP1 maintains Vref at the same potential as the node 50. Since the resistance R2 and the resistance R2' are equal to each other, the emitter potential of Q1 and the potential of the node 31 become equal to each other. The circuit shown in FIG. 32 functions as a bandgap circuit in the same manner as does the conventional circuit.

FIG. 32 is a circuit diagram showing another variation of the starting-up circuit according to an embodiment of the present invention.

In FIG. 32, PM42, PM46, PM49, PM50, and NM46 constitute a starting-up circuit. In the exemplary illustrated embodiment, it is assumed that the potentials of NB1 and PB1 are provided by the circuit of FIG. 27. When a current does not flow in PM1 and PM2, Vref and the potential of the node 50 become a GND level. Because the op-amp using a NMOS differential circuit at the input stage does not function, the circuit cannot be activated without a starting-up circuit. A starting-up circuit is provided to avoid this problem.

When current does not flow in PM1 and PM2, no current flows to PM42, the gate electrode of which is common to the node 10. Because NB1 is added to NM46, and causes a current to flow in NM46, the potential of "pgst" becomes GND. Because the potential of "pgst" becomes GND, PM50 is turned to ON, and a current flows in PM49. When currents flow to PM49 and PM50, the potential of the node 50 rises. Since the potential of Vref becomes GND, and the potential of the node 50 rises, the potential of the node 10 begins to decrease, and currents begin to flow through PM1 and PM2. When currents flow in PM1 and PM2, the op-amp begins functioning, and the potential of the node Vref and the potential of the node 50 become equal. Therefore, the circuit becomes stable.

When the circuit reaches a stable state as described above, a current flows to PM42. Because the potential of the node "pgst" becomes Vdd, the starting-up circuit is separated from the other part of the circuit. If the circuit is designed so that the current flowing through PM42 is greater than the current flowing through NM46, the potential of the node "pgst" can be Vdd.

The bias potential PB1 of PM49 is generated by the circuit of FIG. 27. The starting-up current can be controlled using this bias potential PB1 of PM49. According to the above arrangements, the circuit can be started stably. For example, if the starting-up current is too great, the potential of the node 50 becomes close to Vdd. The potential of Vref becomes a value close to Vdd. In this state, because PM1 and PM2 do not function as a current source, the feed-back function may not function normally. If the starting-up current is controlled by the bias potential PB1 accurately, such anomaly in a starting-up period can be prevented.

As described above, a circuit in which the input potential of the op-amp is greater than the potential of the circuit shown in FIG. 24, as shown in FIG. 32.

Figure 33:
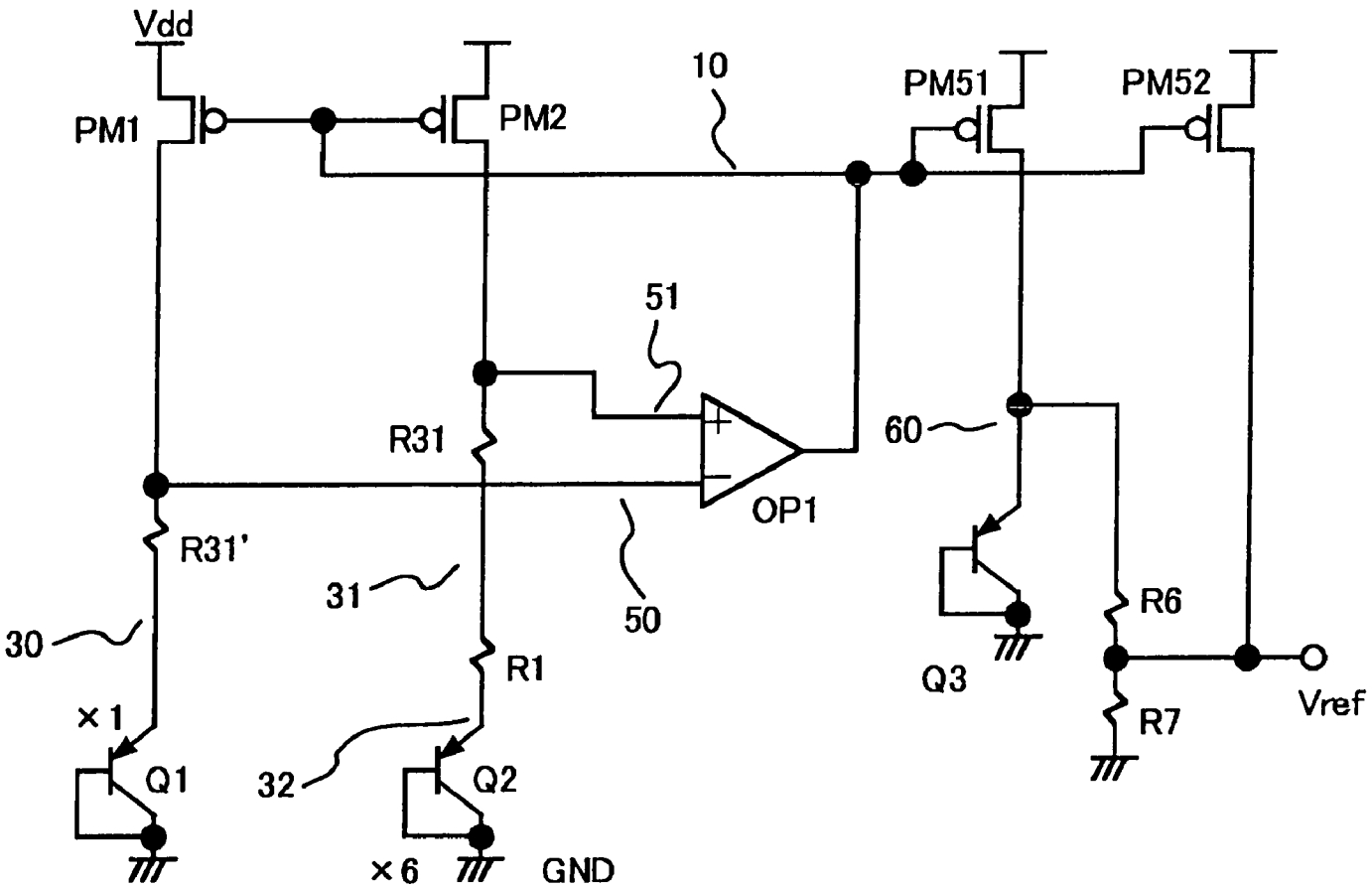
FIG. 33 is a circuit diagram showing a bandgap circuit including an operational amplifier according to yet another embodiment.

FIG. 33 is a circuit diagram showing a bandgap circuit using an op-amp according to another embodiment of the present invention.

In FIG. 33, Q1, Q2, and Q3 indicate pnp bipolar transistors. R1, R31, R31', R6, and R7 indicate resistors. Vref indicates an output reference potential. Vdd indicates a positive power supply. GND indicates a GND terminal. PM1, PM2, PM51, and PM52 indicate PMOS transistors. Numeral 10 indicates the bias potential of the PMOS transistor (op-amp output). Numerals 30, 31, 32, 50, 51, and 60 indicate internal nodes. OP1 indicates an op-amp. Elements having the same functions as those in FIGS. 24 and 8 and corresponding nodes are referred by the same reference numerals. Elements for controlling the circuit, a starting-up circuit, and elements for phase compensation are not shown in FIG. 33. However, those skilled in the art will recognize that the above elements and the starting-up circuit can be added to the circuit shown in FIG. 33 in the same manner as set forth herein.

The circuit shown in FIG. 33 is a bandgap circuit with an op-amp according to an embodiment of the present invention, to which the configuration of circuit for generating an arbitrary voltage is applied in the same manner as the circuit of FIG. 8.

The op-amp OP1 is provided with potentials 50 and 51 obtained by level shifting the potentials of 30 and 31 using the resistors R31' and R31 in the positive direction in the same manner as the circuit shown in FIG. 24. Additionally, the op-amp has the NMOS differential circuit as the input stage. According to the above arrangements, the circuit can operate at a low power supply voltage. Because currents proportional to absolute temperature (PTAT current) flow in PM1 and PM2, the circuit reaches a stable state.

OP1 may be a general op-amp as described above with reference to FIG. 40, for example. If the circuit is configured as shown in FIG. 34 (to be described below), the range of power supply voltage in which the circuit can operate can be extended.

As described above with reference to FIG. 8, PM51 causes a current to flow through Q3, and generates Vbe (the potential of the pn junction in the forward direction) at the node 60. Vbe is divided by the resistors R6 and R7. A potential having a positive temperature dependency is added to the divided potential by PM52. As a result, a reference voltage of 0.9 V, for example, can be generated.

Figure 34:
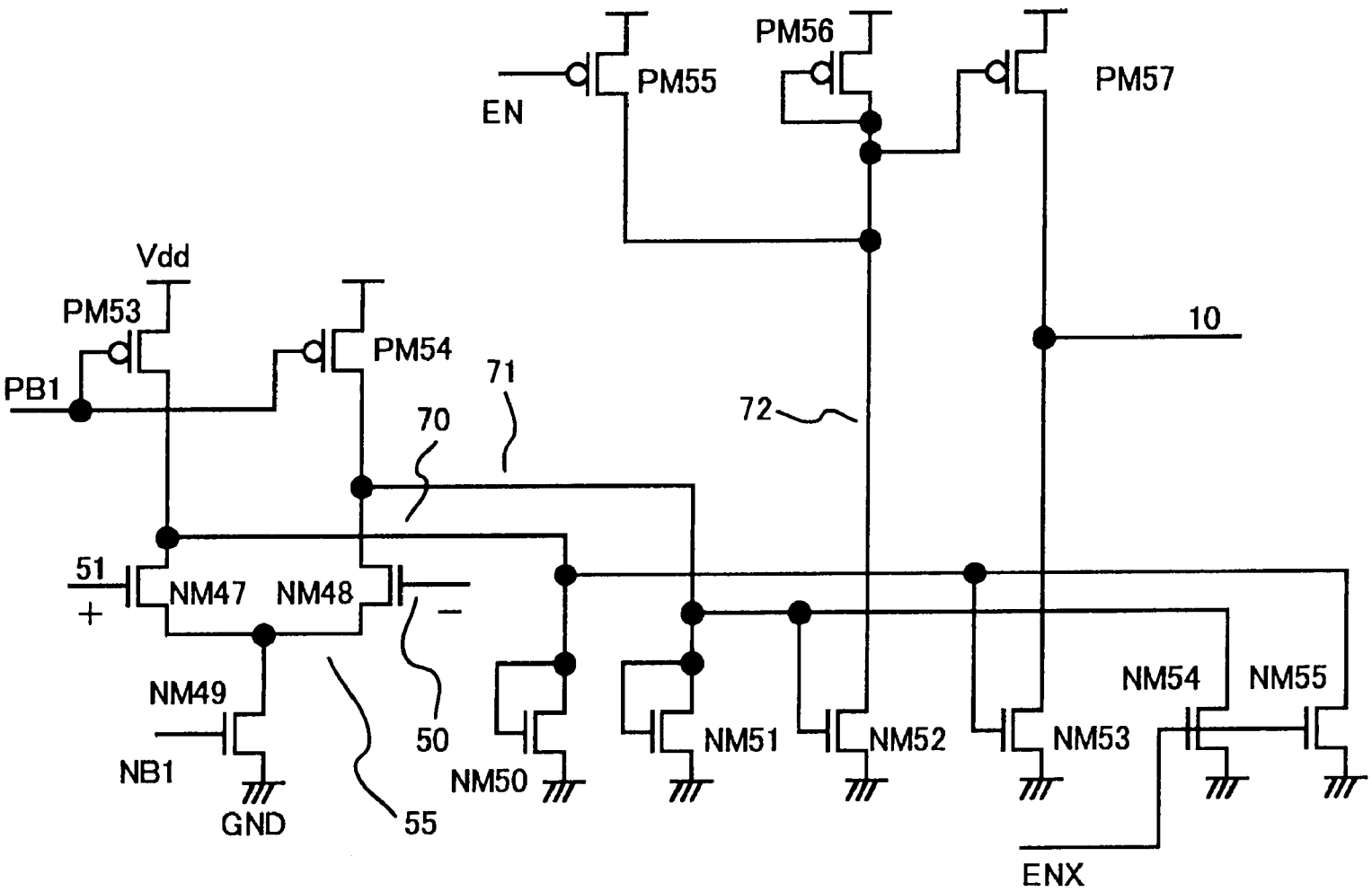
FIG. 34 is a circuit diagram showing an operational amplifier according to an embodiment.

FIG. 34 is a circuit diagram showing an op-amp according to an embodiment of the present invention.

In FIG. 34, Vdd indicates a positive power supply. GND indicates a GND terminal. PM53–PM57 indicate PMOS transistors. NM47–NM55 indicate NMOS transistors. Numeral 10 indicates a bias potential of the PMOS transistor (op-amp output). NB1 indicates a bias potential of the NMOS transistor. PB1 indicates a bias potential of the PMOS transistor. 50, 51, 55, and 70–72 indicate internal nodes. EN, ENX indicate a control signal. Elements having the same functions as those shown in FIGS. 33 and 40, for example, and corresponding nodes are referred to by the same reference numerals.

If EN is at a H level, and ENX is at a L level, the circuit operates normally.

The features of the circuit of FIG. 34 are described below. In the illustrated exemplary embodiment, it is assumed that the potentials of NB1 and PB1 are provided by the circuit of FIG. 27.

PM40 of the general op-amp shown in FIG. 40 is connected as a diode. When the threshold voltage of the PMOS transistor is low, the circuit of FIG. 40 can be employed without causing any problem. When the threshold voltage of the PMOS transistor is great, however, the following problem may occur.

For example, it is assumed that the potentials of 50 and 51 are about 0.9 V, and the power supply voltage Vdd is also around 0.9 V. In the case of the circuit shown in FIG. 40, the potential of the node 55 becomes lower than that of the potential of the node 50 and 51 by the threshold voltage of the NMOS transistor. If the gate potential of PM40 is less than Vdd by the threshold voltage of the PMOS transistor, a current flows through PM40. As a result, in the circumstances in which the potentials of 50 and 51 are close to the power supply voltage, the potential difference between the drain and the source of NM40 shown in FIG. 40 almost vanishes. Under such a circumstance, the gain of the op-amp shown in FIG. 40 becomes low, and enough feedback is not available.

Ideally speaking, in the case where the circuit of FIG. 33 is designed, for example, so that the potentials of 50 and 51 are around 0.9 V, and Vref is 0.9 V, if the power supply voltage is more than 0.9 V, the circuit of FIG. 33 can output a stable reference voltage. However, if the gain of the op-amp OP1 shown in FIG. 33 becomes low as a result of the above problem in the operating point, the accuracy of the reference potential becomes difficult to achieve.

In order to solve this problem, the circuit of FIG. 34 uses PM53 and PM54 as fixed current sources, and is configured so that the drain potential of the differential circuit NM47 and NM48 becomes about Vdd. Fixed currents are provided from PM53 and PM54 to the nodes 70 and 71, respectively (the current of PM53 and the current of PM54 are assumed to be equal). The differential current between the current of PM53 and the current of NM47 flows through NM50, and the differential current between the current of PM54 and the current of NM48 flows through NM51. In the case of a general folded cascode circuit, a PMOS transistor is generally provided between the node 70, 71, and NM50, NM51, respectively. However, in the case of the circuit shown in FIG. 33, the potentials at the nodes 50 and 51 are known to be about 0.9 V in advance. Accordingly, in the case of the circuit shown in FIG. 34, the potentials of the nodes 70 and 71 becomes about the threshold voltage of the NMOS transistor, and the relation between the drain potential and the gate potential of NM47 and NM48 can be set in the saturation region.

The differential currents are converted into voltage by NM50 and NM51, and are amplified by NM52, NM53, PM56, and PM57 thereby to obtain a potential at the node 10. The polarity of signals is briefly explained below. If a potential at the node 51 is high, the current of NM50 decreases, and the potential of the node 70 is reduced. Since more current flows in NM51, the potential of 71 becomes high. The potential of 70 is reduced, and as a result, less current flows in NM53. Because the potential 71 increases, the current of NM52 increases, and the currents of PM56 and PM57 also increase. The current of NM53 is reduced, and the current of PM57 increases. As a result, the potential 10 becomes H.

Figure 35:
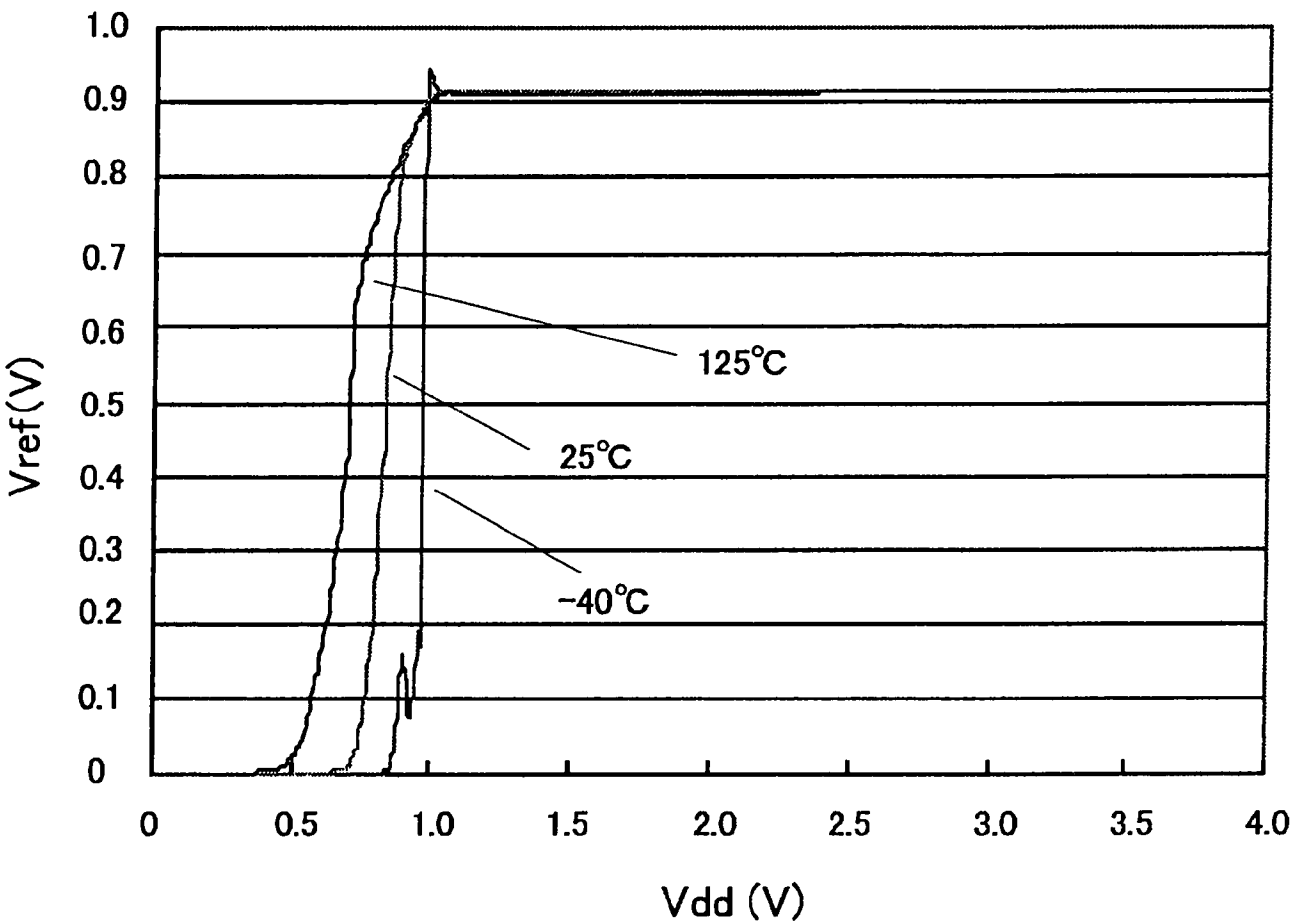
FIG. 35 is a graph showing reference voltages of the circuit shown in FIG. 33 and the circuit shown in FIG. 34 as functions of a power supply voltage.

FIG. 35 is a line graph showing the reference voltage Vref as a function of the power supply voltage Vdd of the circuits shown in FIGS. 33 and 34. FIG. 35 shows the cases of temperature of −40 degrees Celsius, 25 degrees Celsius, and 125 degrees Celsius.

FIG. 35 shows that a constant reference voltage Vref can be obtained irrespective of the power supply voltage Vdd and temperature. Parameters are determined so as to make the reference voltage Vref 0.9 V. If the circuits shown in FIGS. 33 and 34 are used, and the reference voltage Vref is made 0.9 V, the circuit can operate at a power supply voltage of 0.9 V at lowest. The characteristics shown in FIG. 35 indicate that the circuit starts operating from a power supply voltage of about 0.9 V.

Figure 39:
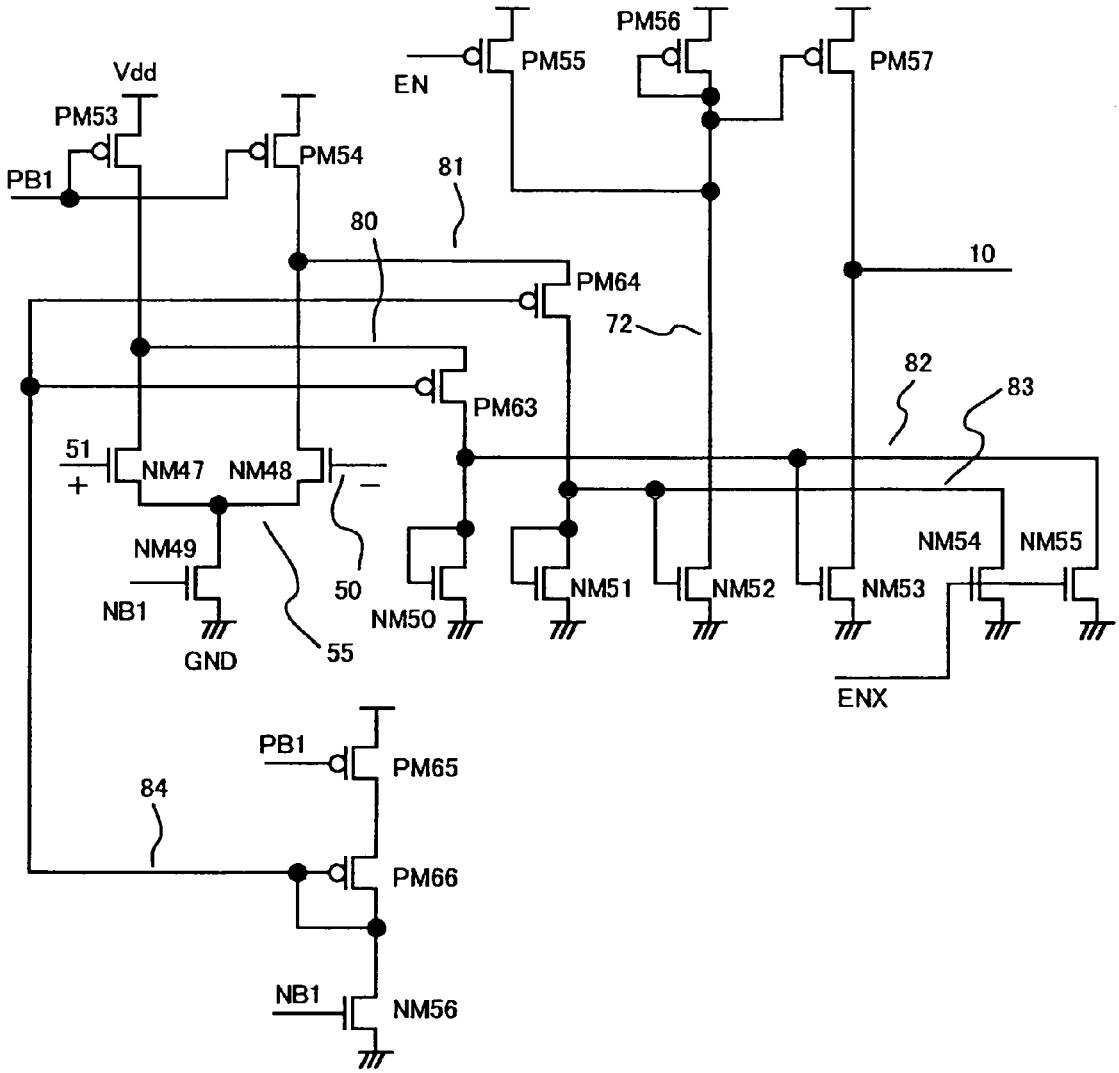
FIG. 39 is a circuit diagram showing an operational amplifier according to another embodiment.

In addition to the op-amp circuit of FIG. 34, an op-amp circuit of FIG. 39, for example, can be used in the circuit of FIG. 33.

In FIG. 39, Vdd indicates a positive power supply. GND indicates a GND terminal. PM53–PM57, PM63–PM66 indicate PMOS transistors. NM47–NM56 indicates NMOS transistors. Numeral 10 indicate the bias potential of the PMOS transistor (op-amp output). NB1 indicates the bias potential of the NMOS transistor. PB1 indicates the bias potential of the PMOS transistor. 50, 51, 55, 72, and 80–84 indicate internal nodes. EN and ENX indicate control signals. Elements having the same functions as those shown in FIGS. 40 and 34, for example, and corresponding nodes are referred to by the same reference numerals.

The circuit of FIG. 39 operates almost in the same manner as the circuit of FIG. 34. Therefore, only the differences from the circuit of FIG. 34 are described below. In the case of the circuit of FIG. 34, the drain electrodes of NM50 and NM51 are directly connected to the drain electrodes of NM47 and NM48, respectively, since the potentials of 50 and 51 are known to become about 0.9 V in advance. If the potentials of 50 and 51 become higher than 0.9 V, and the reduction in the drain-source voltage of NM47 and NM48 matter, the circuit can be configured as shown in FIG. 39.

As shown in FIG. 39, PM63 is provided between the drain of NM50 and the drain of NM47, and PM64 is provided between the drain of NM51 and the drain of NM48. According to the above arrangements, the potential of the node 82 and the potential of the node 80 can be made different, and the potential of the node 83 and the potential of the node 81 can be made different. The potentials of the nodes 82 and 83 are about the threshold voltage since NM50 and NM51 are diode connected. However, the potentials of the nodes 80 and 81 can be made higher than the potential of the node 84 by about the threshold voltage of the PMOS transistor.

FIG. 39 shows a case in which PM65 and NM56 cause a fixed current to flow to PM66, and generate the potential of the node 84. The potential of the node 84 becomes lower than Vdd by about the threshold voltage of the PMOS transistor. As a result, the potentials of the nodes 80 and 81 become close to Vdd. The potentials of the nodes 80 and 81 can be made close to Vdd by providing PM63 and PM64. Even if the potentials of the nodes 50 and 51 become high, NM47 and NM48 do not operate in a linear region. As a result, the input voltage range in which the gain of the op-amp is high can be extended.

As described above, if the potentials of the nodes 50 and 51 can be made higher, the circuit shown in FIG. 39 may be used for configuring a bandgap circuit. The advantage of the op-amp circuit shown in FIG. 39 has been described using the reference voltage circuit shown in FIG. 33 as an example. Of course, the circuit shown in FIG. 39 can be used for the circuit according to an embodiment of the present invention using another op-amp.

Figure 36:
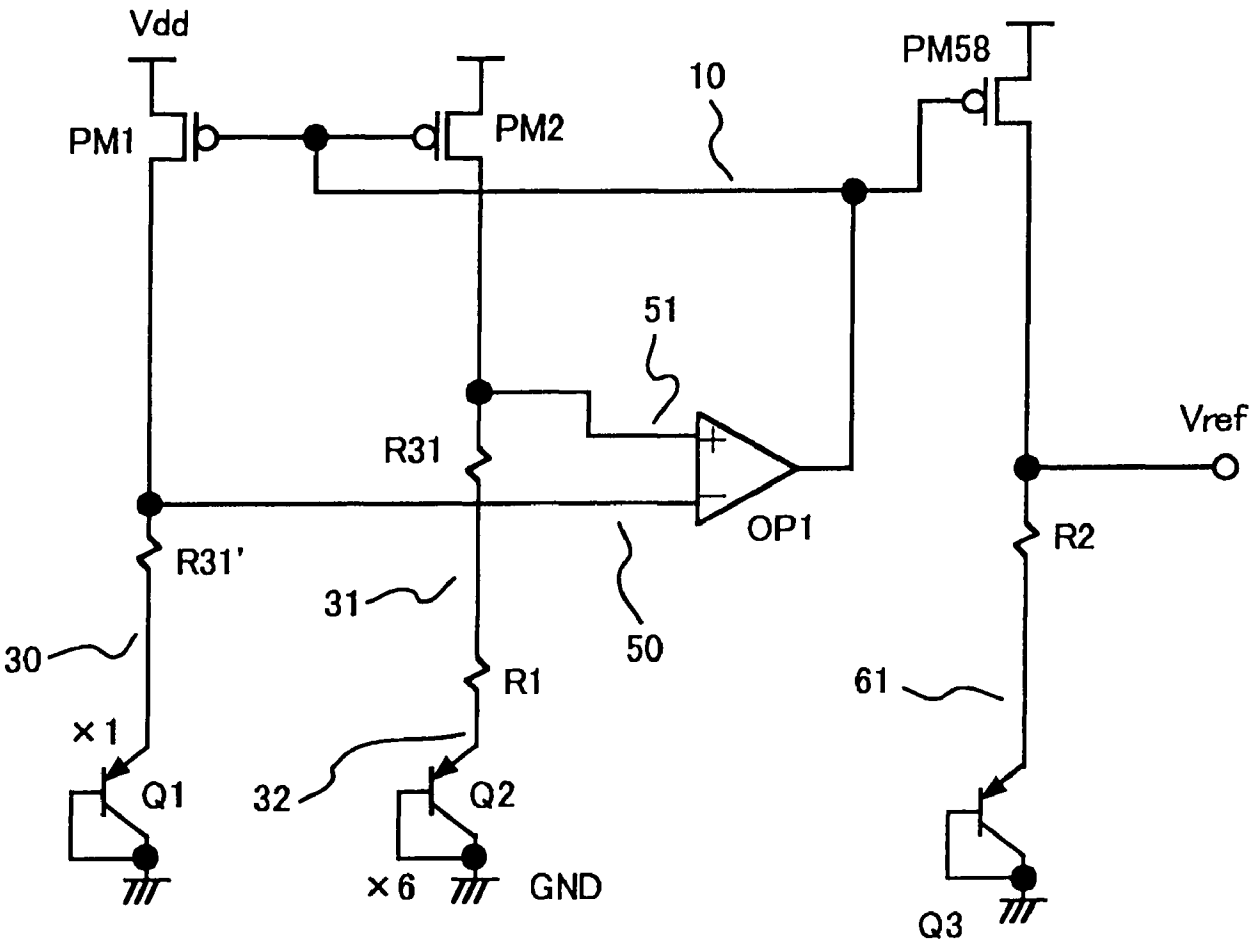
FIG. 36 is a circuit diagram showing a bandgap circuit including an operational amplifier according to yet another embodiment.

FIG. 36 is a circuit diagram showing a bandgap circuit using an op-amp according to another embodiment of the present invention.

In FIG. 36, Q1, Q2, and Q3 indicate pnp bipolar transistors. R1, R31, R31', R2 indicate resistors. Vref indicates an output reference potential. Vdd indicates a positive power supply. GND indicates a GND terminal. PM1, PM2, and PM58 indicate PMOS transistors. Numeral 10 indicates the bias potential of a PMOS transistor (op-amp output). Numerals 30, 31, 32, 50, 51, and 61 indicate internal nodes. OP1 indicates an op-amp. Elements having the same functions as those of the circuits shown in FIGS. 24 and 33, for example, and corresponding nodes are referred to by the same reference numerals. Elements related to control, a starting-up circuit, and phase compensation elements are not shown, but it will be appreciated from the above description that the circuit can be configured in the same manner.

FIG. 33 shows an exemplary circuit in which the configuration for generating an arbitrary reference voltage is applied, in the same manner as the circuit shown in FIG. 8, to a bandgap circuit using an op-amp according to an embodiment of the present invention. If only a potential of about 1.2 V is required to be output, the circuit can be configured as shown in FIG. 36.

If the circuit is configured as shown in FIG. 36, the resistors R31 and R31' for level shifting the potentials of the nodes 50 and 51 down to about 0.9 V are required, but the resistors R30 and R30' are not required. The bandgap voltage is generated by adding the PTAT voltage to the emitter potential 61 of Q3 by R2. If the size of R2 is smaller than R30 and R30' shown in FIG. 24, the circuit shown in FIG. 36 is advantageous area-wise.

Figure 37:
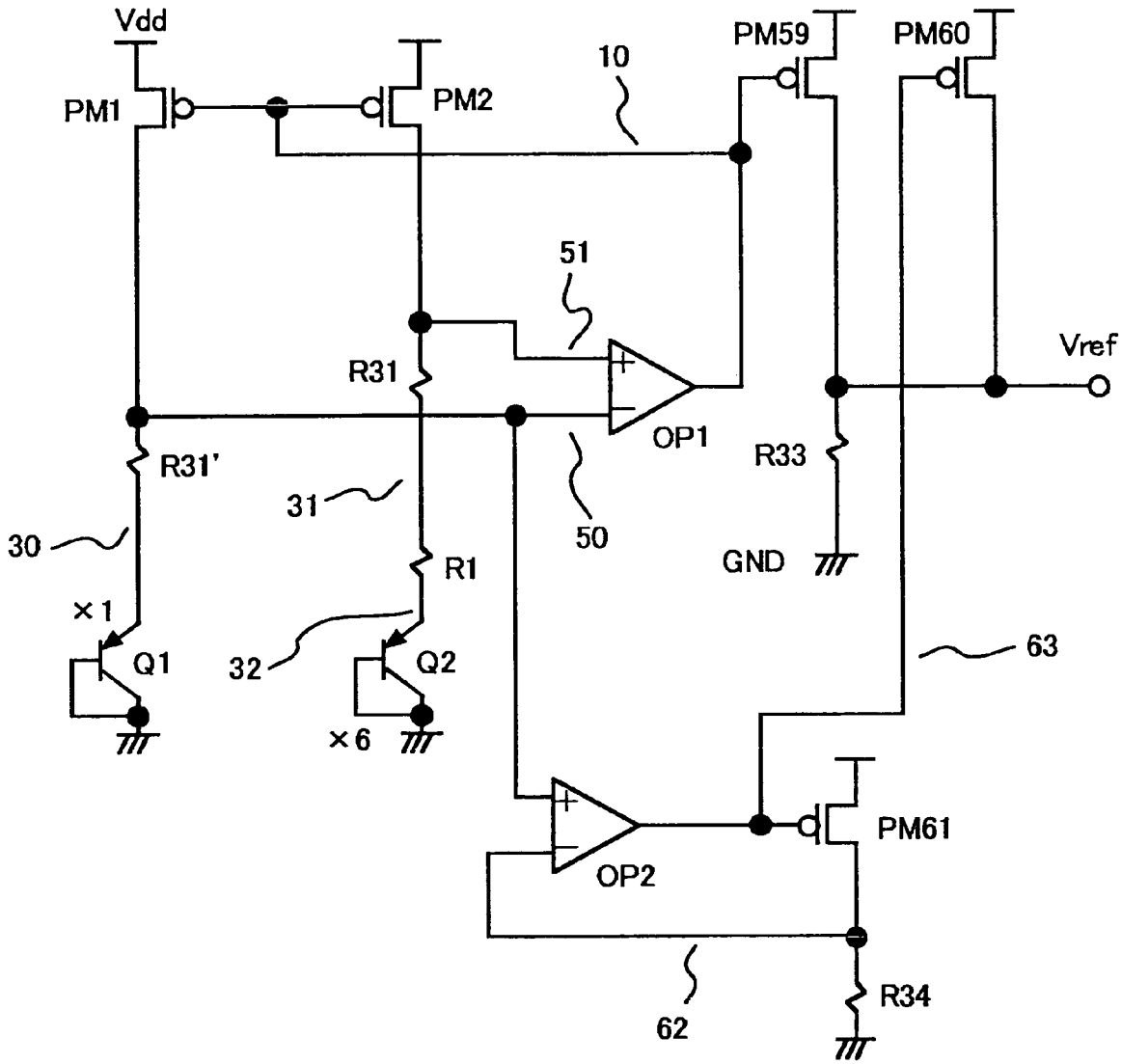
FIG. 37 is a circuit diagram showing a bandgap circuit including an operational amplifier according to yet another embodiment.

FIG. 37 is a circuit diagram showing a bandgap circuit using an op-amp according to another embodiment of the present invention.

In FIG. 37, Q1 and Q2 indicate pnp bipolar transistors. R1, R31, R31', R33, and R34 indicate resistors. Vref indicates an output reference potential. Vdd indicates a positive power supply. GND indicates a GND terminal. PM1, PM2, PM59, PM60, and PM61 indicate PMOS transistors. Numerals 10 and 63 indicate the bias potential of PMOS transistor (op-amp output). Numerals 30, 31, 32, 50, 51, and 62 indicate internal nodes. OP1 and OP2 indicate op-amps. Elements having the same functions as those shown in FIGS. 24 and 36, for example, and corresponding nodes are referred to by the same reference numerals. Elements related to control, a starting-up circuit, and phase compensation elements are not shown to make the circuit diagram easy to understand.

In the previous description with reference up to FIG. 36, methods of generating a bandgap voltage in which the PTAT voltage is directly added to the Vbe of the pnp bipolar transistor or a potential obtained by dividing the Vbe of the pnp bipolar transistor have been described. However, the bandgap voltage can be generated by adding a voltage that cancels the temperature dependency of the PTAT voltage. A circuit configuration as shown in FIG. 37 can be used as well.

From the above description, those skilled in the art will easily understand that the gate potential 10 of PM1 and PM2 is controlled by OP1 so as to make the potentials of the nodes 50 and 51 become equal, and that the PTAT current is caused to flow through PM1, PM2, and PM59. As will be appreciated, the potentials of the nodes 50 and 51 have negative temperature dependency as shown in FIG. 29. For example, a current having a negative temperature dependency can be generated using the potential at the node 50.

The gate potential of PM61 is negatively fed back by OP2 so as to make the potential 50 equal to the potential 62. A current having a negative temperature dependency starts flowing through PM61. If this current is appropriately scaled so as to cancel the positive temperature dependency of the PTAT current of PM59, and is added by PM60, the total current can be made independent of temperature. If the total current of PM59 and PM60 is converted into voltage by the resistor R33, a reference voltage Vref that does not depend on temperature can be generated.

If the circuit is configured as shown in FIG. 37, the bias current that has an arbitrary temperature dependency is obtainable simultaneously.

Figure 38:
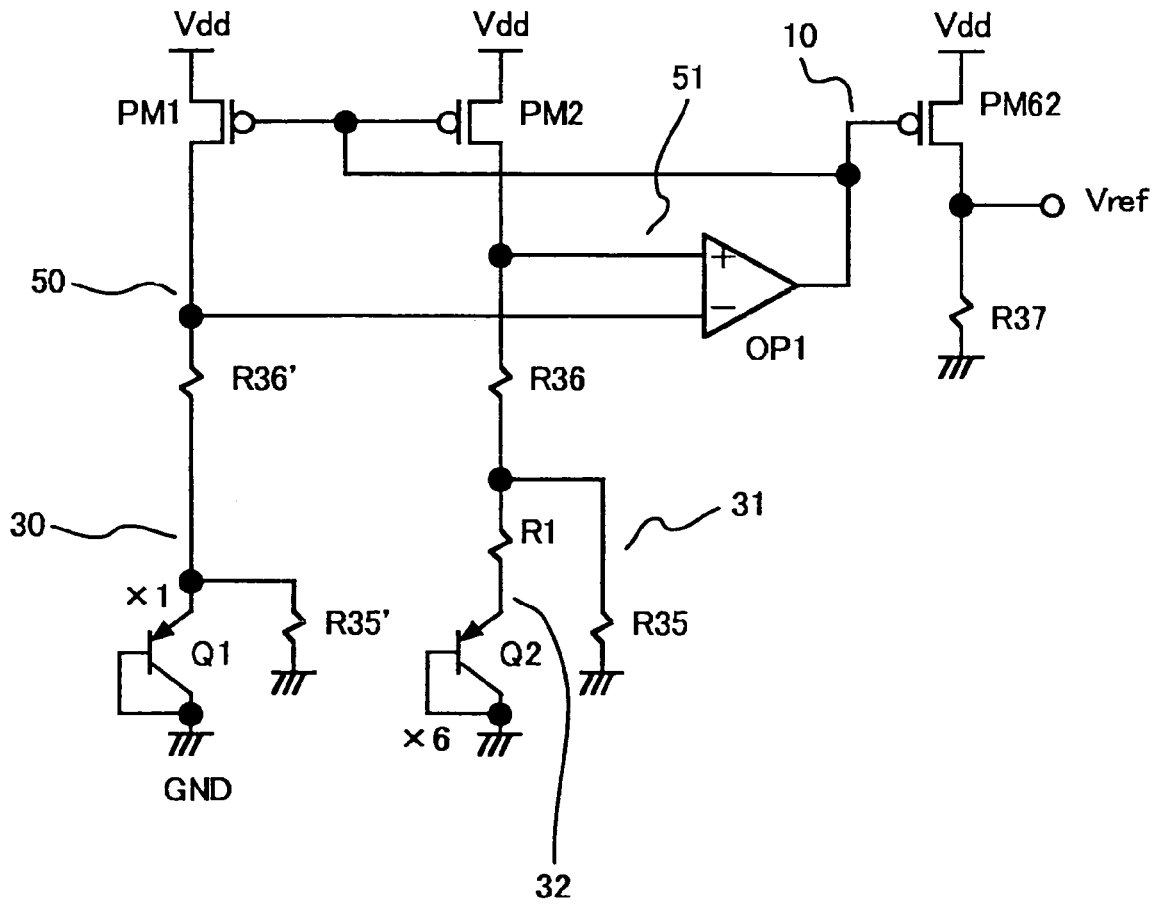
FIG. 38 is a circuit diagram showing a bandgap circuit including an operational amplifier according to yet another embodiment.

FIG. 38 is a circuit diagram which shows a bandgap circuit using an op-amp according to another embodiment of the present invention.

In FIG. 38, Q1 and Q2 indicate pnp bipolar transistors. R1, R35, R35', R36, R36', and R37 indicate resistors. Vref indicates an output reference potential. Vdd indicates a positive power supply. GND indicate a GND terminal. PM1, PM2, and PM62 indicate PMOS transistors. Numeral 10 indicates the bias potential of a PMOS transistor (op-amp output). Numerals 30, 31, 32, 50, and 51 indicate internal nodes. OP1 indicates an op-amp. Elements having the same functions as those shown in FIG. 36, for example, and corresponding nodes are referred to by the same reference numerals. Elements related to control, a starting-up circuit, and phase compensation elements are not shown to make the diagram easy to understand. In the illustrated exemplary embodiment, it is assumed that R35 and R35' are equal in resistance, and R36 and R36' are equal in resistance.

R36 and R36' level shifts the potential 31 corresponding to the emitter potential 30 of Q1 to the positive direction (functions in the same manner as the resistors R31 and R31', respectively, shown in up to FIG. 37). One of the differences between the circuit of FIG. 36 and the circuit of FIG. 38 is the resistors R35 and R35'.

If the potential of the node 30 and the potential of the node 31 are controlled to become equal, the currents flowing through Q1 and Q2 are proportional to absolute temperature in the same manner as the circuits of FIG. 36 and FIG. 37. As will be appreciated, the potential Vbe of the node 30 is reduced as temperature rises (negative temperature dependency) (formula (1)). If the potential difference is divided by the resistance R35, a current that decreases as temperature rises (negative temperature dependency) can be obtained. If the current having the positive temperature dependency flowing through Q1 and Q2 and the current having the negative temperature dependency flowing through the resistors R35 and R35' are appropriately added, the total current becomes independent of temperature.

In other words, the potential at the node 50 obtained by level shifting the emitter potential 30 of Q1 in the positive direction and the potential at the node 51 obtained by level shifting the corresponding potential 31 in the positive direction are controlled to be equal to each other. As a result, the potentials of 30 and 31 become the same potential. As described above, if the potential at the node 30 and the potential at the node 31 becomes equal to each other, the total current of the current flowing through Q1 and Q2 and the current flowing through the resistors R35 and R35' does not depend on temperature. The current that does not depend on temperature is converted into voltage by R37 thereby to obtain the reference voltage independent of temperature.

As described above, the circuit configuration as shown in FIG. 38 can realize the effects of the present invention, and can generate the reference voltage that does not depend on temperature.

Figure 41:
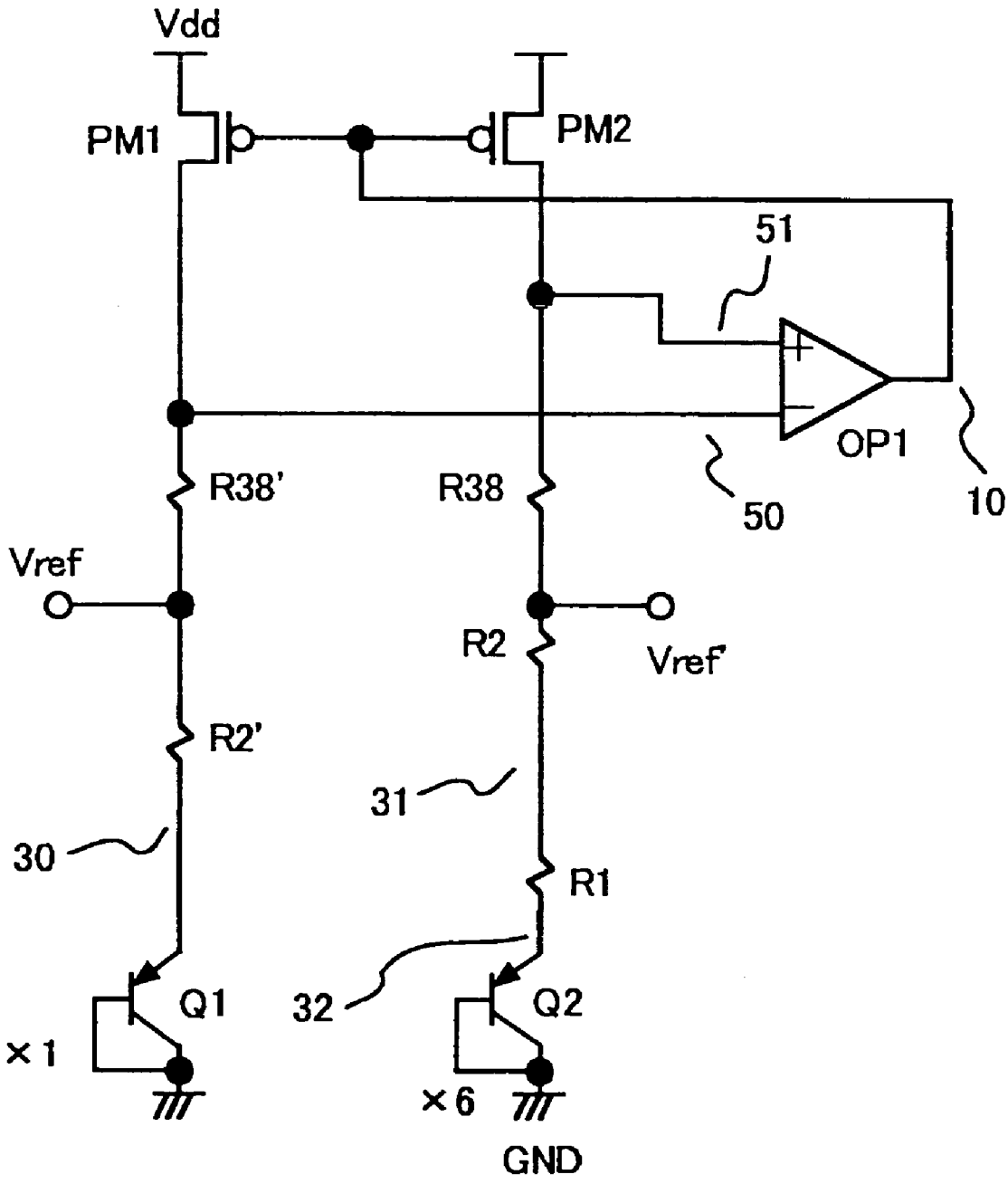
FIG. 41 is a circuit diagram showing a bandgap circuit including an operational amplifier according to yet another embodiment.

FIG. 41 is a circuit diagram which shows a bandgap circuit using an op-amp according to another embodiment of the present invention.

In FIG. 41, Q1 and Q2 indicate pnp bipolar transistors. R1, R2, R2', R38, and R38' indicate resistors. Vref and Vref' indicate output reference potentials. Vdd indicates a positive power supply. GND indicates a GND terminal. PM1 and PM2 indicate PMOS transistors. Numeral 10 indicates the bias potential of a PMOS transistor (op-amp output). Numerals 30, 31, 32, 50, and 51 indicate internal nodes. OP1 indicates an op-amp. Elements having the same functions as those of the circuit shown in FIG. 24 and corresponding nodes are referred to by the same reference numerals. Elements related to control, a starting-up circuit, and phase compensation elements are not shown to make the diagram easy to understand. In the illustrated exemplary embodiment, it is assumed that R2 and R2' are equal in resistance, and R38 and R38' are equal in resistance.

R38, R38', R2, and R2' level shift the emitter potential 30 of Q1 and the corresponding potential 31 in the positive direction (function in the same manner as R31 and R31' shown in FIG. 37). One of the differences between the circuit of FIG. 24 and the circuit of FIG. 41 are the resistors R38 and R38'.

In the description of the circuit shown in FIG. 24, the threshold voltage of NMOS transistor is assumed to be about 0.8 V. Even if the threshold voltage of the NMOS transistor is considerably great, a bandgap circuit can be configured in the same manner as that shown in FIG. 24. FIG. 41 shows a circuit according to an embodiment of the present invention in the case that the threshold voltage of the NMOS transistor is 1.3 V.

Even if the threshold voltage of the NMOS transistor is 1.3 V, which is greater than the bandgap voltage, the emitter potential 30 of Q1 and the corresponding potential 31 are level shifted in the positive direction, and the shifted potentials can be input to the op-amp. Because the threshold voltage of the NMOS transistor, which is about 1.3 V, is greater than the bandgap voltage, the resistors R38 and R38' are provided in addition to the resistors R2 and R2' in order to shift the potential in the positive direction. The potentials 50 and 51 are increased up to a level more than 1.3 V by R38 and R38' and are equalized by the negative feedback, and as a result, the potentials of 30 and 31 become equal. The currents flowing through PM1 and PM2 become the PTAT currents, and generate the bandgap voltage.

One feature of the circuit according to an embodiment of the present invention shown in FIG. 41 is that, even if the threshold voltage of the NMOS transistor is about 1.3 V, which is higher than the bandgap voltage, the NMOS transistor differential input of the op-amp can be operated by level shifting the emitter potential 30 of Q1 and the corresponding potential 31 in the positive direction, and as a result, the circuit operates at a low power supply voltage.

Figure 42:
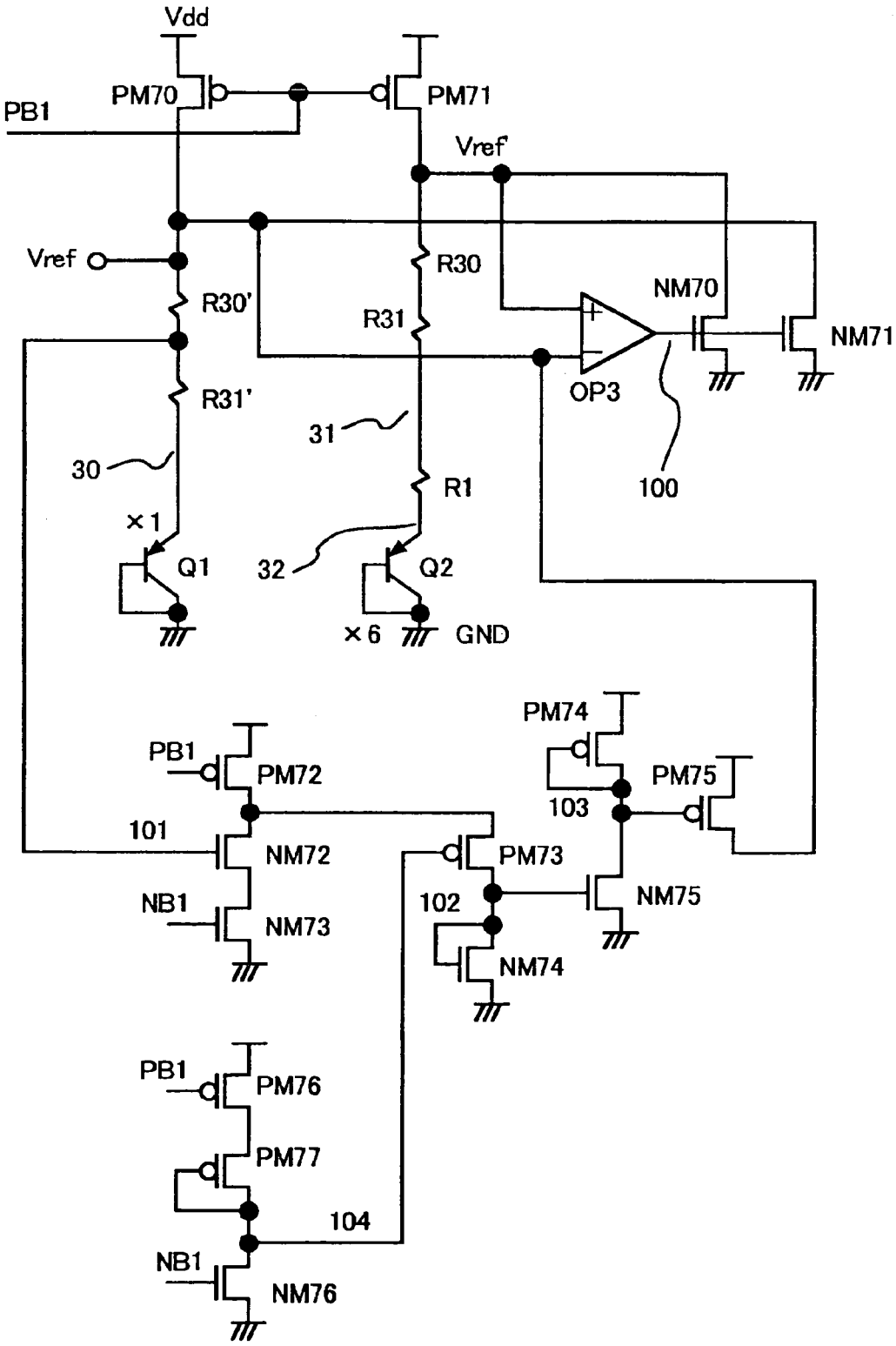
FIG. 42 is a circuit diagram showing a bandgap circuit including an operational amplifier according to yet another embodiment.

FIG. 42 is a circuit diagram which shows a bandgap circuit using an op-amp according to yet another embodiment of the present invention.

In FIG. 42, Q1 and Q2 indicate pnp bipolar transistors. R1, R30, R3', R31, and R31' indicate resistors. Vref and Vref' indicate output reference potentials. Vdd indicates a positive power supply. GND indicates a GND terminal. PM70 through PM77 indicate PMOS transistors. NM70–NM76 indicate NMOS transistors. Numeral 100 indicates bias potential of a NMOS transistor (op-amp output). NB1 indicates the bias potential of the NMOS transistor. PB1 indicates the bias potential of the PMOS transistor. Numerals 30, 31, 32, and 101–104 indicate internal nodes. OP3 indicates an op-amp. Elements having the same functions as those shown in FIG. 24, for example, and corresponding nodes are referred to by the same reference numerals. Elements related to control and phase compensation elements are not shown in the diagram to make the diagram easy to understand. In the illustrated exemplary embodiment, it is assumed that NB1 and PB1 are provided by the circuit of FIG. 27.

A description has been given above of circuits configured so that an op-amp is used for controlling the gate potentials of the PMOS transistors (PM1, PM2), and the current flowing through Q1 and Q2 become the PTAT currents. However, the present invention is applicable to a circuit that controls the gate potential of the PMOS transistors (PM1, PM2) using the op-amp, but not limited to the above embodiments. FIG. 42 shows a circuit in which fixed currents are provided to R1, R30, R30', R31, R31', Q1, and Q2 using PM70 and Pm71, and the gate potential (100) of NM70 and NM71 are controlled thereby to generate a PTAT current.

The inputs of the op-amp OP3 are referred to as Vref and Vref'. The potential of the node 30 is made equal to the potential of the node 31 by the effect of negative feedback as described below. In the exemplary embodiment, it is assumed that the circuit is designed so that the size of NM70 and the size of NM71 are equal. Fixed currents are provided by PM70 and PM71 (both currents are assumed to be equal), and currents of the same amount flow through NM70 and NM71 as well. As a result, differential currents of the same amount flow through R30, R30', R31, and R31'. In the exemplary embodiment, it further is assumed that R30 and R30' are equal in resistance and R31 and R31' are equal in resistance.

If the potential of Vref' is higher than the potential Vref, the potential at the node 100 becomes high, the currents flowing through NM70 and NM71 become great, and as a result, the potential of Vref' is reduced. In contrast, if the potential of Vref' is less than the potential of Vref, the potential at the node 100 is reduced, the currents flowing through NM70 and NM71 are reduced, and as a result, the potential Vref' increases. As a result, Vref and Vref' are made equal. Because R30 and R30' are equal in resistance, and R31 and R31' are equal in resistance, if the potentials of Vref and Vref' become equal, the potential of the nodes 30 and 31 become equal to each other. That is, the currents flowing through Q1 and Q2 become the PTAT currents proportional to absolute temperature as described above with reference to the conventional circuits. Accordingly, bandgap voltages that do not depend on temperature can be generated at Vref and Vref'.

The lower portion of the circuit shown in FIG. 42 including PM72 through PM77 and NM72 through NM76 operate as a starting-up circuit. The operation of the starting-up circuit is described below. In the exemplary embodiment, it is assumed that, in the final stable state of the circuit, the potential of the node 101 is about 0.9 V.

The bias potential PB1 is applied to PM76, and the bias potential NB1 is applied to NM76. A fixed current flows through PM76, PM77, and NM76. If the drain potential of PM76 is in the neighborhood of Vdd, the potential of the node 104 is lower than Vdd by about the threshold voltage of the PMOS transistor.

The bias potential PB1 is applied to PM72, and the bias potential NB1 is applied to NM73. At the same time, the current flowing through NM73 is made greater enough than the current flowing through PM72.

It is assumed that the bandgap circuit is not in the final stable state, and no current is flowing through Q1 and Q2. In this case, the potentials at the node 101, Vref, and Vref' are GND. Since the potential at the node 101 is GND, NM72 is turned off, and the current provided by PM72 does not flow through NM72. The current provided by PM72 flows to NM74 via PM73. Since a current flows through NM74, the potential of the node 102 increases, and a current flows through NM75 and PM74. The current flowing through PM74 causes a current to flow through PM75, and this current increases the potential of Vref. Whereas the potential of Vref' is GND, the potential of Vref increases. As a result, the potential at the node 100 is reduced, and the current of NM70 and NM71 decrease. Because the currents of NM70 and NM71 decrease, the current flowing in PM70 and PM71 increases the potential of Vref'. As both potentials of Vref and Vref' increase, the op-amp OP3 operates so as to make Vref and Vref' equal to each other, and make the circuit stable.

When the potentials of Vref and Vref' are made equal, the potential of the node 101 has been increased up to about 0.9 V, and the current of PM72 also flows to NM72. Because the current of NM73 is set greater enough than the current of PM72, the entire current of PM72 flows to NM73 via NM72. Because the entire current of PM72 flows to NM73, no current flows to PM73, and no current flows to NM74, NM75, and PM74. Since no current flows to PM74, no current flows to PM75, and as a result, the starting-up circuit is separated from the other part of the circuit.

Figure 43:
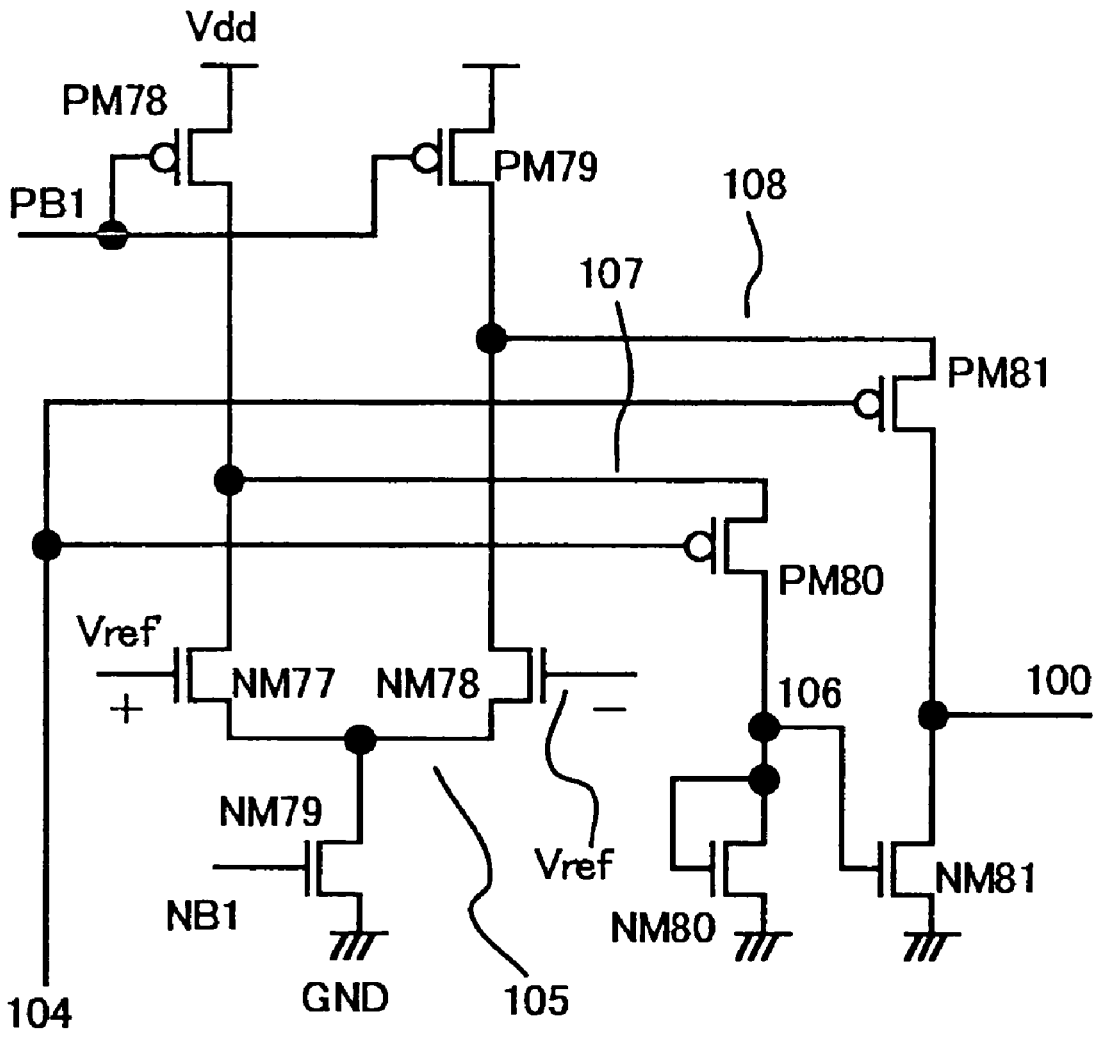
FIG. 43 is a circuit diagram showing an operational amplifier suitable for the circuit shown in FIG. 42.

FIG. 43 is a circuit diagram showing an op-amp circuit suitable for the circuit configuration shown in FIG. 42.

In FIG. 43, Vdd indicates a positive power supply. GND indicates a GND terminal. PM78–PM81 indicate PMOS transistors. NM77–NM81 indicate NMOS transistors. Numeral 100 indicates bias potential of a NMOS transistor (op-amp output). NB1 indicates the bias potential of a NMOS transistor. PB1 indicates the bias potential of a PMOS transistor. 105–108, Vref, and Vref' indicate internal nodes. In addition, elements having the same functions as those shown in FIG. 42, for example, and corresponding nodes are referred to by the same reference numerals. Elements related to control, and phase compensation elements are not shown to make the diagram easy to understand. In the illustrated exemplary embodiment, it is assumed that NB1 and PB1 are provided by the circuit of FIG. 27. It is further assumed in the exemplary embodiment that the gate potential 104 of PM80 and PM81 is provided by the circuit 104 of FIG. 42.

The circuit shown in FIG. 43 is a general folded cascode circuit. Accordingly, its operation is not described below in detail, and a description about the polarity of signals is given below. If the potential of Vref' is high, the current flowing in NM77 increases, and the current flowing in NM80 decreases. As a result, the potential of the node 106 is reduced. As the current flowing through NM78 is reduced, the current flowing through PM81 increases. The potential at the node 106 decreases, and the current flowing through NM81 is reduced. The current flowing through PM81 increases, and since the current of NM81 decreases, the potential at the node 100 increases. In contrast, if Vref' is lower than Vref, it is obvious that the potential of the node 100 decreases.

The features of the circuits shown in FIGS. 42 and 43 are described below.

In the case of the circuit shown in FIG. 42, a fixed current is provided from Vdd by the fixed current source, and the op-amp controls the gate potential of the NMOS transistors thereby to generate the bandgap voltage. Since the circuit is configured in this manner, the circuit shown in FIG. 42 is prevented from being affected by power supply noise compared to the circuit shown in FIG. 24.

The effects of the phase compensation capacitor and the power supply noise are described below with an assumption of the most general Miller compensation.

In the case where the op-amp controls the gate potential of the PMOS transistor (PM1), the phase compensation capacitor is provided between the gate of the PMOS transistor and the output reference potential as C10 shown in FIG. 25.

In the case where the phase compensation capacitor is provided between the output reference potential above GND by a fixed potential and the gate of the PMOS transistor, if the power supply Vdd includes noise, the gate potential 10 of the PMOS transistor tries to stay at a fixed potential above GND. Accordingly, the voltage between the gate and source of PM1 fluctuates causing the output reference potential. (As will be appreciated, that there is a potential difference between the gate potential 10 of the PMOS transistor and Vdd).

On the other hand, in the case of the circuit of FIG. 42, since the gate potential 100 of the NMOS transistor NM71 is controlled by the op-amp, the phase compensation capacitor of the general Miller compensation is provided between the node 100 and Vref. Both the gate potential 100 of the NMOS transistor NM71 and Vref are signals in which the potential difference from GND matters. Even if the power supply Vdd is noisy, the gate potential 100 of the NMOS transistor NM71 and Vref are not affected by the noise on the power supply.

As described above, in the case of the circuit shown in FIG. 42, a fixed current is provided from Vdd using the fixed current source, and the gate potential of the NMOS transistor is controlled by the op-amp thereby to generate the bandgap voltage. Accordingly, the effect of the noise on the power supply Vdd can be reduced.

As described above, the circuits shown in FIGS. 42 and 43 can realize a low voltage operation in accordance with the present invention. In addition, as shown in FIG. 42, fixed currents are provided to R1, R30, R30', R31, R31', Q1, and Q2 by PM70 and PM71 thereby to control the gate potential (100) of NM70 and NM71, respectively. According to the above arrangements, the currents of the node 30 and 31 are made equal, and the PTAT current is generated. As will be appreciated, the circuits according to embodiments of the present invention can be modified without departing from the scope of the present invention.

The present invention is not limited to these embodiments, but various variations and modifications may be made without departing from the scope of the present invention.

What is claimed is:

1. A semiconductor integrated circuit, comprising:

a current generator circuit configured to generate a first current substantially proportional to an absolute temperature, the first current being determined by size ratio of MOS transistors, and by a resistor; and a starting-up circuit configured to set said current generator circuit at a stable working point in which said current generator circuit generates the first current, wherein a current that flows through said starting-up circuit when said current generator circuit operates at the stable working point is determined by a resistance and MOS transistors connected in series provided in said starting-up circuit.

2. The semiconductor integrated circuit as claimed in claim 1, further comprising:

a voltage generator circuit that generates a reference voltage substantially independent of the absolute temperature using the first current generated by said current generator circuit.

3. The semiconductor integrated circuit as claimed in claim 2, wherein said voltage generator circuit comprises:

one of a bipolar transistor and a diode; and a resistor connected to said bipolar transistor or said diode; and said voltage generator generates the reference voltage by flowing a second current proportional to the first current through a series of the one of the bipolar transistor and the diode, and the resistor.

4. A semiconductor integrated circuit, comprising:

a current generator circuit that generates a first current substantially proportional to an absolute temperature; and a voltage generator circuit that generates a reference voltage substantially independent of the absolute temperature using the first current generated by said current generator circuit, wherein said voltage generator circuit comprises:

a first element that generates a voltage that is substantially linearly reduced as the absolute temperature increases;

a resistance division circuit connected in parallel to said first element;

a second element connected to the parallel connection of said first element and said resistance division circuit, wherein said second element provides a second current proportional to the first current; and a third element connected to a node between resistors of said resistance division circuit, wherein said third element provides a third current proportional to the first current.

5. The semiconductor integrated circuit as claimed in claim 4, wherein said first element is one of a bipolar transistor and a diode.

6. The semiconductor integrated circuit as claimed in claim 4, wherein said current generator circuit generates the first current determined by a size ratio of a MOS transistor, and by a resistor.

7. A semiconductor integrated circuit, comprising:

a first NMOS transistor that is provided with a voltage to a gate thereof, which voltage is generated by dividing a power supply voltage with resistors;

a second NMOS transistor that is provided with a reference voltage to a gate thereof;

a first PMOS transistor and a second PMOS transistor diode-connected to each other;

a third PMOS transistor, a gate of which is connected to a gate electrode of said first PMOS transistor;

a fourth PMOS transistor, a gate of which is connected to a gate electrode of said second PMOS transistor;

a third diode-connected NMOS;

a fourth NMOS transistor, a gate of which connected to the gate of said third NMOS transistor, and a first resistor, wherein a source electrode of said first NMOS transistor and a source electrode of said second NMOS transistor are connected to each other;

a drain of said first NMOS transistor and a drain of said first PMOS transistor are connected to each other;

a drain of said second NMOS transistor and a drain of said second PMOS transistor are connected to each other;

a drain of said third PMOS transistor and a drain of said third NMOS transistor are connected to each other; p1 a drain of said fourth PMOS transistor and a drain of said fourth NMOS transistor are connected to each other;

a first end of said first resistor is connected to the power supply voltage;

a second end of said first resistor is connected to the drain of said fourth PMOS transistor and to the drain of said fourth NMOS transistor; and the semiconductor integrated circuit outputs a voltage of the second end of said first resistor for determining whether the power supply voltage is lower than a predetermined voltage.

8. The semiconductor integrated circuit as claimed in claim 7, wherein the reference voltage is generated by the semiconductor integrated circuit as claimed in claim 2.

9. A semiconductor integrated circuit, comprising:

a first pnp bipolar transistor;

a second pnp bipolar transistor;

a first resistor connected in series to an emitter of said first pnp bipolar transistor;

a second resistor connected in series to an emitter of said second pnp bipolar transistor;

a third resistor connected in series to an end of said first resistor, resistance of said third resistor is equal to the resistance of the second resistor; and an operational amplifier that is provided with a voltage generated by level-shifting an emitter voltage of said second pnp bipolar transistor to a positive direction with said second resistor as a first input, and with a voltage generated by level-shifting a voltage at the end of said first resistor to a positive direction with said third resistor as a second input, wherein said operational amplifier receives the first input and the second input as a gate input of a differential pair of NMOS transistors, and is negatively fed back so that a voltage of the first input and voltage of the second input are equalized.

10. The semiconductor integrated circuit as claimed in claim 9, further comprising:

a voltage generator circuit that generates a reference voltage substantially independent of an absolute temperature using a first current flowing through said first pnp bipolar transistor, wherein said voltage generator circuit further comprises:

a first element that generates a voltage that is substantially linearly reduced as the absolute temperature increases;

a resistance division circuit connected in parallel to said first element;

a second element that provides a second current proportional to the first current, said second element connected in parallel to the parallel connection of said first element and said resistance division circuit; and a third element that provides a third current proportional to the first current, the third element connected to a node between resistors of said resistance division circuit.

11. The semiconductor integrated circuit as claimed in claim 1, wherein the resistance that determines the current that flows through said starting-up circuit when said current generator circuit operates at the stable working point is a diffusion resistance.

* * * * *